US006038424A

United States Patent [19]

Nakagawa

[11] Patent Number: 6,038,424

[45] Date of Patent: Mar. 14, 2000

[54] SHEET CONVEYING APPARATUS AND IMAGE FORMING APPARATUS PROVIDED WITH THE SAME

[75] Inventor: Tomohito Nakagawa, Kashiwa, Japan

[73] Assignee: Canon Kabushiki Kaisha, Tokyo, Japan

[21] Appl. No.: 09/067,013

[22] Filed: Apr. 27, 1998

[30] Foreign Application Priority Data

Apr. 28, 1997 [JP] Japan ..... 9-111545
May 20, 1997 [JP] Japan ..... 9-130135

[51] Int. Cl.[7] ..... G03G 21/00

[52] U.S. Cl. ..... 399/367; 271/10.1; 271/109; 271/264; 271/270; 358/498

[58] Field of Search ..... 399/367, 361; 271/10.1, 14, 42, 225, 262, 109, 264, 270, 302, 303; 358/296, 496, 497, 498

[56] References Cited

U.S. PATENT DOCUMENTS

| | | | |
|---|---|---|---|
| 4,667,951 | 5/1987 | Honjo et al. | 271/270 X |
| 5,351,112 | 9/1994 | Naito et al. . | |
| 5,401,012 | 3/1995 | Taruki . | |
| 5,455,667 | 10/1995 | Hiroi et al. . | |
| 5,552,859 | 9/1996 | Nakagawa et al. . | |
| 5,579,083 | 11/1996 | Naito et al. . | |
| 5,621,501 | 4/1997 | Matsuo et al. . | |
| 5,799,237 | 8/1998 | Ueda et al. | 399/367 |
| 5,812,912 | 9/1998 | Hiroi et al. | 399/367 X |
| 5,819,151 | 10/1998 | Naito et al. | 399/367 X |
| 5,825,512 | 10/1998 | Okita | 358/496 |

FOREIGN PATENT DOCUMENTS

| | | |
|---|---|---|
| 0 551 862 | 7/1993 | European Pat. Off. . |
| 0 647 888 | 4/1995 | European Pat. Off. . |
| 0 750 235 | 12/1996 | European Pat. Off. . |
| 60-83025 | 5/1985 | Japan . |
| 63-180642 | 7/1988 | Japan . |
| 7-196181 | 8/1995 | Japan . |

*Primary Examiner*—Susan S. Y. Lee
*Attorney, Agent, or Firm*—Fitzpatrick, Cella, Harper & Scinto

[57] ABSTRACT

A sheet conveying apparatus has a stacking portion on which sheets are stacked, a separating unit for separating and paying away the sheets tacked on the stacking portion, a feeder for feeding the sheets downstream of the separating unit, a plurality of conveyance paths leading from the separating unit to the feeder, and a switching device for switching the plurality of conveyance paths, the separating unit being effective to feed the sheets at a speed higher than the feeding speed of the feeder.

17 Claims, 50 Drawing Sheets

| FIG. 30A | FIG. 30B |
|---|---|

| FIG. 39A |
| --- |
| FIG. 39B |

SHEET CONVEYING APPARATUS AND IMAGE FORMING APPARATUS PROVIDED WITH THE SAME

BACKGROUND OF THE INVENTION

1. Field of the Invention

This invention relates to a sheet conveying apparatus applicable to an image forming apparatus such as a copying apparatus or an LBP and a sheet reading apparatus and an image forming apparatus provided with the sheet conveying apparatus. It particularly relates to a sheet conveying apparatus provided with a separating device and a sheet supplying device for separating and supplying out a plurality of sheets one by one, and mounting or conveying them on or to a predetermined position.

2. Related Background Art

A sheet conveying apparatus separates a plurality of sheets stacked on a tray or the like one by one in a sperating portion and supplies them to a predetermined position. Such a sheet conveying apparatus is applied to an automatic original feeding apparatus or the like for automatically feeding sheet-like originals to the image reading portion of an image forming apparatus such as a copying apparatus.

An example of an original conveying apparatus (sheet conveying apparatus) will hereinafter be described with reference to FIG. 49 of the accompanying drawings.

An original conveying apparatus 802 provided in an image forming apparatus 801 feeds a plurality of sheet-like originals stacked on an original tray 804 to a separating portion in succession from the uppermost sheet by the rotation of a sheet feeding roller 805. The separating portion is provided with a separating-conveying roller 808 rotatable in a sheet feeding direction, and a separating belt 806 rotatable in a direction for returning the originals, so that originals fed are separated and supplied one by one by the action of the separating-conveying roller 808 and the separating belt 806.

A first sheet supplying roller 816 supplies the originals separated and fed in this manner toward the downstream side, and abut them against a stationary second sheet supplying roller 809 to form a loop to thereby correct the skew-feed of the originals and to register the leading ends thereof with the second sheet supplying roller. Thereafter, at suitable timing, the second sheet supplying roller 809 is rotated to thereby further feed out the originals toward the downstream side. At this time, a drive roller 836 over which a conveying belt 807 is wound is rotatively driven, so that the original is conveyed on a platen 803 by the conveying belt 807 and is placed on a predetermined reading position.

As an image reading system, there is a system for reading an image while conveying an original with an image reading portion fixed (a flow-reading system), besides a system for reading an image while moving an image reading portion with an original fixed on the platen 803 (a fixed-reading system). These two systems are selectively used depending on the difference in the kind of sheet or the mode.

When the reading of the original image is finished, the conveying belt 807 is driven again to thereby convey the original to a sheet discharge tray 810. Finally, the original is discharged onto the sheet discharge tray 810 by sheet discharge rollers 811 and 812. In FIG. 49, the reference numeral 200 designates a reader unit for reading an image, and the reference numeral 300 denotes an image forming unit for forming an image.

In the above-described example of the prior art, however, when the originals are being separated and conveyed by the separating portion, the separating belt 806 is being rotated in a direction to return the original in order to binder the entry of the next original. Therefore, in some cases, the rectilinearity of conveyance of the original has been unstable.

Also, depending on the friction state of the surface of the original, the separating belt has come not to follow the rotation of the separating-conveying roller 808 (the slip of the original and the roller) and the separating-feeding time has sometimes been late. In such an apparatus, the presence of the occurrence of the delay in the separation of the original is monitored on the basis of the result of the detection by a separation sensor which monitors the originals. Therefore, in the worst case, it has been judged by a control device that a delay in the separation of the original has occurred (the sensor does not detect even when a predetermined time has passed), and the apparatus might been stopped.

Also, in the flow-reading mode, it is necessary during the reading of an image to separate the next original and convey it to a reading standby position. However, if a delay in separation occurs, the next original is not conveyed to the standby position, and therefore the time (productivity) for continuously reading the images of a plurality of originals is reduced. To prevent the occurrence of a delay in separation, it is conceivable to increase the separating-conveying speed. However, this may cause the leading end of the next original to abut against the trailing end of an original under the image reading to thereby cause sheet jam.

SUMMARY OF THE INVENTION

It is the object of the present invention to provide a sheet conveying apparatus capable of effecting high-speed conveyance of sheets, and an image forming apparatus capable of effecting high-speed image formation.

As a first mode of the present invention, there is provided a sheet conveying apparatus provided with a stacking portion on which sheets are stacked, separating means for separating and feeding out the sheets stacked on said stacking portion, feeding means for feeding the sheets on the downstream side of said separating means, a plurality of conveyance paths leading from said separating means to said feeding means, and switching means for switching said plurality of conveyance paths. It is characterized by that said separating means feeds out said sheets at a speed higher than the feeding speed of said feeding means.

As a second mode of the present invention, there is provided a sheet reading apparatus characterized by the sheet conveying apparatus of the first mode, and reading means for reading the sheets conveyed by said sheet conveying apparatus.

As a third mode of the present invention, there is provided an image forming apparatus characterized by the sheet conveying apparatus of the first mode, reading means for reading the images of the sheets conveyed by said sheet conveying apparatus, and image forming means for forming the images read by said reading means on a recording medium.

The operation of the present invention will now be described.

The separating means feeds out the sheets at a speed higher than the feeding speed of the feeding means. Accordingly, the stoppage of the apparatus and the reduction in productivity attributable to a delay in separation do not occur. Also, the plurality of conveyance paths are switched by the switching means and properly used, whereby the next sheet can be prevented from catching up with and colliding against a sheet conveyed earlier.

Also, it is possible to make the distance between the trailing end of a preceding sheet and the leading end of a succeeding sheet infinitely "zero". This is because a gap of a certain value is formed to detect the distance between the sheets immediately after the separation thereof (it is always necessary), but thereafter this gap can be made infinitely "zero".

In the present invention, the separating and feeding out speed is set to a value higher than the feeding speed, and therefore even if the sheet comes not to follow the rotation of the separating means due to the state of the sheet or the friction state of the surface thereof, the separating and feeding out time is not delayed. Accordingly, the stoppage of the apparatus or the reduction in productivity by a delay in separation can be prevented. Also, by the plurality of paths being properly used, it does not happen that even if the next sheet catches up with the preceding sheet, the sheets abut against each other or sheet jam occurs.

DESCRIPTION OF THE PREFERRED EMBODIMENTS

Figure 1:
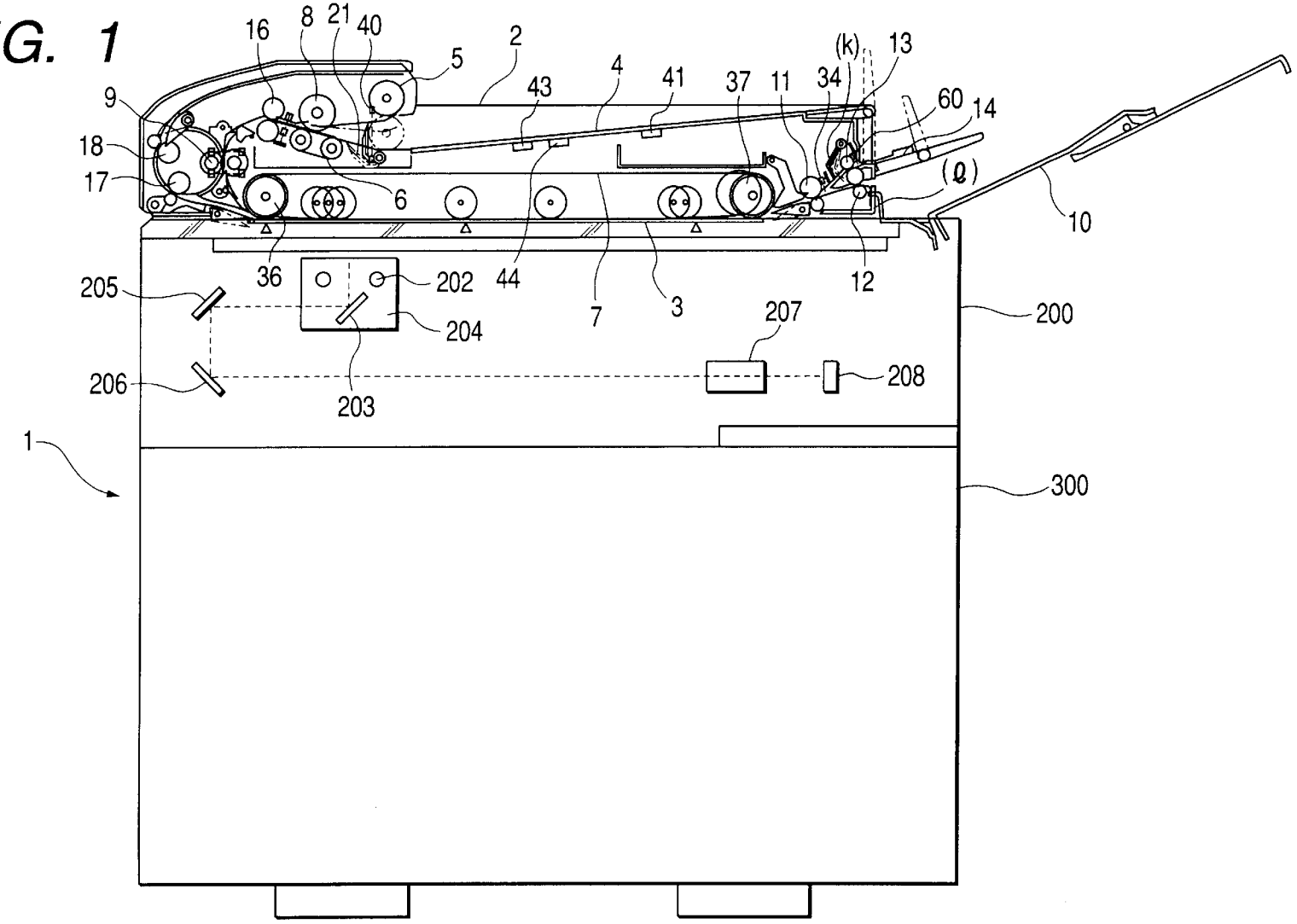
FIG. 1 shows the construction of an image forming apparatus, particularly, an ADF, which is an embodiment of the present invention.

An image forming apparatus which is an embodiment of the present invention will hereinafter be described with reference to the drawings.

In the embodiment hereinafter described, "separating means" is realized by a separating-conveying roller 8, a separating belt 6, a separate motor 100, and a control device, etc. "Feeding means" is realized by second feeding rollers 9, a convey motor 101, a control device, etc. "Switch means" is realized by a separate flapper 70, a separate flapper solenoid 110 and a control device. What a correspond to "a plurality of conveyance paths" are a first path 71 and a second path 72.

[Summary of Image Forming Apparatus] . . . see FIG. 1

The image forming apparatus according to the present embodiment, as shown in FIG. 1, is provided with a copying apparatus body or main body 1 comprised of an image inputting unit (hereinafter referred to as a "reader unit") 200 and an image outputting unit (hereinafter referred to as a "printer unit") 300, and an original conveying apparatus (hereinafter referred to as the "ADF") 2 disposed above the copying apparatus body 1.

The reader unit 200 optically reads the image of an original placed on platen glass (platen) 3 which is a reading position in the copying apparatus body 1, photoelectrically converts it and inputs it as image data. The reader unit 200 has the platen 3, a scanner unit 204 having a lamp 202 and a mirror 203, mirrors 205 and 206, a lens 207, an image sensor 208, etc.

The printer unit 300 is well-known image forming means for outputting the image read by the reader unit 200 to a predetermined sheet. The printer unit 300 will be described later in detail with reference to FIG. 2.

The ADF 2 is for conveying an original to a predetermined reading position in the copying apparatus body 1, and has an original tray 4 on which originals are stacked above itself. Also, below the ADF 2, there is disposed a wide belt 7 passed over a drive roller 36 and a turn roller 37. The originals on the original tray 4 may be separated in succession from the uppermost one and conveyed to the platen glass (platen) 3 which is a reading position in the copying apparatus body 1.

The wide belt 7 bears against the upper surface of the platen 3, and places the originals conveyed from the original tray 4 on a predetermined position on the platen 3, and feed out the originals on the platen 3 onto a sheet discharge tray 10. The originals are placed on the tray 4 in the order or sequence of page 1 (page 2), page 3 (page 4), . . . from above. The ADF 2 will be described later in detail.

The present invention is also applicable to a reading apparatus in which the reader unit 200 and the ADF 2 are made integral with each other. The copying apparatus body 1 can also be provided with the ADF 2.

The details of each of said units will hereinafter be described.

[ADF 2]

The ADF 2 will hereinafter be described in detail with respect to each portion thereof.

1. Construction of the Original Tray and Its Surroundings

Figure 4:
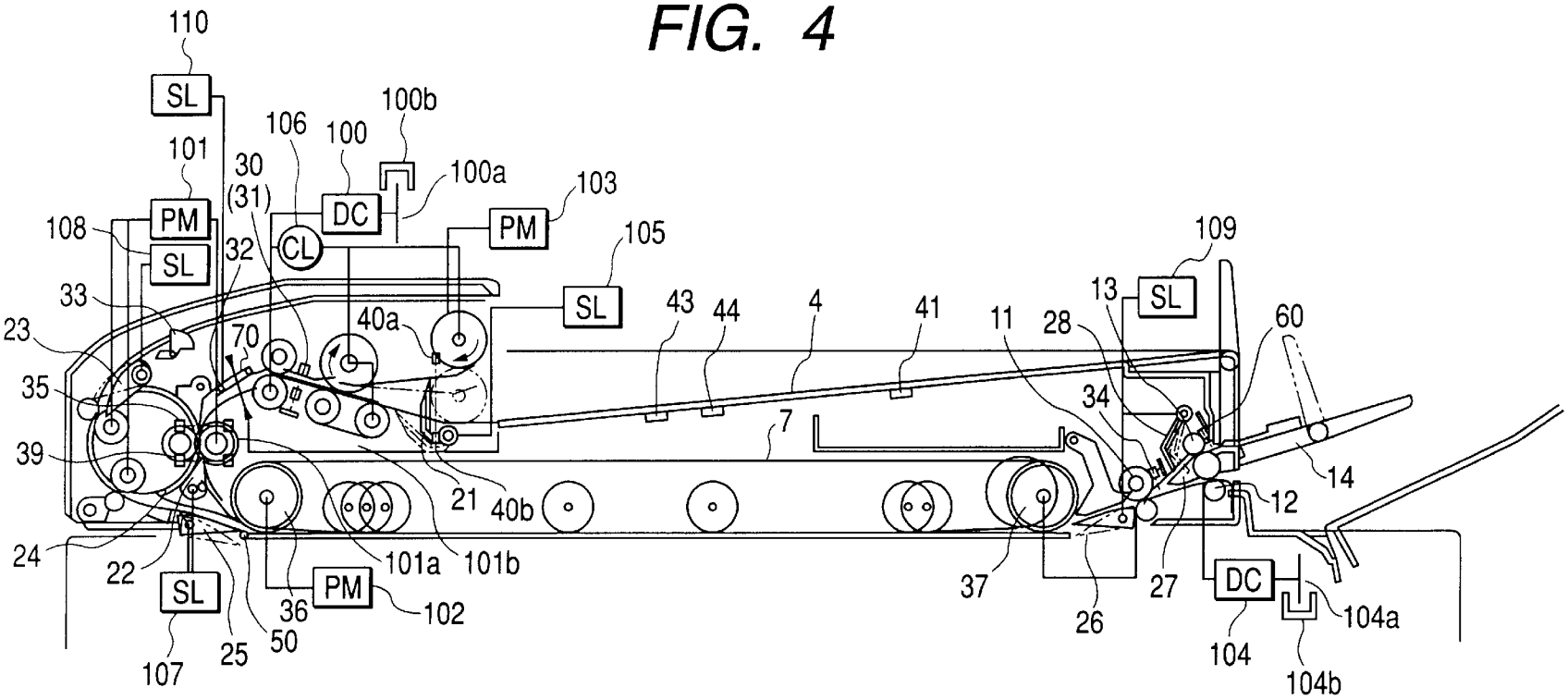
FIG. 4 shows the driving system of the ADF.

1) Original Tray . . . see FIG. 4

The original tray 4 is for stacking sheet-like originals thereon. The original tray 4 has a pair of widthwise direction regulating plates slidably disposed thereon in the widthwise direction of the original, whereby the widthwise direction of the originals placed on the original tray 4 can be regulated. Thus, the stability during the feeding of the originals is secured.

A pivotally movable stopper 21 is disposed on the downstream side end portion of the original tray 4 with respect to the direction of conveyance. This stopper 21 can be pivotally moved to a predetermined angular position as required to thereby prevent the originals set on the original tray 4 from inadvertently moving to the downstream side.

2) Sensors on the Original Tray . . . see FIG. 4

Near the upstream portion of the stopper 21, there are provided original set detect sensors (herein, transmission type optical sensors) 40*a* and 40*b* for detecting that a bundle of originals has been set.

Further, in the middle of the original tray 4, there is provided an original trail end detect sensor (herein, a reflection type optical sensor) 41 for determining whether the size of the set originals is a half-size. This original trail end detect sensor 41 is disposed at a distance of 225 mm from the stopper 21, and is designed such that the detection state thereof becomes "ON" when long originals are set.

Intermediately of the original set detect sensor 40 and the trail end detect sensor 41, there is provided a final original detect sensor (here, a reflection type optical sensor) 43. The result of the detection by this final original detect sensor 43 is used to determine whether the original being conveyed is the final original.

Further, in the lower portion of the original tray 4, there is provided a sheet width detect sensor 44 for detecting the width of the bundle of originals P set on the original tray 4. Actually, however, this sheet width detect sensor 44 is adapted to detect the positions of the widthwise direction regulating plates.

Figure 5:
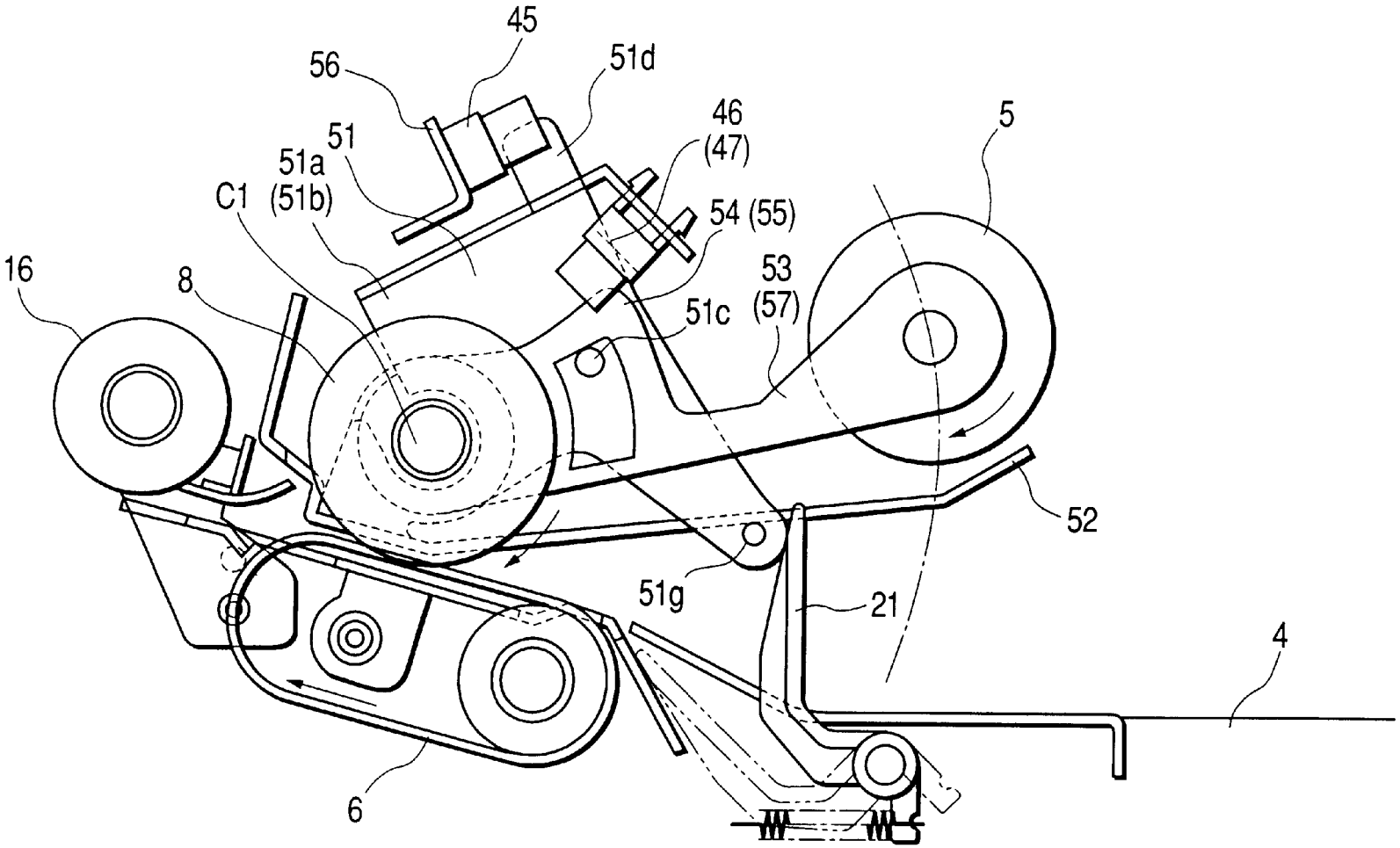
FIG. 5 shows the operation of the separating portion (seen along the line 5—5 of FIG. 9) of the ADF.

2. Sheet Supplying—Separating Mechanism . . . see FIGS. 5, 6, 7, 8, 9, 10A, 10B and 10C As shown in FIG. 5, above the original tray 4, a rocking arm 53 and a lift arm 51 are constructed for rocking about the center C1 of the rotary shaft of a separating-conveying roller 8. Further, the rocking arm 53 has its rocking movement regulated by an arm shaft 51*c* supported through support plates 51*a* and 51*b* before and behind the lift arm 51. A sheet supply roller 5 is provided on the tip end of the rocking arm 53.

Usually, the sheet supply roller 5 is deterred by the arm shaft 51*c* and is retracted to its home position (FIG. 5) above a separating upper guide plate 52 (deterred by a pin 51*g*) and therefore does not hamper the original setting work. The lift arm 51, as will be described later, is controlled by a rock motor 103 (see FIG. 4) and is at the shown position. Some of parts constituting the sheet supplying—separating mechanism are divisionally shown in FIGS. 10A to 10C.

Figure 8:
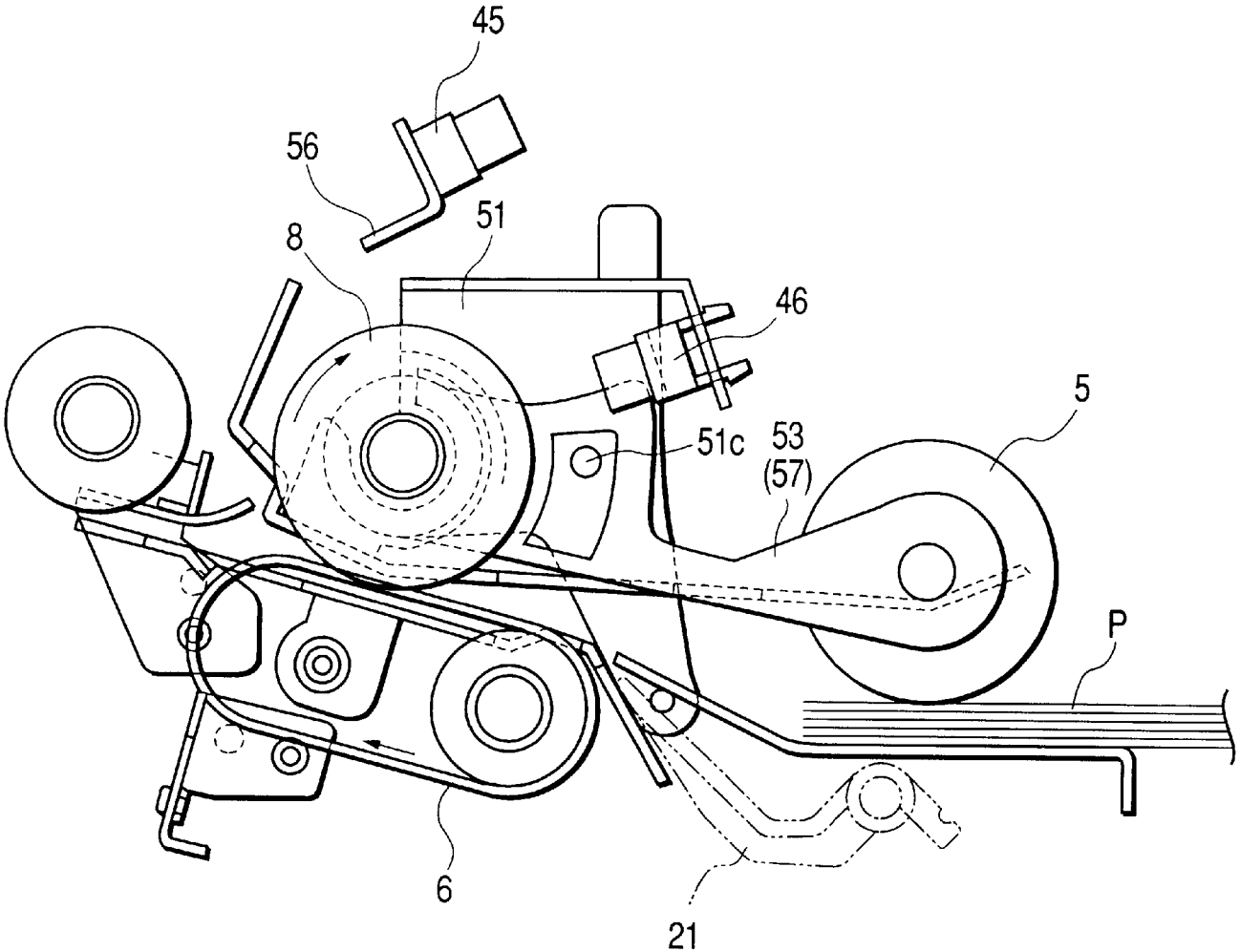
FIG. 8 shows the operation of the separating portion (seen along the line 5—5 of FIG. 9) of the ADF.
Figure 9:
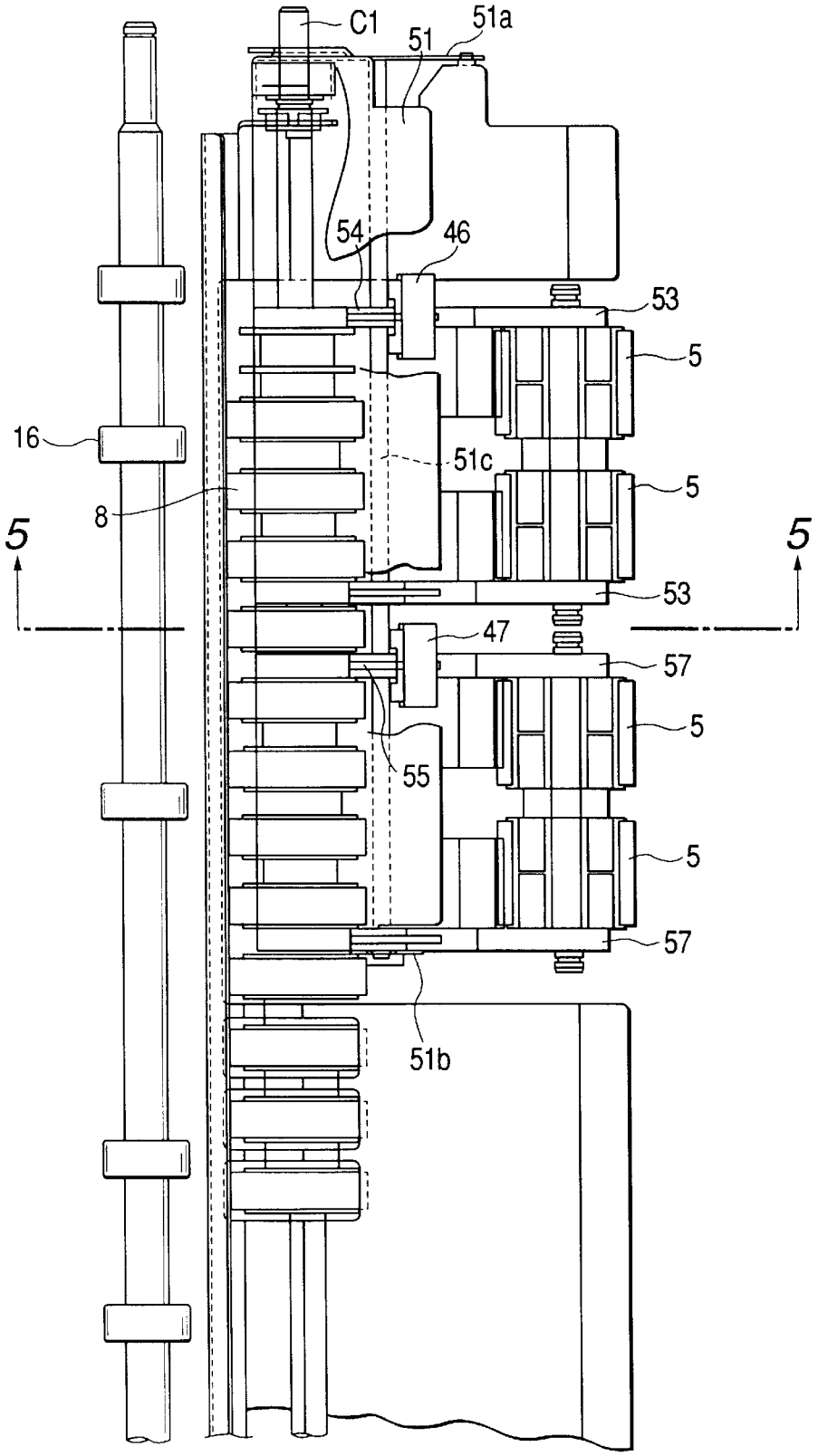
FIG. 9 is a plan view of the ADF.
Figure 10A:
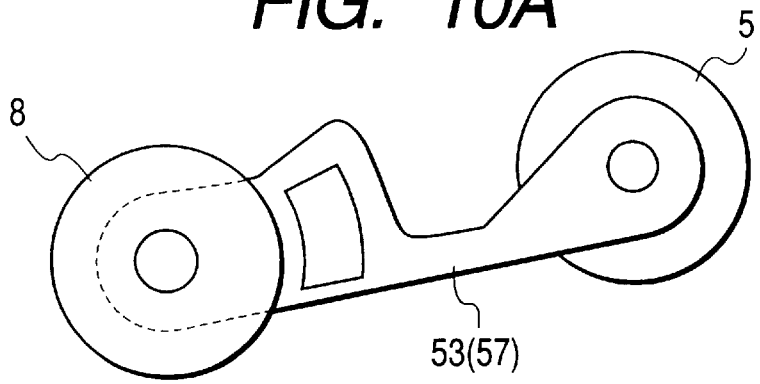
FIGS. 10A, 10B and 10C show the constructions of the main members of the ADF.
Figure 10B:
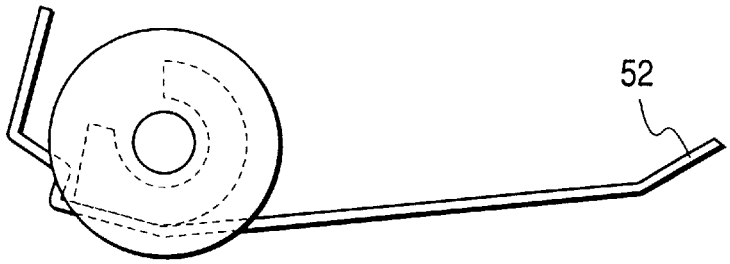
Figure 10C:
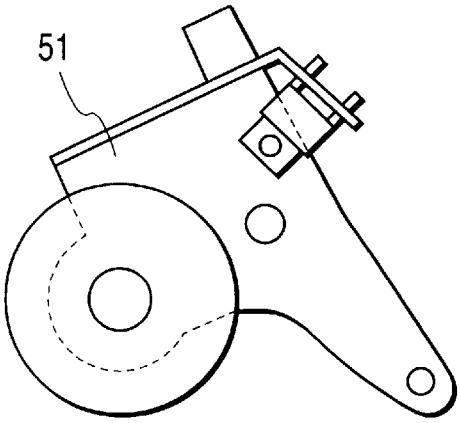

FIG. 9 is a plan view of the sheet supplying—separating construction. The lift arm 51 is pivotally moved about the center C1 of the rotary shaft, whereby it is movable from a state (position) shown in FIG. 5 to a state (position) shown in FIG. 6. As previously described, the sheet supply roller 5 is provided on the tip ends of the rocking arms 57 and 53 rotatively movable about the center C1 of the rotary shaft. When the rocking arms 57 and 53 lower from gravity with the movement of the lift arm 51, the sheet supply roller 5 lands on the uppermost one of the originals P and stops (the position of FIG. 8). In this state, the sheet supply roller 5 is rotated, whereby the originals P can be conveyed in succession from the uppermost sheet. The upper guide plate 52 is deterred in the position of FIG. 6 by a stopper (not shown).

The arm shaft 51*c* which has supported the rocking arms 57 and 53 in the state of FIG. 8 has its engagement released at a point of time whereat the sheet supply roller 5 has landed on the surface of the uppermost original. By the engagement having been released at this time, deviation begins to occur to the relative positional relation among the rocking arms 57, 53 and the lift arm 51. The amount of this deviation is designed to be detected by a first rocking arm flag 54 and a second rocking arm flag 55 which are portions of the rocking arms 57, 53, and a first rock position sensor 46 and a second rock position sensor 47 mounted on the lift arm 51. When the states of the first rock position sensor 46 and the second rock position sensor 47 change from their non-detecting states to their detecting states (see FIG. 8), the rocking arms 57 and 53 are subjected to stop control.

In this state, the rocking arms 57, 53 and the sheet supply roller 5 rest from gravity on the bundle of originals P stacked on the tray 4, and can therefore always impart a stable feeding force to the originals P.

Figure 6:
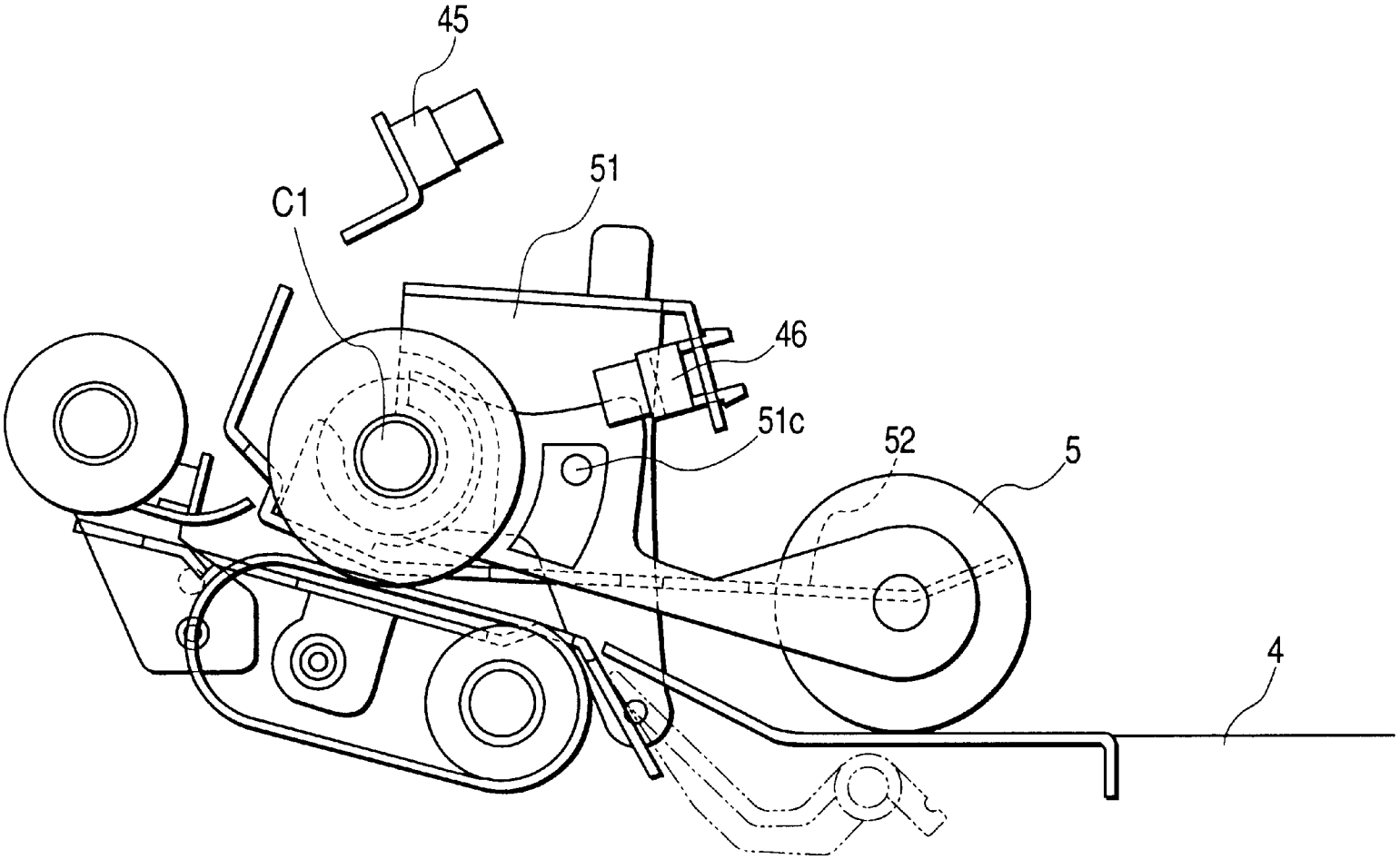
FIG. 6 shows the operation of the separating portion (seen along the line 5—5 of FIG. 9) of the ADF.
Figure 7:
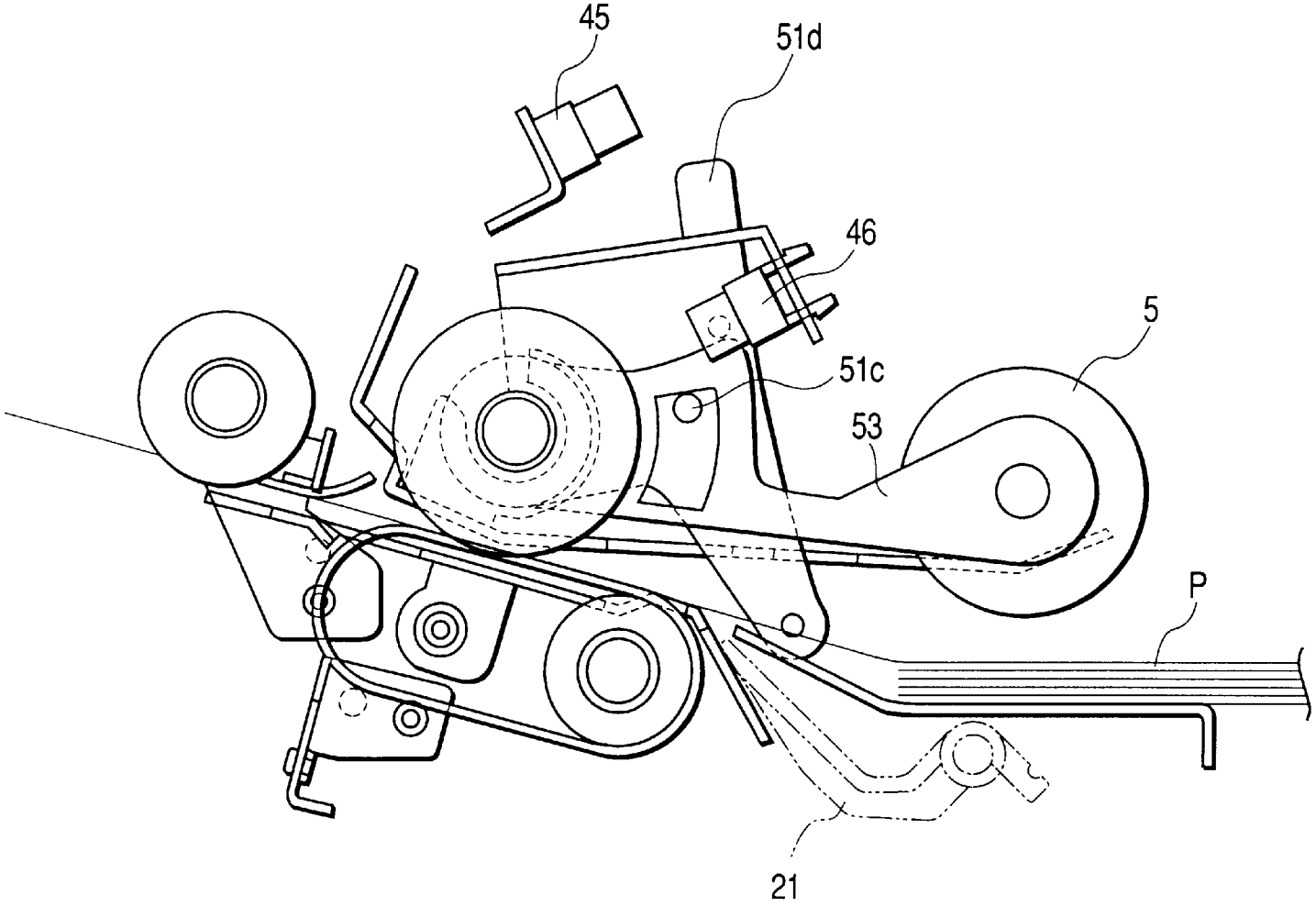
FIG. 7 shows the operation of the separating portion (seen along the line 5—5 of FIG. 9) of the ADF.

The lift arm 51 is driven by the rock motor 103, and the lift arm 51 can assume any state (position) between the state (position) shown in FIG. 5 and the state (position) shown in FIG. 6 (see FIG. 7).

Above the separating roller 6, a sheet supply roller home sensor (transmission type optical sensor) 45 is mounted on a fixed support plate 56. When the lift arm 51 is in its home position (standby position), a lift arm flag 51*d* provided on the rocking arms 57, 53 intercept the sensor optical path of the sheet supply roller home sensor 45.

As previously described, the first rock position sensor 46 and the second rock position sensor 47 movable with the lift arm 51 are provided on the lift arm 51, and a first rocking arm flag 54 and a second rocking arm flag 55 formed extending in the lowering direction of the rocking arms 57, 53 are detected by these sensors.

The aforedescribed state of FIG. 7 is a retracted position during continuous sheet supply. During continuous sheet supply, the rocking arms 57 and 53 need not return to their home positions (see FIG. 5), and therefore the rocking arms 57 and 53 are controlled so as to be intermediately stopped at positions in which the sheet supply roller 5 is spaced apart by a minimum amount (the order of 3 to 5 mm) from the bundle of originals (the retracted position shown in FIG. 7).

By adopting this construction, it becomes possible to suppress the amount of movement of the sheet supply roller 5 to the minimum, and the vibration with which the sheet supply roller 5 lands on the originals P becomes small, and this contributes to an improvement in sheet supplying performance. Along therewith, the time till the start of the subsequent sheet supply can be shortened, and sheet supply control in which the sheet supply interval is shortened becomes possible. In contrast, if the feeding operation is started in a state in which the sheet supply roller 5 is bounding due to the shock when the sheet supply roller 5 lands on the originals P, the balance of the pressure of the sheet supply roller 5 against the originals P before and after the feeding operation will be described. Thus, the possibility of causing the skew-feed during sheet supply will becomes great.

The plurality of sheet supply rollers 5 disposed in the widthwise direction as shown in FIG. 9 each assume an independently mounted construction and are easily equalized to the originals P, and therefore it is possible to improve the sheet supplying performance.

A well-known separating portion comprised of the separating belt 6 and the separating—conveying roller 8 is provided downstream of the direction of conveyance of a shutter 21 so that it may be rotated in the separating operation.

3. Conveying mechanism

Figure 3:
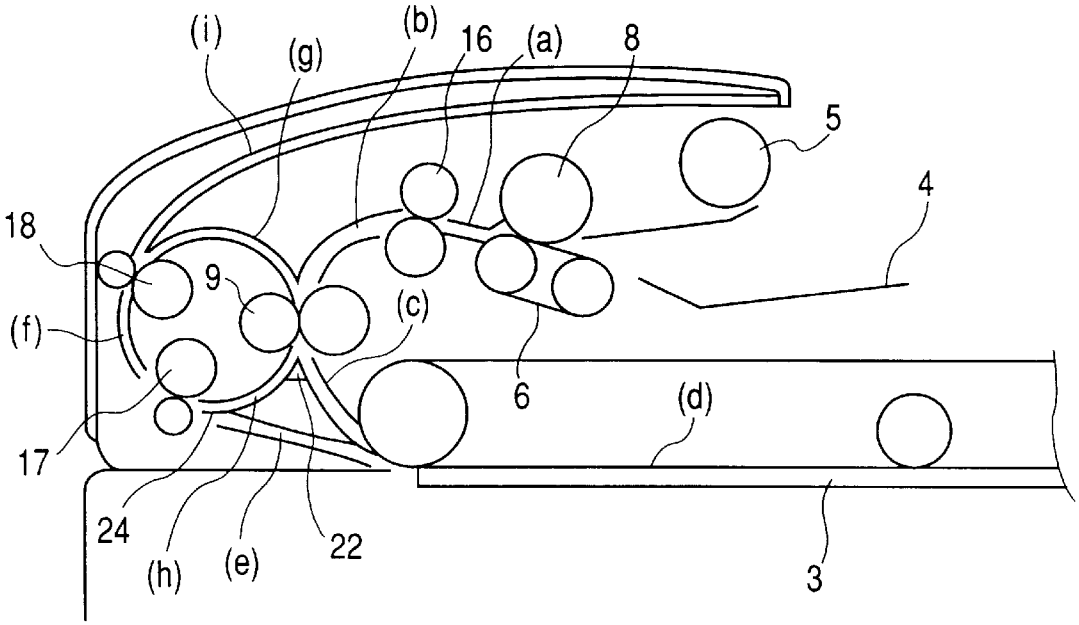
FIG. 3 shows a path in the ADF.
Figure 13:
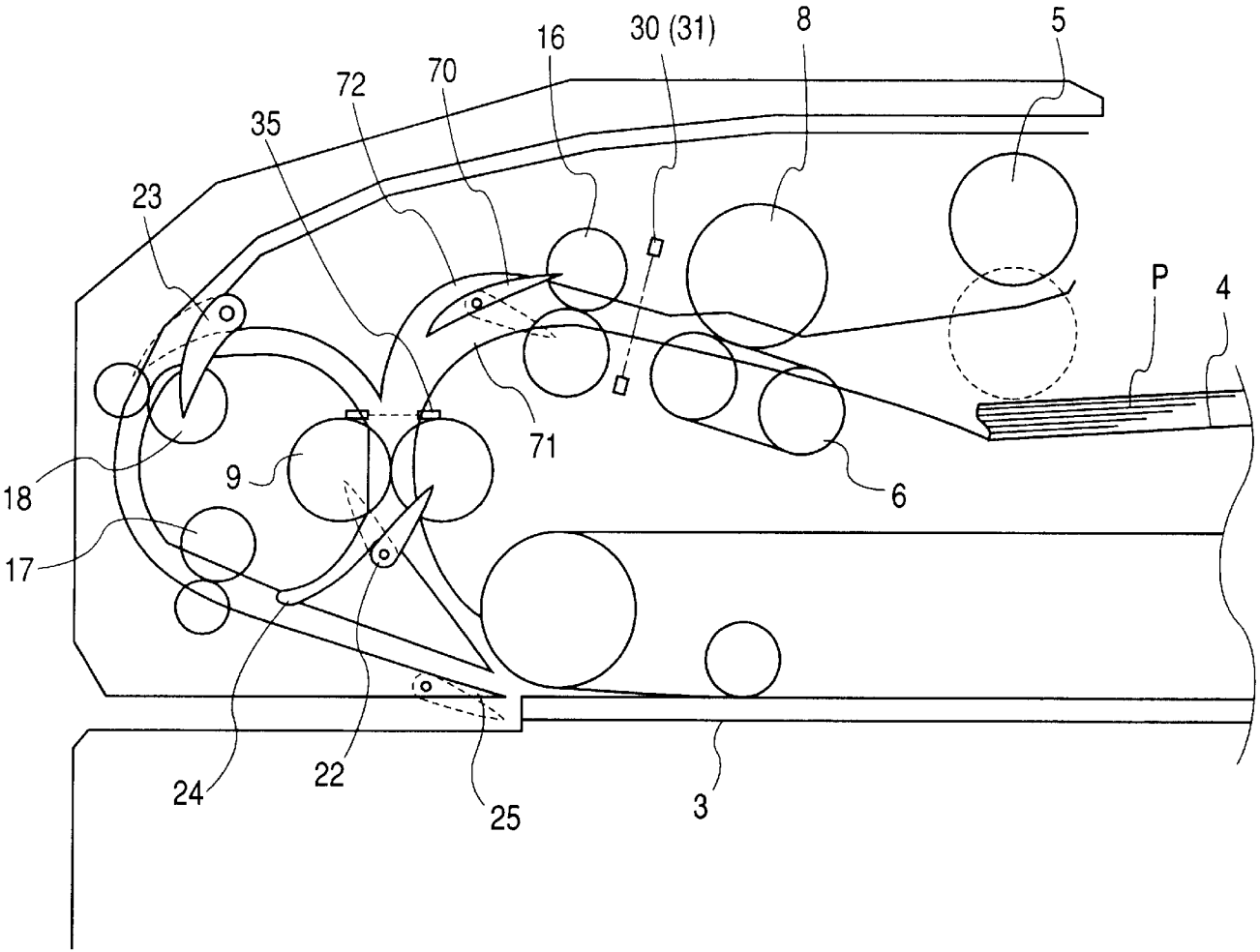
FIG. 13 shows the separating-feeding portion of the ADF of the present invention.

1) Conveyance Paths . . . see FIGS. 3 and 13

As shown in FIG. 3, from the original tray 4 to the platen 3, there are constructed original feeding paths (a), (b) and (c) for directing the originals onto the platen 3, and these paths are bent (downwardly curved) and connected to an original conveyance path (d) on the platen 3.

The original feeding path (a) is a conveyance path along which the original separated by the separating portion is conveyed in the downstream direction by the separating-conveying roller 8. Also, the original feeding path (b) is divided into a first path 71 and a second path 72 as shown in FIG. 13, but joins again on the downstream side.

Reverse feeding paths (h), (f) and (i) extend from the original feeding path (b), and these are used to reverse the originals before the originals are conveyed to the platen 3. The originals reversed by the reverse feeding paths (h), (f) and (i) are switched back, pass through an original supply and discharge path (d), are conveyed to the platen 3 and are placed thereon.

Further, an original reversing path (g) branches off from the reverse feeding path (f) and can join the original feeding path (b). If conveyance paths (e), (f), (g) and (c) are utilized, the original on the platen 3 can be switched back and reversed, and can be again returned onto the platen 3. After image reading is finished, the original on the platen is discharged onto a sheet discharge tray 10 through the original conveyance path (d) on the platen 3 and an original discharge path (l) shown in FIG. 1.

At the right of the ADF 2, there is provided an operable-closable type manual-insert original tray 14 (see FIG. 1). An original set on the manual-insert original tray 14 can be fed to the platen 3 through a manual-insert conveyance path (k).

2) Rollers . . . see FIGS. 1, 3, 4 and 13

First feeding rollers 16 are provided between the original feeding paths (a) and (b). The first feeding rollers 16 restrain the original sent from the separating portion (the separating belt 6 and the separating-conveying roller 8) and prevent the skew feeding thereof. Also, the separating-conveying roller 8 is provided with a one-way mechanism. Thereby, the conveyance load when the original is pulled out of the separating portion by the first feeding rollers 16 is mitigated.

Second feeding rollers 9 are disposed in the portion of junction of the original conveyance paths (a), (b) and (c) and the original reversing path (g). These second feeding rollers 9 form a loop in the original which has arrived at them to thereby prevent the skew feeding of the original. First reversing rollers 17 and second reversing rollers 18 are provided in the reverse feeding paths (h), (f) and (i), and these convey the original along a loop-like reversing path.

A manual-insert sheet supply roller 13 is provided at the right of the ADF 2, and this supplies the original set on the manual-insert original tray 14 from right to left. Manual-insert register rollers 11 are provided between the manual-insert sheet supply roller 13 and the platen 3, and these form a loop in an original manually supplied to thereby prevent the skew feeding thereof. Further, these manual-insert register rollers 11 effect the relay of the discharge of the original from the platen 3.

In the original discharge path (l), there is provided a sheet discharge roller 12 for discharging the discharged original onto the sheet discharge tray 10.

3) Flapper . . . see FIGS. 3, 4, 13, 14 and 15

FIGS. 4 and 13 show the position of a flapper on the conveyance path. Each feeding path is as shown in FIG. 3.

Figure 14:
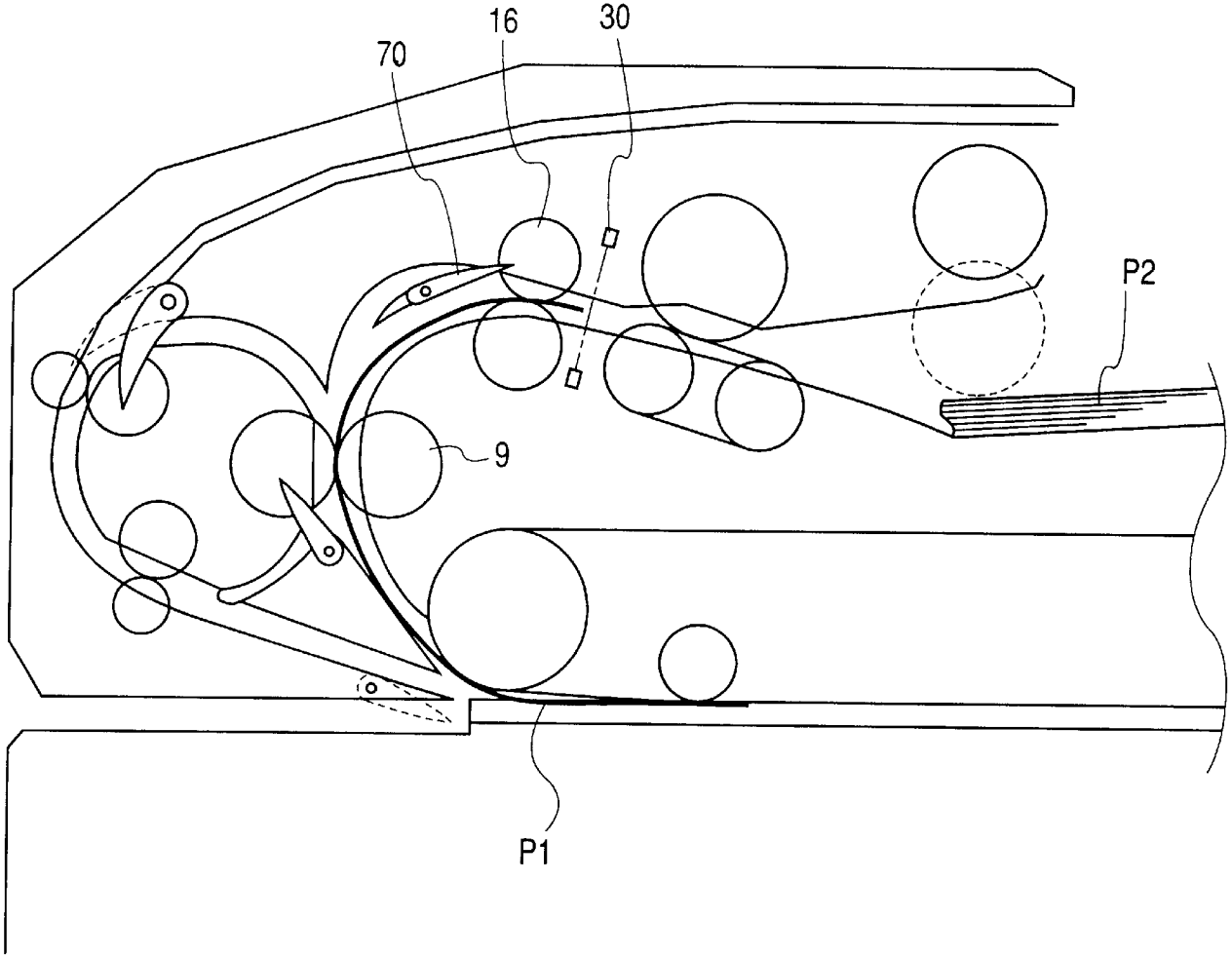
FIG. 14 shows the separating-feeding portion of the ADF of the present invention.
Figure 15:
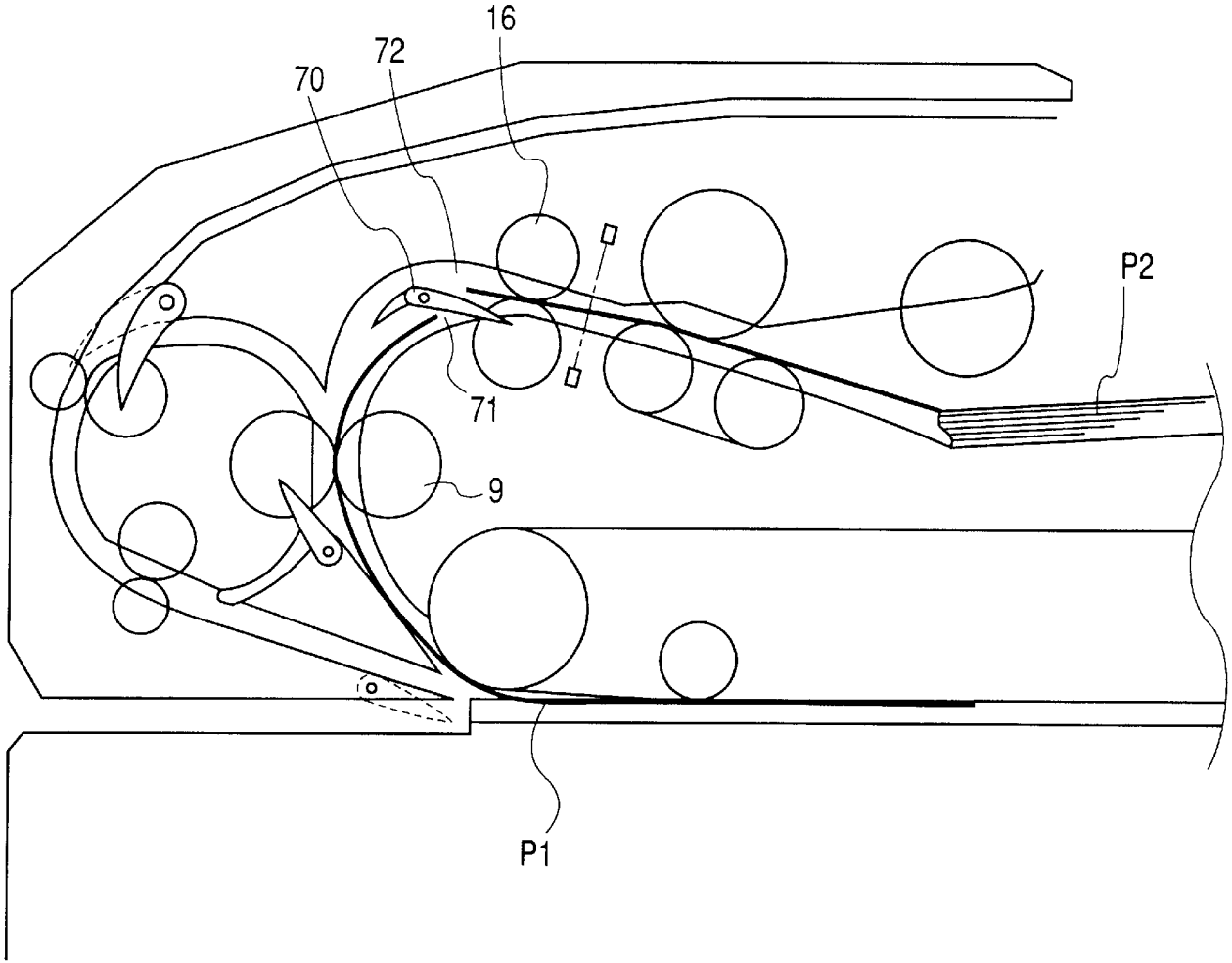
FIG. 15 shows the separating-feeding portion of the ADF of the present invention.

A separating flapper 70 is provided downstream of the first feeding rollers 16 with respect to the direction of conveyance, to effect the switching of a first path 71 and a second path 72 of the original feeding path (b) as shown in FIGS. 13, 14 and 15.

A reverse sheet supply flapper 22 is provided downstream of the second feeding rollers 9 with respect to the direction of conveyance to and switch the original feeding path (c) and the reverse feeding path (h). This reverse sheet supply flapper 22 assumes a state depicted by solid line in FIG. 13 when it conveys the original to the reverse feeding paths (h), (f) and (i), and assumes a state depicted by broken line in FIG. 13 by rocking when it conveys the original to the original feeding path (c) and the original conveyance path (d).

A reversing flapper 23 is provided downstream of the second reversing rollers 18 with respect to the direction of conveyance, and switches the reverse feeding path (i) and the original reversing path (g).

The reversing flapper 23 is in a state depicted by solid line in FIG. 13 when it reverses the original conveyed from the original feeding path (b) and the reverse feeding path (h). On the other hand, it assumes a state depicted by broken line in FIG. 13 by rocking when it reverses the original from the platen 3 through the original supply and discharge path (e), the reverse feeding path (f) and the original reversing path (g).

A one-way flapper 24 (having Myler attached thereto) is provided in the junction portion of the reverse feeding path (h) and the original supply and discharge path (e) located upstream of the first reversing rollers 17. This one-way flapper 24 plays the role of a guide when it conveys the original from the reverse feeding path (h) to the reverse feeding path (f). Also, it plays the role of preventing the backward movement of the original to the reverse feeding path (h) when it conveys the original from the reverse feeding paths (g) and (f) to the platen 3 through the original supply and discharge path (e).

A supply and discharge flapper 25 operatively associated with the reverse sheet supply flapper 22 is provided on the platen 3 of the reverse supply and discharge path (e). This supply and discharge flapper 25 is in a state indicated by solid line in FIG. 13 to prevent the leading end of the original going onto the platen 3 from abutting against the end portion of the platen 3, when it conveys the original from the original supply and discharge path (e) to the platen 3. Also, it assumes a state depicted by broken line in FIG. 13 by rocking so as to scoop up the original from the platen 3 when it conveys the original from the platen 3 to the original supply and discharge path (e).

A sheet discharge flapper 26 is provided between the right end of the platen 3 and the manual-insert register rollers 11 (see FIG. 4). The sheet discharge flapper 26 is in a state depicted by solid line in FIG. 4 to prevent the leading end of the original going onto the platen 3 from abutting against the end portion of the platen 3 when it conveys the original from the manual-insert conveyance path (k) to the platen 3. It assumes a state depicted by broken line in FIG. 4 by rocking so as to scoop up the original from the platen 3 when it discharges the original from the platen 3 to an original discharge path (j).

A one-way manual-insert flapper 27 is provided in the portion of junction of the original discharge path (j) and the manual-insert conveyance path (k). This manual-insert flapper 27 prevents the original from going into the manual-insert conveyance path (k) when it discharges the original from the platen 3.

A manual-insert shutter 28 provided downstream of the manual-insert sheet supply roller 13 with respect to the direction of conveyance prevents a manually inserted original set on the manual-insert original tray 14 from going to the manual-insert register rollers 11, when an original which has been copied is discharged. At this time, the conveying force of the manual-insert sheet supply roller 13 is set to a low level so that the manual-insert sheet supply roller and the original may slip.

4) Sensors on the Conveyance Path . . . see FIG. 4

A separate sensor 30 is provided between the separating-conveying roller 8 and the first feeding rollers 16, and detects the original conveyed by the separating-conveying roller 8. Also, a skew-feed detect sensor 31 is provided at the same position in the direction of conveyance as the separate sensor 30 and spaced apart by a predetermined distance in the thrust direction. The results of the detection by the skew-feed detect sensor 31 and the separate sensor 30 (both being transmission type optical sensors) are used to detect the amount of skew feeding of the original fed thereto.

A mixed stack detect sensor 32 is provided downstream of the first feeding rollers 16, and detects the original by the movement of a flag. A control device (to be described later) judges the results of the detection by the mixed stack detect sensor 32 and by the various sensors on the original tray 4, to thereby detect during the conveyance of the original that originals of different sizes are set on the original tray 4. A sheet supply sensor (transmission type optical sensor) 35 is disposed upstream of the second feeding rollers 9 to detect the leading end and trailing end of the original which has passed one of the original feeding paths (a), (b) and (c) and the original reversing path (g).

A register sensor (transmission type optical sensor) 39 is disposed downstream of the feeding rollers 9 to detect the trailing end of the original. The result of the detection is used to control the stopped position of the original. A reverse sensor (transmission type optical sensor) 50 is disposed in the reverse conveyance path (e) to detect an original discharged from the platen 3 or an original going onto the platen 3.

A reverse detect sensor (of a type detecting the original by the movement of a flag) 33 is provided in the reverse feeding path (i) to detect that the original has been directed to the reverse feeding path (i). A manual-insert register sensor (transmission type optical sensor) 34 is provided downstream of the manual-insert register rollers 11 with respect to the direction of sheet discharge to detect the original from the manual-insert conveyance path (k) and also to detect the original discharged from the platen 3 to the original discharge path (j).

A manual-insert original detect sensor (of a type detecting the original by the movement of a flag) 60 is provided on that side of the manual-insert sheet supply roller 13 which is adjacent to the manual-insert original tray 14 to detect that an original is set on the manual-insert original tray 14.

5) Driving System . . . see FIGS. 4 and 13

FIG. 4 shows a driving system including motors and solenoids for driving the conveying rollers and flappers.

A separate motor 100 is for driving the separating portion (the separating-conveying roller 8 and the separating belt 6) in the direction of arrow in FIG. 5, and the drive force thereof is also transmitted also to the sheet supply roller 5 through a separating clutch 106 to drive the sheet supply roller 5. Here, a DLL-controlled DC brush motor is used as the separate motor 100. This separate motor 100 is mounted thereon a mechanism for generating a clock pulse proportional to the number of revolutions of the separate motor 100 when this motor revolves. This mechanism is comprised of a clock plate 100*a* provided with a plurality of slits which is mounted on the motor shaft of the separate motor 100, and a separate clock sensor 100*b* which is a transmission type optical sensor.

A convey motor (reversible stepping motor) 101 is for driving the second feeding rollers 9, the first reversing rollers 17 and the second reversing rollers 18. This convey motor 101 is provided with a mechanism for generating a clock pulse proportional to the number of revolutions of the convey motor 101 when this motor revolves. This mechanism is comprised of a clock plate 101*a* provided with a plurality of slits which is mounted on the driven roller shaft of the second feeding roller 9, and a reverse clock sensor 101*b* which is a transmission type optical sensor. The amount of slip when the original is conveyed by the second feeding rollers 9 can be measured on the basis of the clock pulse number generated by this mechanism and the drive clock pulse number of the convey motor 101.

A belt motor (reversible stepping motor) 102 is for driving the wide belt 7 and the manual-insert register rollers 11, and the drive force thereof is transmitted to the wide belt 7 through the drive roller 36. Thereafter, this drive force is transmitted to the manual-insert register rollers 11 through the wide belt 7 and the turn roller 37. In this case, the conveyance speed of the original on the platen 3 and the conveyance speed by the manual-insert register rollers 11 are set to be equal to each other.

A rock motor (reversible stepping motor) 103 is for driving the lift arm 53 of the sheet supply roller. A sheet discharge motor (FG servo control type DC motor) 104 is for driving the sheet discharge roller 12 and the manual-insert sheet supply roller 13. This sheet discharge motor 104 has mounted thereon a mechanism for generating a clock pulse proportional to the number of revolutions thereof. This mechanism is comprised of a clock plate 104*a* provided with a plurality of slits which is mounted on the motor shaft of the sheet discharge motor 104, and a sheet discharge clock sensor 104*b* which is a transmission type optical sensor.

A stopper solenoid 105 serves to drive the stopper 21 at the sheet supply end of the original tray 4. The stopper 21, during its OFF state, is in a position indicated by solid line in FIG. 13, and during its ON state, rocks to a position indicated by broken line in FIG. 13. A separate clutch 106 is for controlling the transmission/interception of the drive force of the separate motor 100 to the sheet supply roller 5, the separating belt 6 and the separating-conveying roller 8.

A path switch solenoid 107 serves to drive the reverse sheet supply flapper 22 and the supply and discharge flapper 25. When the path switch solenoid 107 is OFF, the reverse sheet supply flapper 22 and the supply and discharge flapper 25 are in their respective states depicted by solid lines in FIG. 13, while when it is ON, the reverse sheet supply flapper 22 and the supply and discharge flapper 25 assumes their respective states by rocking depicted by broken lines in FIG. 13. A reverse flapper solenoid 108 serves to drive the reverse flapper 23. When the reverse flapper solenoid 108 is OFF, the reverse flapper 23 is in its state depicted by solid line in FIG. 13, while when it is ON, the reverse flapper 23 rocks to assume its state depicted by broken line in FIG. 13.

A sheet discharge flapper solenoid 109 serves to drive the sheet discharge flapper 26 and the manual-insert shutter 28. When the sheet discharge flapper solenoid 109 is OFF, the sheet discharge flapper 26 and the manual-insert shutter 28 are in their respective states depicted by broken lines in FIG. 13, while when it is ON, the sheet discharge flapper 26 and the manual-insert shutter 28 assumes their respective states depicted by solid lines in FIG. 13 by rocking. A separate flapper solenoid 110 serves to drive the separate flapper 70. When the separate flapper solenoid 110 is OFF, the separate flapper 70 is in its state depicted by solid line in FIG. 13, while when it is ON, the separate flapper 70 rocks to assume its state depicted by broken line in FIG. 13.

Figure 11:
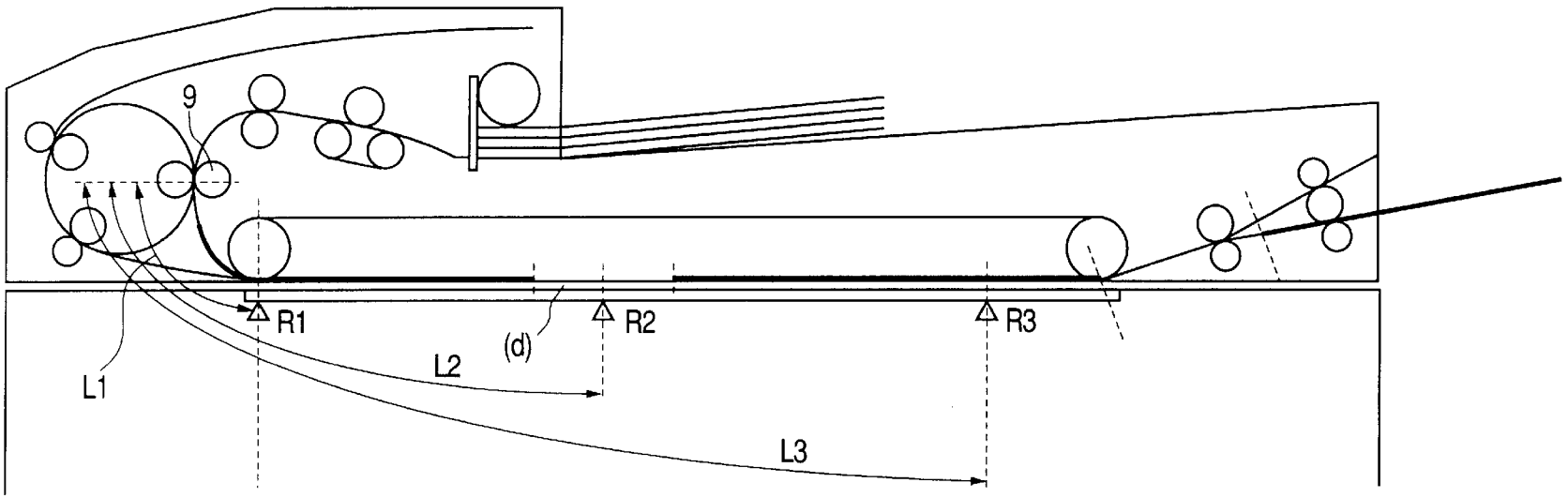
FIG. 11 shows an original reading position.
Figure 12:
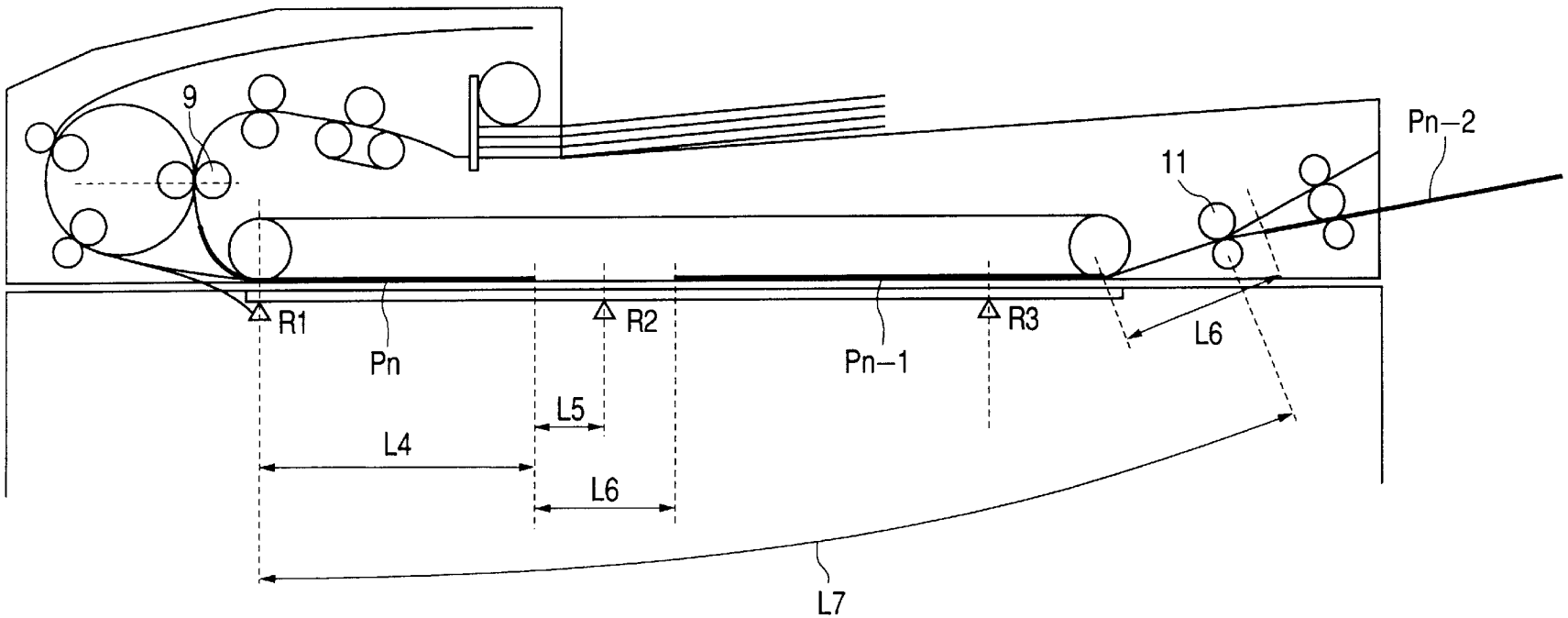
FIG. 12 shows the original reading position.

6) Reading Positions . . . see FIGS. 11 and 12

FIG. 11 shows original reading positions on the platen 3.

The original reading positions are at three locations (a first reading position R1, a second reading position R2 and a third reading position R3), and one of these positions is selected in conformity with the original conveying mode and the size of the original to be conveyed.

The first reading position R1 is used in the both-face original mode. In this case, the reading of an image is effected by causing the scanner unit 204 of the copying apparatus body 1 to scan with an original placed with its end adjusted to this reading position R1 (fixed-reading mode). The second reading position R2 is used when a half-size original is to be read in the one-face original mode. In this case, the reading of an image is effected while the scanner unit 204 is fixed at the second reading position R2 and the original is conveyed (flow-reading mode). The third reading position R3 is used when a large-size original and a half-size original during the one-face original mode are longitudinally fed. In this case, the reading of an image is effected while the scanner unit 204 is fixed at the third reading position R3 and the original is conveyed (flow-reading mode).

In FIG. 11, L1 is the distance from the nip point of the second feeding rollers 9 to the first reading position R1. L2 is the distance from the nip point of the second feeding rollers 9 to the second reading position R2. L3 is the distance from the nip point of the second feeding rollers 9 to the third reading position R3.

In FIG. 12, L4 is the distance from the first reading position R1 to a stop position for the waiting of a half-size original placed on the left side of the platen 3. L5 is the distance from the leading end of the original stopped at the waiting position the second reading position R2. L6 is the set value of the distance from the trailing end of a preceding original to the leading end of a succeeding original (hereinafter referred to as the "sheet interval"). During conveyance, the sheet interval is controlled so as to be L6. L7 is the distance from the first reading position R1 to the manual-insert register rollers 11.

When the length of the half-size original in the direction of conveyance is Lph, the stop position of the half-size original is controlled so that the following relational may be established:

$L7<(L4+2\times L6+Lph)$ $L2>(L5-Lph)$

As the result, even when as shown in FIG. 12, originals $P_n$ and $P_{n-1}$ are stopped on the platen 3, the trailing end of a succeeding original $P_{n-2}$ goes through the nip of the manual-insert register rollers 11. Also, the trailing end of the original $P_n$ waiting for image formation goes through the nip of the second feeding rollers 9.

7) Conveying Operation

The original conveying operation of this original conveying apparatus will now be described.

During conveyance, the separating operation common to the various original conveying modes is performed, whereafter a different operation is performed in each original conveying mode. In the following, description will be divisionally made of the separating operation and the operation inherent to each original conveying mode. In order to make the order of conveyance clear, there is a case where an original conveyed earlier is called the "preceding original" and an original conveyed later is called the "succeeding original".

7) (1) Separating Operation

When the bundle of originals on the original tray 4 is detected by original set detecting sensors 40*a* and 40*b*,the pre-separating operation is started. That is, the sheet supply roller 5 is first lowered and lands on the bundle of originals. In the ensuing description, the originals stacked on the original tray 4 are called the original P1, the original P2, the original P3, . . . in succession from above. Also, when the order of the originals is not particularly designated, the originals are called the originals P.

When a copying condition is inputted by the operating portion of the copying apparatus and a start key is depressed, the detection of the original size is effected by a sensor or the like on the platen 3 and further, the stopper 21 is operated by the stopper solenoid 105, and the way of the bundle of originals is liberated. The bundle of originals is subjected to the feeding by the sheet supply roller 5 to move the original P1 (the uppermost original) to the downstream portion. The separating-conveying roller 8 and the separating belt 6 are rotated in the directions of arrows indicated in FIG. 5, whereby they separate the originals P moved from the original tray 4 one by one, and convey the separated original to the downstream portion.

The original P which has passed the separating portion has detected skew-feed thereof by the separate sensor 30 and the skew-feed sensor 31, whereafter it is restrained and conveyed by the first feeding rollers 16. Thereupon, the sheet supply roller 5 is elevated and subsequently, the separating belt 6 and the separating-conveying roller 8 are stopped. This stoppage is effected by switching off the clutch 106 and disconnecting the driving of the separating belt 6 and the driving of the separating-conveying roller 8 from each other. After the stoppage, the separating-conveying roller 8 follows the movement of the original P conveyed and is rotated (therewith).

The original P is conveyed by the first feeding rollers 16 alone and is abutted against the second feeding rollers 9 stopped, whereby well-known skew-feed elimination is effected. When the skew-feed elimination is finished, the first feeding rollers 16 and the second feeding rollers 9 begin to be rotated at a time. In this case, speed of the first feeding rollers 16 and the second feeding rollers 9 are synchronously controlled so that their conveying speeds may coincide with each other.

When the originals are continuously fed, the separate flapper 70 is locked and the paths (the second path 72/the first path 71) are alternately switched for each original. That is, when as shown in FIG. 13, the original goes through the nip of the first feeding rollers 16, the separate flapper 70 is operated in preparation for the entry of the next original, and the conveyance path is switched. The timing at which the separate flapper 70 is operated is determined on the basis of a signal produced by the separate sensor 30 having detected the trailing end of the preceding original.

FIG. 14 shows the manner in which the trailing end of the preceding original P1 goes through the separate sensor 30 and the separation and feeding of the next original P2 are started. FIG. 15 shows the manner in which the original P1 separated and fed earlier goes through the nip of the first feeding rollers 16, whereafter the separate flapper 70 has been switched.

In the present embodiment, the separating speed of the original P2 after the separate flapper 70 has been switched is set to a level higher than the aforementioned synchronizing speed. Therefore, the original P2 catches up with the original P1 and moves into the second path 72 and is waiting for separation. However, the first path 71 and the second path 72 are regulated by the separate flapper 70, and therefore it does not happen that the original P1 and the original P2 interfere with each other.

Depending on the frictional state of the surface of the original, the original sometimes does not follow the rotation of the separating-conveying roller 8 (the slip of the original and the roller). In the present embodiment, however, with such a delay of separation taken into account, the separating speed is set to a level higher than the feeding speed of the second feeding rollers 9. Therefore, the stoppage of the apparatus or the reduction in productivity by the delay of separation does not result. Also, when the separating speed is made higher than the feeding speed of the second feeding rollers 9, it is conceivable that the next original catches up with the preceding original. In the present embodiment, however, it does not happen that the next original abut against the preceding original, because the path is regulated by the separate flapper 70.

When the original P1 goes out from the second feeding rollers 9 after the waiting of the original P2 for separation, the above-mentioned skew-feed is eliminated. That is, the original P2 fed by the rollers 16 bears against the stopped rollers 9.

The description of the separating operation is now ended. Hereafter, the operation in each original conveying mode will be performed.

7) (2) Operation in Each Original Conveying Mode

The operations after the aforedescribed separating operation will hereinafter be described with respect to each of the original conveying modes (the half-size one-face original conveying mode, the large-size one-face original conveying mode, the half-size both-face original conveying mode, the large-size both-face original conveying mode and the manual-insert original conveying mode).

7) (2)(i) Half-Size One-Face Original Conveying Mode

FIGS. 16A to 16C and FIGS. 17A and 17B are typical views showing the flow of the originals during the one-face original conveying mode.

When the original conveying mode is the one-face original conveying mode, the path switch solenoid 107 is OFF-controlled and the conveyance path is changed to the side of the original feeding path (c). In this state, the preceding original P1 goes onto the platen 3. At this time, the conveying speed of the wide belt 7 is pre-controlled so as to coincide with the speed of the second feeding rollers 9.

When the trailing end of the preceding original P1 passes the nip point of the sheet supply rollers 5, the sheet supply rollers 5 are again lowered in preparation for the supplying operation for the succeeding original P2. Further, when the trailing end of the preceding original P1 passes the nip point of the first feeding rollers 16, the separate clutch 106 is switched on to start the supply of the succeeding original P2 by the sheet supply rollers 5 (see FIG. 16A).

When the trailing end of the preceding original P1 passes the nip of the second feeding rollers 9, the second feeding rollers 9 are stopped. It is controlled after the sheet supply by the sheet supply rollers 5 is started, the succeeding original P2 is suddenly accelerated, and is arrived at a position to be detected by the sheet supply sensor 35 when the second feeding rollers 9 is stopped. When the sheet supply sensor 35 detects the succeeding original P2, control for skew-feed elimination is effected as in the case of the preceding original P1.

At this time, the preceding original P1 is in the conveyance path (d) on the platen 3 and is singly conveyed by the wide belt 7. When the trailing end of the preceding original P1 passed the sheet supply sensor 35 and advanced by a predetermined distance, the preceding original P1 is once stopped (see FIG. 16B). At this time, the distance between the leading end of the original P1 and the second reading position R2 is controlled so as to be L5. Also, the distance L8 from the trailing end of the original P1 to the nip point of the second feeding rollers 9 is designed to be plus (the trailing end of the original P1 has passed the nip of the second feeding rollers).

L8 has the following relation with L2, L5 and the size of the conveyed original:

L8=L2−L5−size of conveyed original

L2: the distance from the second reading position R2 to the second feeding rollers 9

At the same time, the ADF 2 once stops the preceding original P1, outputs a conveyance completion signal 120 to the copying apparatus body 1. It waits for a conveyance starting signal 121 to be inputted.

When the ADF receives the conveyance starting signal 121 from the copying apparatus body and the skew-feed elimination control for the succeeding original P2 is completed, the wide belt 7 is actuated and the preceding original P1 is conveyed at an image forming speed by the wide belt 7. When the sheet interval (the distance between the trailing end of the preceding original P1 and the leading end of the succeeding original P2) becomes a predetermined distance, the second feeding rollers 9 are actuated. Like the preceding original P1, the succeeding original P2 is conveyed at the image forming speed by the second feeding rollers 9. In this case, the actuation and acceleration of the second feeding rollers 9 are controlled so that the aforementioned sheet interval may be L6 when the conveying speeds of the wide belt 7 and the second feeding rollers 9 coincide with each other.

When the preceding original P1 arrives at the reading position R2, the ADF 2 outputs an image tip arrival signal 122. In response thereto, the copying apparatus body 1 starts to read the image of the preceding original P1.

Figure 16A:
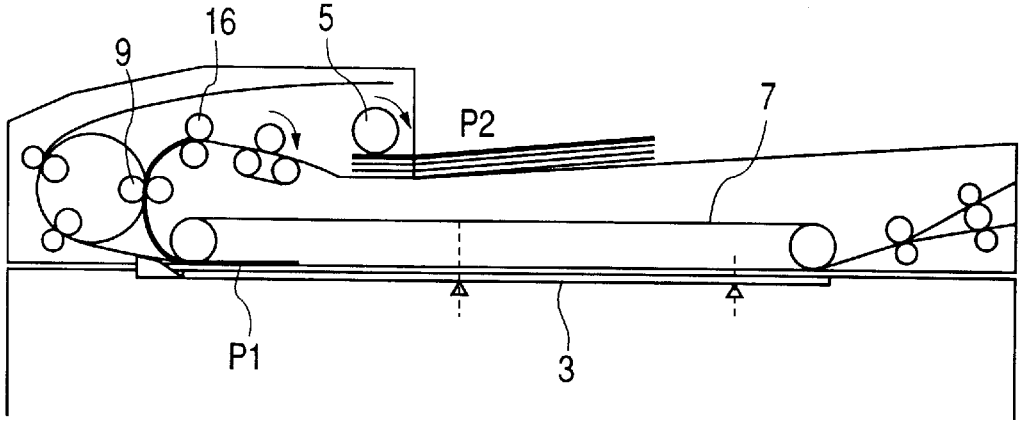
FIGS. 16A, 16B, 16C, 17A and 17B show the flow of a half-size original in one-face original conveying mode.
Figure 16B:
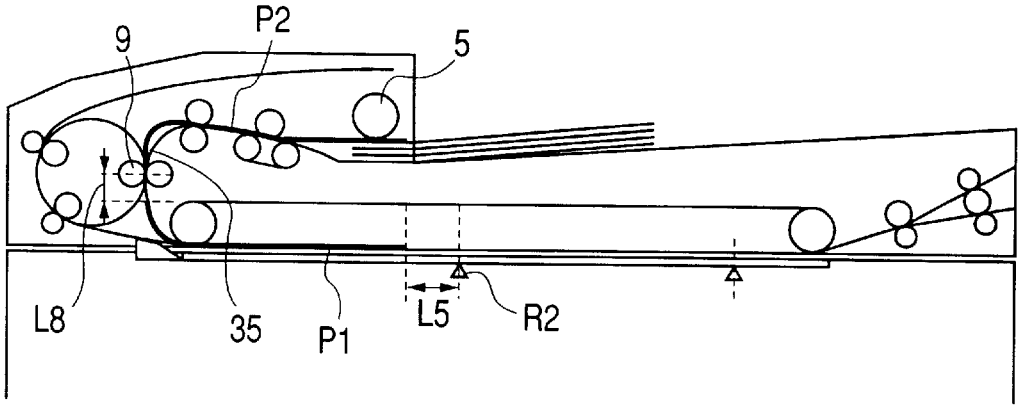
Figure 16C:
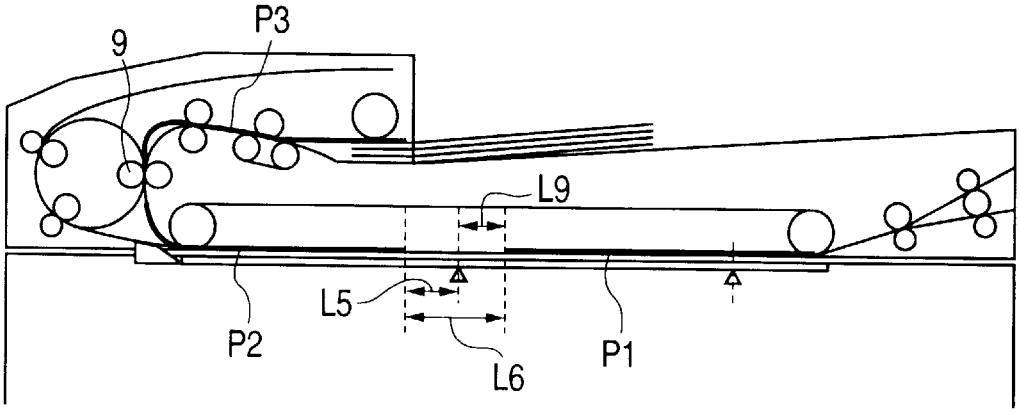

FIG. 16C shows the state of the original P1 after the completion of the reading of the image thereof. The original P1 is stopped after it has been conveyed by a predetermined distance (L9) after the reading has been completed. At this time, the succeeding original P2 is stopped at a distance L5 from the reading position R2. The further succeeding original P3 is waiting while maintaining a loop for skew-feed elimination by the second feeding rollers 9.

Figure 17A:
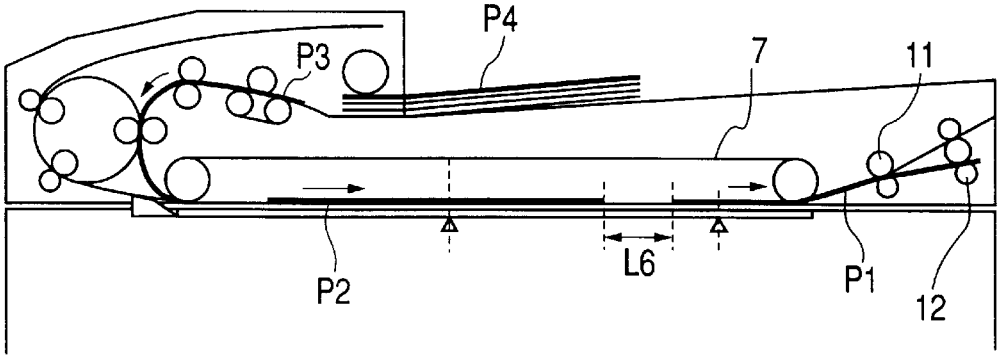

When in this state, the conveyance starting signal 121 is inputted from the copying apparatus body 1, image formation for the original P2 is effected. FIG. 17A shows the position of the original in the conveyance path during the reading of the image of the original P2. The original P1 is being conveyed by the wide belt 7, the manual-insert register rollers 11 and the sheet discharge roller 12. It is so designed that at this time, the conveying speeds of the wide belt 7 and the manual-insert register rollers 11 become equal to each other. The conveying speed of the sheet discharge roller 12 is controlled to be equal to or somewhat higher than these speeds.

Figure 17B:
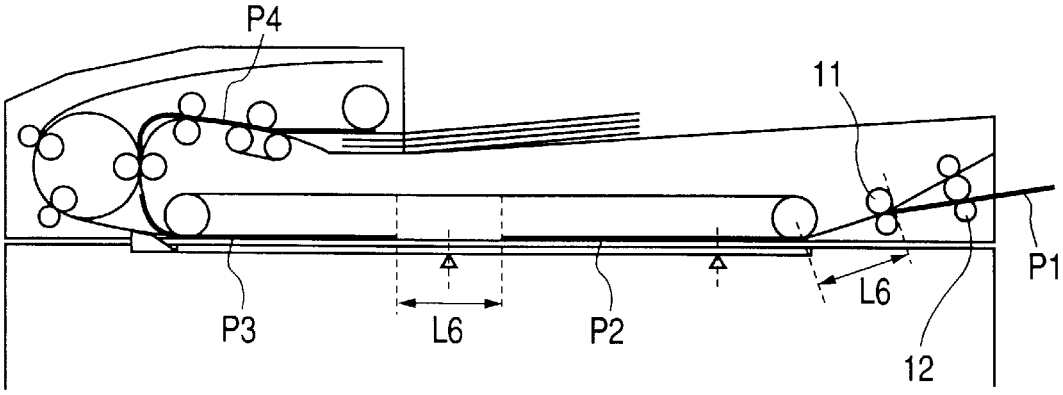

FIG. 17B shows the state of the succeeding original P2 when the reading thereof is completed. Since the wide belt 7 is stopped after the completion of the reading, the succeeding originals P2 and P3 are stopped on the platen 3. The trailing end of the preceding original P1 has already passed the nip of the manual-insert register rollers 11, and therefore this original P1 is singly conveyed by the sheet discharge roller 12 to be discharged onto the sheet discharge tray 10.

7) (2)(ii) Large-Size One-Face Original Conveying Mode

FIGS. 18A, 18B, 19A and 19B are typical views showing the flow of the originals during the large-size one-face original conveying mode.

As in the case of the small-size one-face original conveying mode, the path switch solenoid 107 is OFF-controlled and the conveyance path is on the side of the original feeding path (c), and in this state the preceding original P1 goes onto the platen 3. When the trailing end of the preceding original P1 passes the nip point of the separating-conveying rollers 8, the feeding rollers 5 are again lowered in preparation for the feeding operation for the succeeding original P2.

Figure 18A:
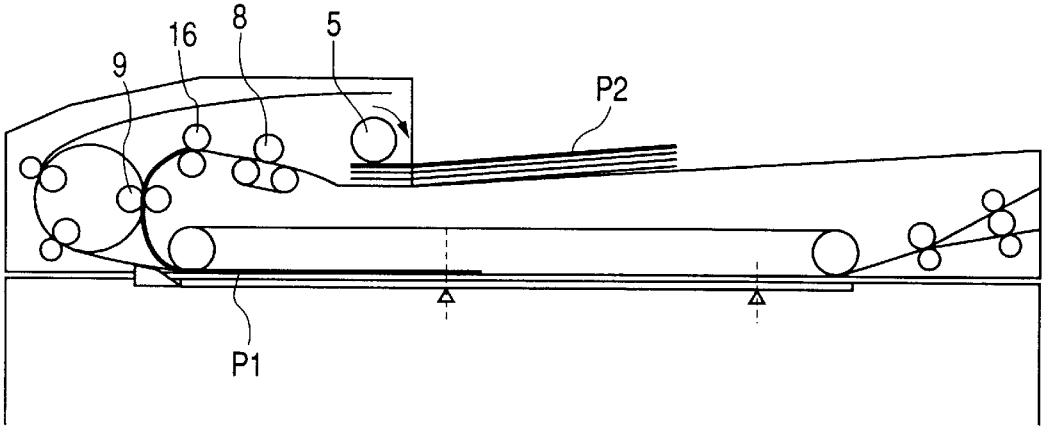
FIGS. 18A, 18B, 19A and 19B show the flow of a large-size original in one-face original conveying mode.
Figure 18B:
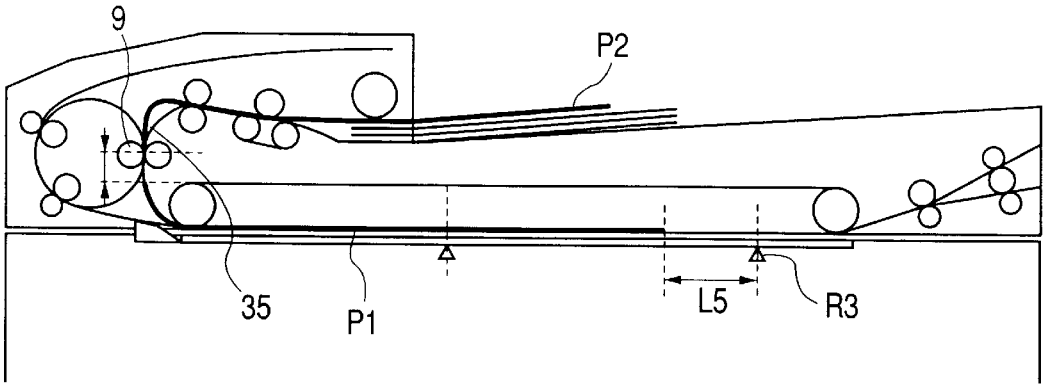

Further, when the trailing end of the preceding original P1 passes the nip point of the first feeding rollers 16, the separate clutch 106 is switched on and the supply of the succeeding original P2 by the sheet supply rollers 5 is started (see FIG. 18A). When the trailing end of the preceding original P1 passes the nip of the second feeding rollers 9, the second feeding rollers 9 are stopped. After the sheet supply by the sheet supply rollers 5 is started, the succeeding original P2 is suddenly accelerated and is controlled so as to arrive at the sheet supply sensor 35 when the second feeding rollers 9 are stopped. When the sheet supply sensor 35 detects the succeeding original P2, control for skew-feed elimination is effected as in the case of the preceding original P1.

At this time, the preceding original P1 is in the conveyance path (d) on the platen 3 and is singly conveyed by the wide belt 7. When the trailing end of the preceding original P1 passed the sheet supply sensor 35 and advanced by a predetermined distance, this preceding original P1 is once stopped (see FIG. 18B).

At this time, the distance between the leading end of the original P1 and the third reading position R3 is controlled so as to be L5 as in the case of the conveyance of the half-size original. Also, the distance L10 from the trailing end of the original P1 to the nip point of the second feeding rollers 9 is designed to be plus (the trailing end of the original P1 has passed the nip of the second feeding rollers 9).

L10 has the following relation with L3, L5 and the size of the original.

L10=L3−L5−size of conveyed original

L3: the distance from the third reading position R3 to the second feeding rollers 9

The ADF 2 once stops the preceding original P1 and at the same time, outputs a conveyance completion signal 120 to the copying apparatus body 1. It then waits for a conveyance starting signal 121 to be inputted.

When the ADF 2 received the conveyance starting signal 121 from the copying apparatus body and the skew-feed elimination control for the succeeding original P2 is completed, the wide belt 7 is actuated, whereby the preceding original P1 is conveyed at the image forming speed. When the preceding original P1 arrives at the reading position R3, the ADF 2 outputs an image tip arrival signal 122. In response thereto, the copying apparatus body 1 starts to read the image of the preceding original P1.

Figure 19A:
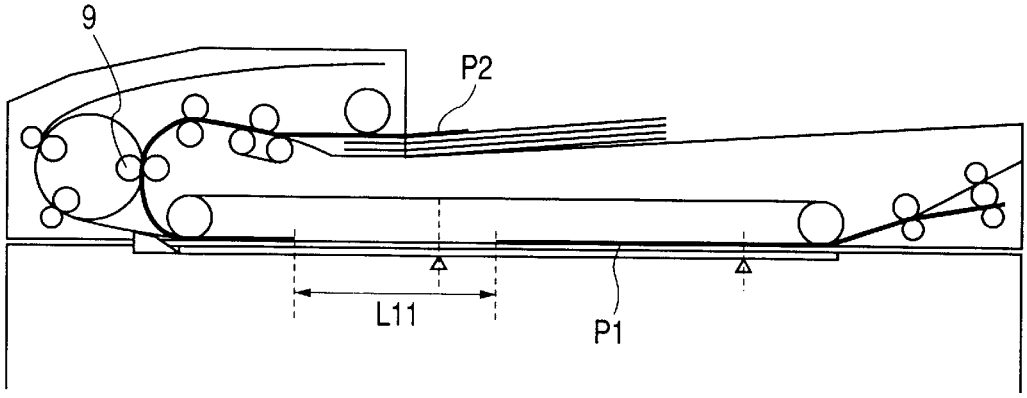

When the sheet interval (the distance between the trailing end of the preceding original P1 and the leading end of the succeeding original P2) becomes a predetermined distance, the second feeding rollers 9 are actuated, whereby the succeeding original P2, like the preceding original P1, is conveyed at the image forming speed. At this time, the actuation and acceleration of the second feeding rollers 9 are controlled so that the aforementioned sheet interval may become L11 when the conveying speeds of the wide belt 7 and the second feeding rollers 9 coincide with each other. This state is shown in FIG. 19A.

Figure 19B:
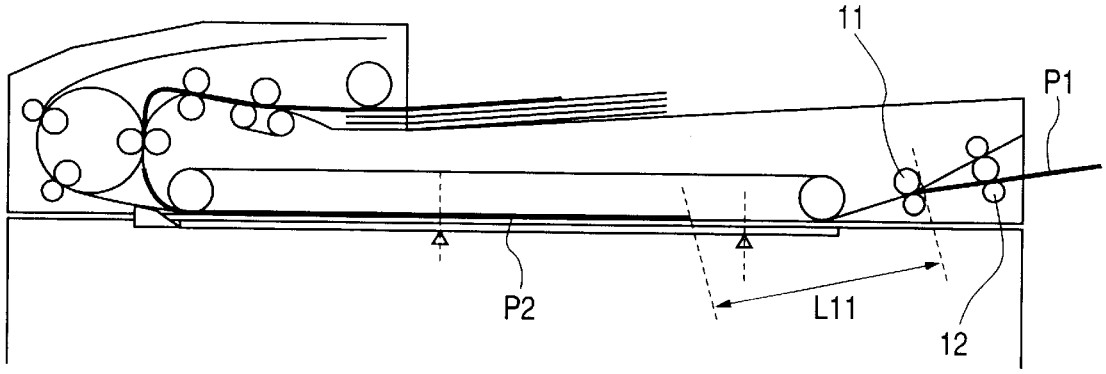
Figure 20A:
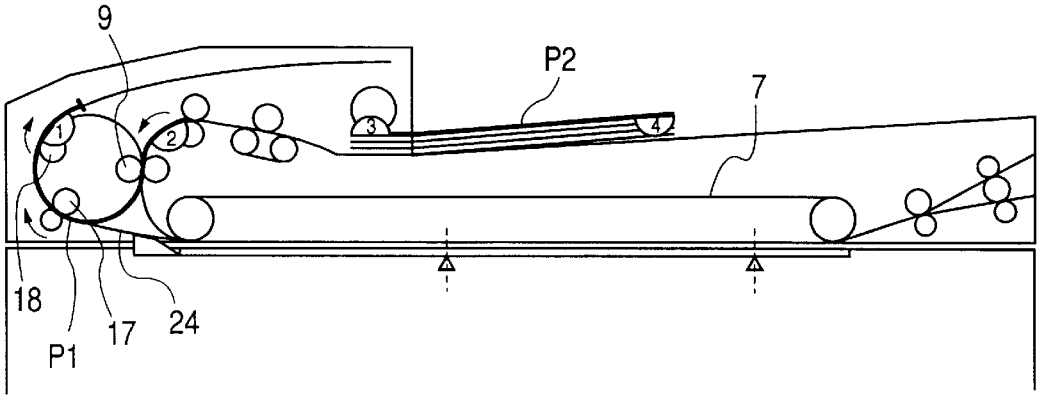
FIGS. 20A, 20B, 21A, 21B, 22A, 22B, 23A and 23B show the flow of the half-size original in both-face original conveying mode.
Figure 20B:
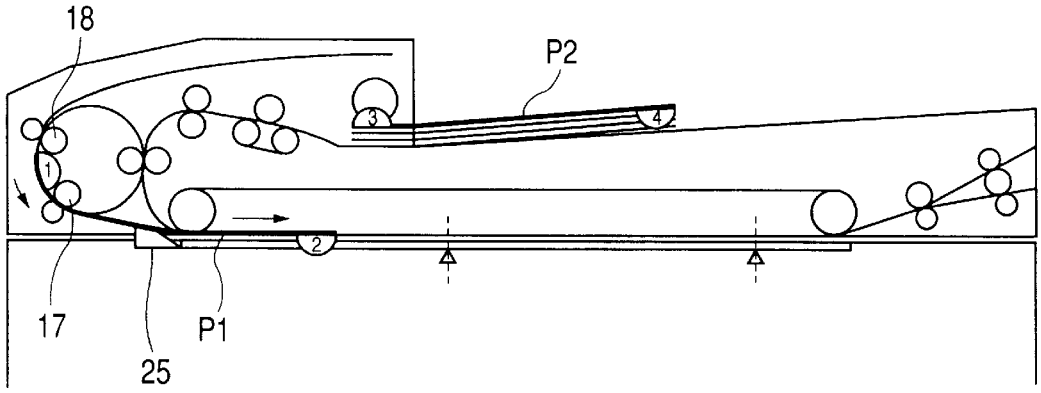
Figure 21A:
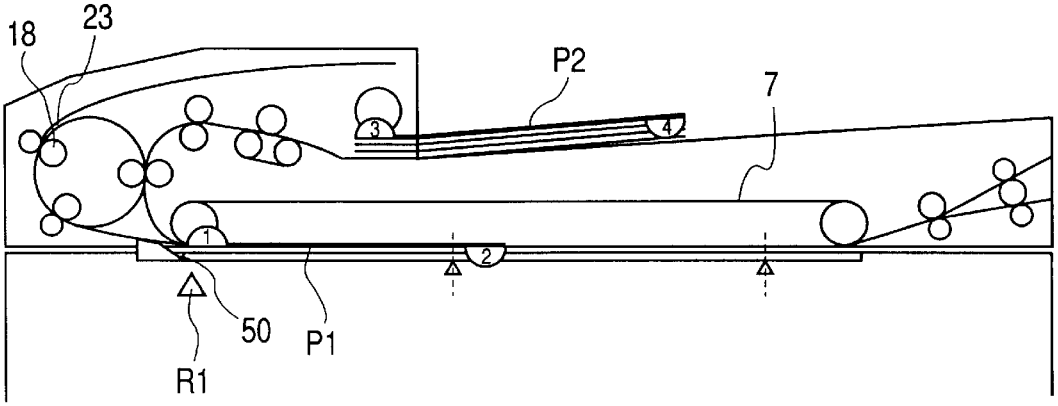
Figure 21B:
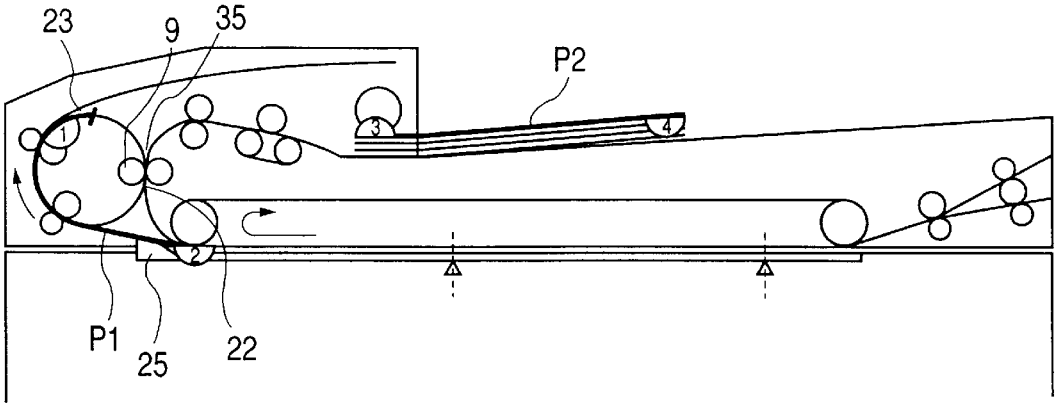

FIG. 19B shows the state of the original P1 after the completion of the reading of the image thereof. The succeeding original P2 is stopped on the platen 3. The sheet interval L11 is set so as to be greater than the distance from the leading end of the succeeding original P2 to the nip point of the manual-insert register rollers 11. Accordingly, when the succeeding original P2 is stopped, the trailing end of the preceding original P1 has already passed the nip point of the manual-insert register rollers 11, and the original P1 is singly conveyed and discharged by the sheet discharge roller 12.

7) (2)(iii) Half-Size Both-Face Original Conveying Mode

FIGS. 20A, 20B, 21A, 21B, 22A, 22B, 23A and 23B are typical views showing the flow of the originals during the both-face original conveying mode. The conveying speeds of the second feeding rollers 9 and the wide belt 7 are controlled so as to be equal to each other except for a special case.

When the original conveying mode is the both-face original conveying mode, the reverse sheet supply flapper 22 and the reverse flapper 23 are in their states depicted by solid lines in FIG. 13 at first. In this state, the original P1 is directed to the side of the reverse feeding paths (h), (f) and (i) (see FIG. 20A). When the trailing end of the original P1 passes the one-way flapper 24, the rollers 17 and 18 are reversely rotated to thereby convey the original P1 in the reverse direction. The supply and discharge flapper 25 is in its state depicted by solid line in FIG. 13, and therefore the reversely conveyed original P1 is directed to the original conveyance path (d) on the platen 3 (see FIG. 20B).

When the original is further conveyed by a predetermined distance after a point of time at which the reverse sensor 50 detected the trailing end of the original in the direction of conveyance, the wide belt 7 is stopped. As the result, the original P1 is placed at the first reading position R1 during the fixed reading mode (see FIG. 21A). Then, in this state the reading and scanning of the second surface by the scanner unit 204 of the copying apparatus body 1 are effected.

Before or after the original P1 is placed, the path switch solenoid 107 is switched off. Thereupon, the reverse sheet supply flapper 22 and the supply and discharge flapper 25 rock to assume their states depicted by broken lines in FIG. 13. When the reading and scanning of the second surface of the original P1 by the scanner unit 204 are completed, the wide belt 7 is reversely rotated and the original P1 is conveyed to the original supply and discharge path (e). At this time, simultaneously with the reverse rotation of the wide belt 7, the reverse flapper 23 rocks to assume its state depicted by broken line in FIG. 13. Therefore, the original P1 is directed to the original reversing path (g) (see FIG. 21B).

When the original is further conveyed by a predetermined distance after a point of time at which the reverse sensor 50 detected the leading end of the original, the rotation of the wide belt 7 is once stopped, and thereafter is reversed (from reverse rotation to forward rotation). Control is effected so that the conveying speeds of the second feeding rollers 9 and the wide belt 7 may coincide with each other when the leading end of the reversely moved original P1 comes to the original conveyance path (d) on the platen 3.

When the trailing end of the preceding original P1 passes the nip point of the second feeding rollers 9, the second feeding rollers 9 are stopped and wait for the arrival of the succeeding original P2.

The preceding original P1 is singly conveyed by the wide belt 7. However, when the original is further conveyed by a predetermined distance after a point of time at which the sheet supply sensor 35 detected the trailing end of the original, the wide belt 7 is stopped. As the result, the original P1 is placed at the first reading position R1 during the fixed reading mode. Then, in this state, the reading and scanning of the first surface are effected by the scanner unit 204. Also, before or after the detection of the trailing end of the preceding original by the sheet supply sensor 35, the separation of the succeeding original P2 is started and well-known skew-feed elimination is effected by the second feeding rollers 9.

The reversing operation for the succeeding original P2 is completed during the scanning of the first surface of the original P1 by the scanner unit 204. The succeeding original P2 after reversal waits with the vicinity of its leading end nipped by the first reversing rollers 17 (see FIG. 22A).

When the reading and scanning of the first surface of the preceding original P1 are completed, the reverse rotation of the first reversing rollers 17 and the second reversing rollers 18 and the forward rotation of the wide belt 7 are started. Thereby, the preceding original P1 and the succeeding original P2 are placed on the platen 3 with a predetermined sheet interval L12 kept therebetween (see FIG. 22B).

Figure 22A:
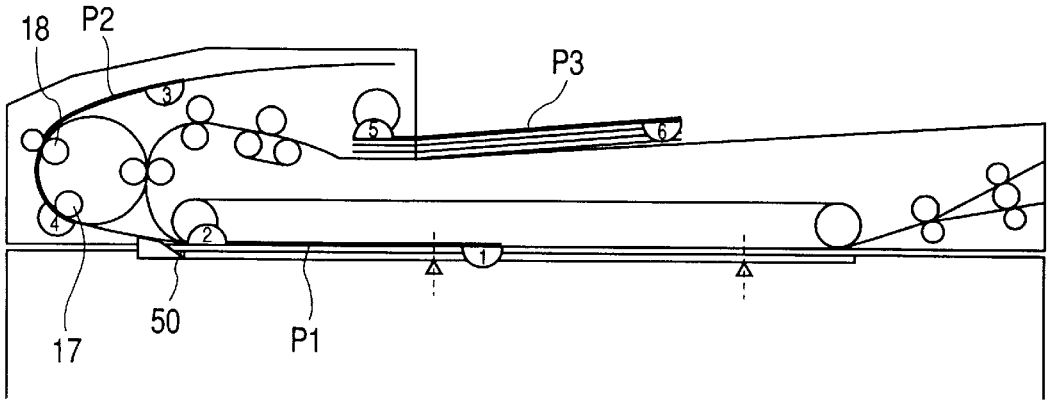
Figure 22B:
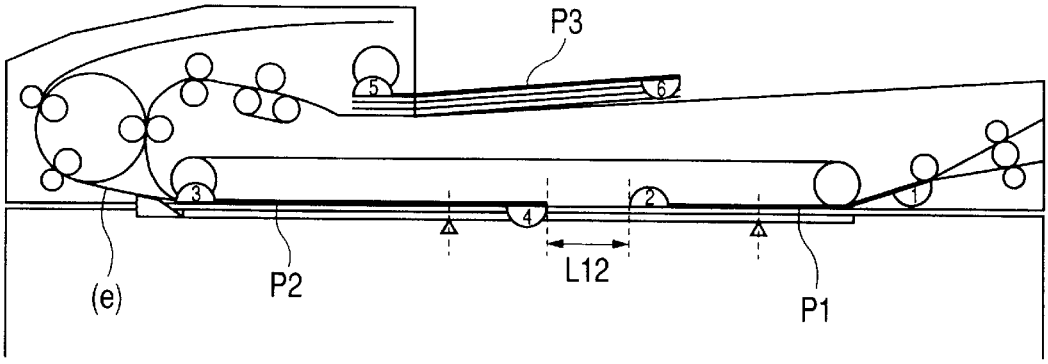
Figure 23A:
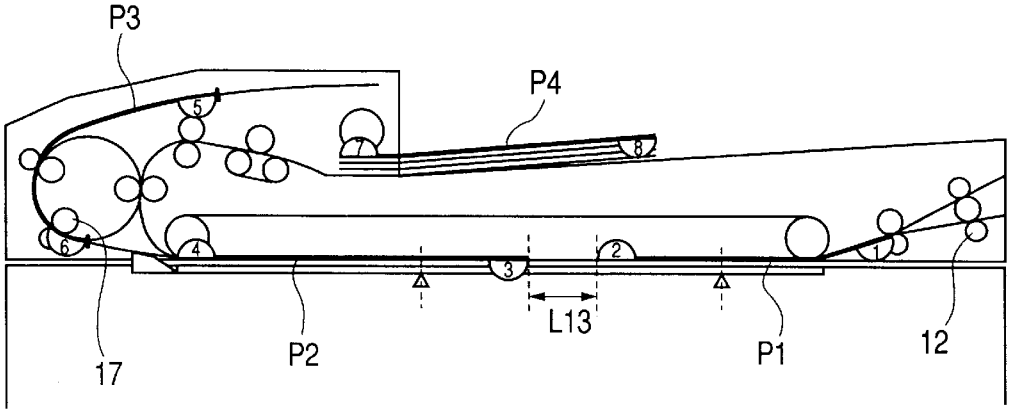
Figure 23B:
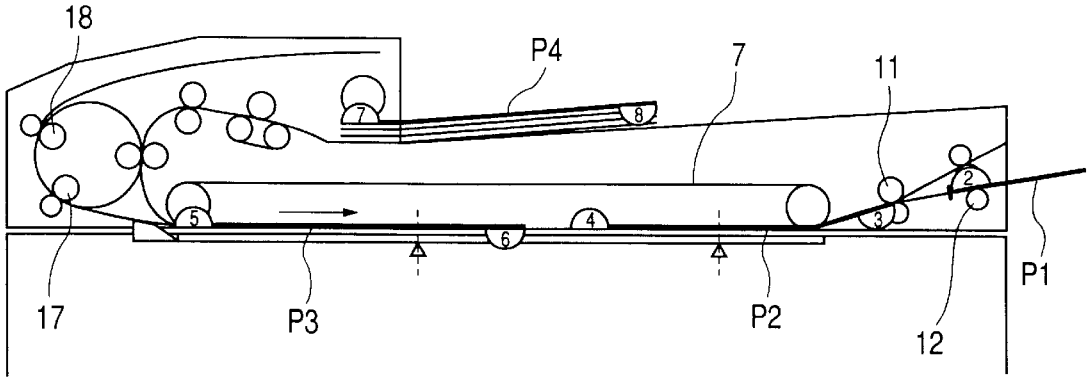

When the scanning of the second surface of the original P2 by the scanner unit 204 is completed, the reversing operation for the succeeding original P2 is started as in the case of the preceding original P1, and the succeeding original P2 and the preceding original P1 are conveyed toward the reverse feeding path (e). However, the rotation of the belt is temporarily stopped while the preceding original P1 is still in the conveyance path (d) on the platen 3, whereafter the direction of rotation of the wide belt 7 is switched (this is possible by setting the sheet interval L12 to an appropriate value). As the result, the original P1 and the original P2 are again conveyed toward the sheet discharge roller 12 and are stopped (see FIG. 23A). Then, in this state, the reading of the first surface of the original P2 is again started. The sheet interval between the original P1 and the original P2 at this time is L13 (it is also possible to control this sheet interval so as to be L12). Also, at this time, the succeeding original P3, as in the case of the original P2 shown in FIG. 22A, is waiting while being nipped by the first reversing rollers 17.

When the reading and scanning of the first surface of the original P2 are completed, the reverse rotation of the first reversing rollers 17 and the second reversing rollers 18, the forward rotation of the wide belt 7 and the rotation of the sheet discharge roller 12 are started. Thereby, the succeeding original P3, and the original P2 and the original P1 of which the images have been read are conveyed at a time.

When the wide belt 7 is stopped and the placement of the second surface of the succeeding original P3 is completed, the trailing end of the preceding original P1 has already passed the nip of the manual-insert register rollers 11. Accordingly, thereafter, the preceding original P1 is singly conveyed by the sheet discharge roller 12 and is discharged onto the sheet discharge tray 10 (see FIG. 23B). This is accomplished by setting the sheet interval to L13.

By the above-described operations being continuously performed, the final original Pm and the before-the-final original $P_{n-1}$ are arranged side by side on the platen 3 when the reading and scanning of the first surface of the final original $P_n$ completed, and these originals are discharged at a time by the continuous operation of the wide belt 7.

7) (2)(iv) Large-Size Both-Face Original Conveying Mode

FIGS. 24A, 24B, 25A, 25B, 26A, 26B and 27 are typical views showing the flow of the originals during the conveyance of large-size both-face originals. The conveying speeds of the second feeding rollers 9 and the wide belt 7 are controlled so as to be equal to each other except for a special case.

When the original conveying mode is the both-face original conveying mode, the reverse sheet supply flapper 22 and the reverse flapper 23 are in their states depicted by solid lines in FIG. 13 at first. In this state, the original P1 is directed to the side of the reverse feeding paths (h), (f) and (i) (see FIG. 24A). When the trailing end of the original passes the one-way flapper 24, the rollers 17 and 18 are reversely rotated to convey the original P1 in the reverse direction.

Figure 24A:
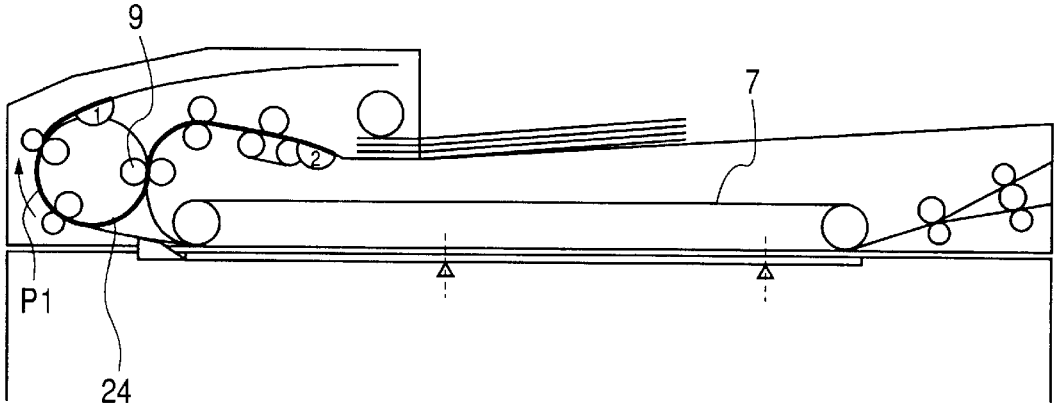
FIGS. 24A, 24B, 25A, 25B, 26A, 26B and 27 show the flow of a large-size original in both-face original conveying mode.
Figure 24B:
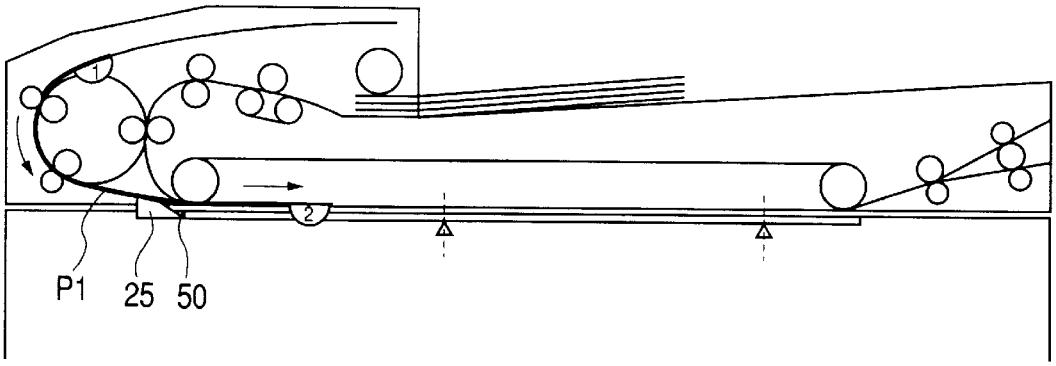
Figure 25A:
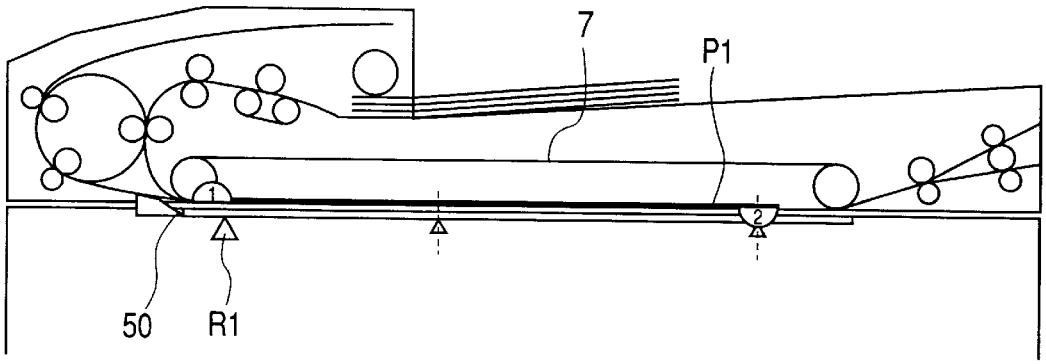
Figure 25B:
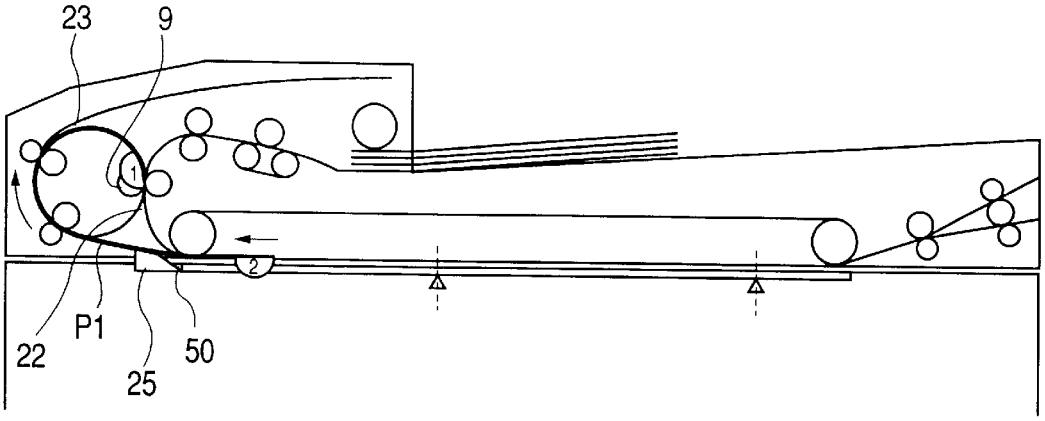
Figure 26A:
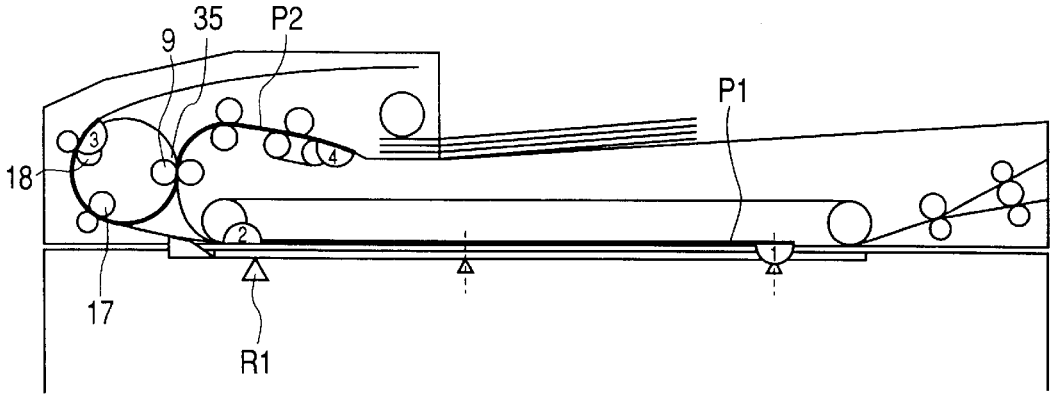
Figure 26B:
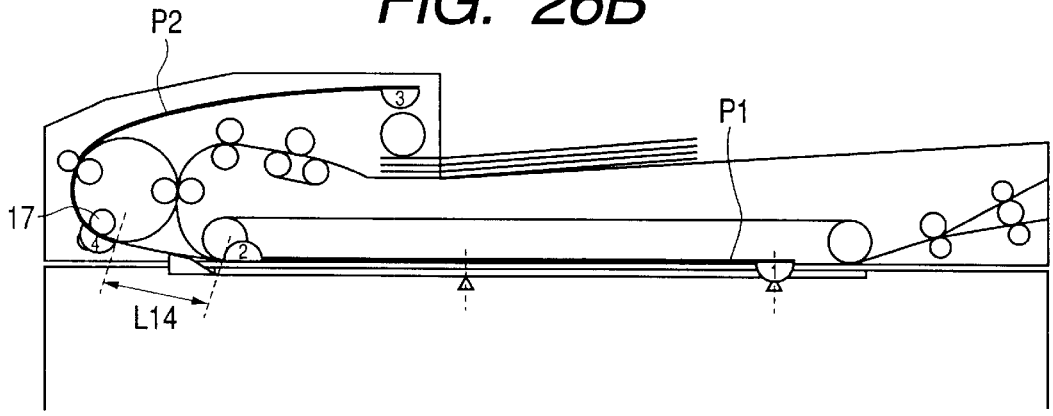
Figure 27:
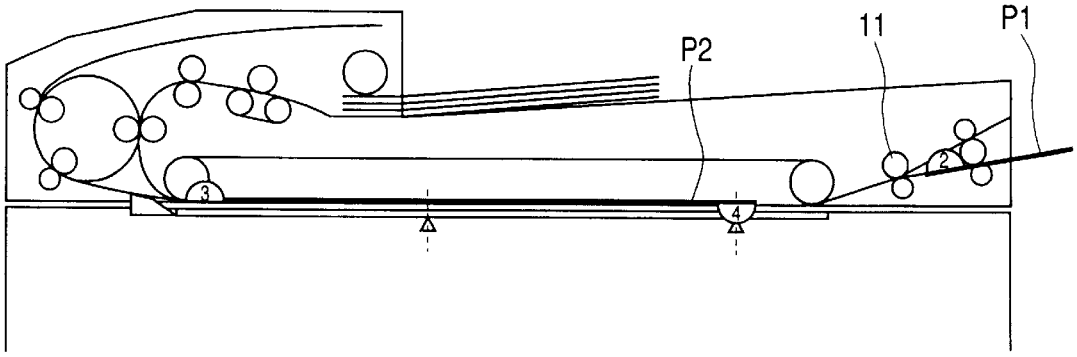
Figure 28A:
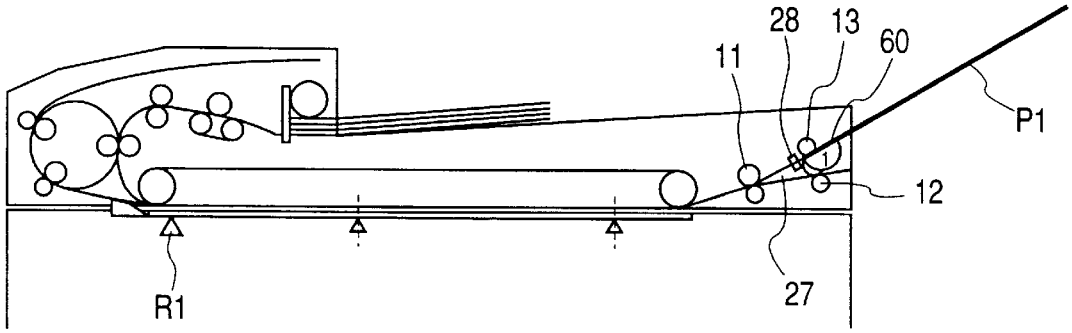
FIGS. 28A, 28B, 29A and 29B show the flow of an original during the conveyance of a manually inserted original.
Figure 28B:
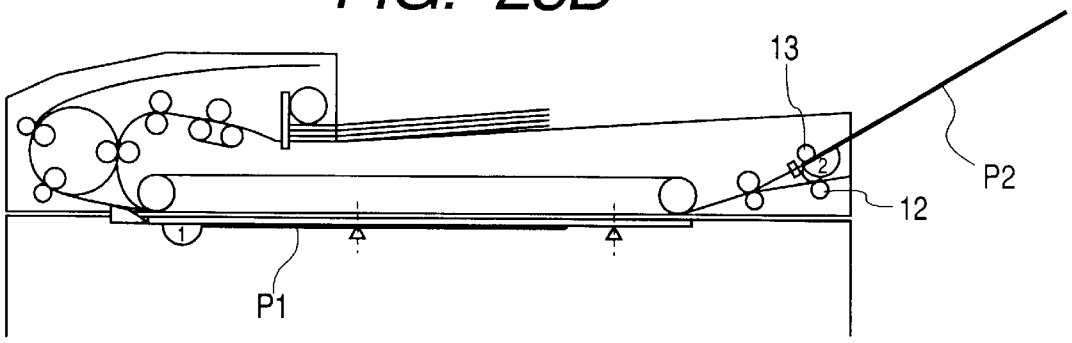

Since the supply and discharge flapper 25 is in its state depicted by solid line in FIG. 13, the reversely conveyed original P1 is directed to the original conveyance path (d) on the platen 3 (see FIG. 24B). When the original P1 is further conveyed by a predetermined distance after a point of time at which the reverse sensor 50 has detected the trailing end of the original in the direction of conveyance, the wide belt 7 is stopped. In this state, the original P1 is placed at the first reading position R1 during the fixed reading mode (see FIG. 25A).

The path switch solenoid 107 is switched off before or after the completion of the placement of the original. Thereupon, the reverse sheet supply flapper 22 and the supply and discharge flapper 25 rock to assume their states depicted by broken lines in FIG. 13. When the reading and scanning of the second surface of the original P1 by the scanner unit 204 are completed, the wide belt 7 is reversely rotated and the original P1 is conveyed to the original supply and discharge path (e). At this time, simultaneously with the reverse rotation of the wide belt 7, the reverse flapper 23 rocks to assume its state indicated by broken line in FIG. 13. Therefore, the original P1 is directed to the original reversing path (g) (see FIG. 25B).

When the original is further conveyed by a predetermined distance after a point of time at which the reverse sensor 50 detected the leading end of the original, the rotation of the wide belt 7 is once stopped, and thereafter is reversed (from reverse rotation to forward rotation). The conveying speeds of the second feeding rollers 9 and the wide belt 7 are controlled so as to coincide with each other when the leading end of the reversed original P1 comes to the original conveyance path (d) on the platen.

When the trailing end of the preceding original P1 passes the nip point of the second feeding rollers 9, the second feeding rollers 9 are stopped and wait for the arrival of the succeeding original P2. The preceding original P1 is singly conveyed by the wide belt 7. However, the wide belt 7 is stopped when the original P1 is further conveyed by a predetermined distance after a point of time at which the sheet supply sensor 35 detected the trailing end of the original P1. As the result, the original P1 is placed at the first reading position R1 during the fixed reading mode.

Also, before or after the detection of the trailing end of the preceding original by the sheet supply sensor 35, the separating operation for the succeeding original P2 is started and the well-known skew-feed elimination is effected by the second feeding roller being stopped. Thereafter, the original P2 is directed to the reverse feeding paths (h), (f) and (i) (see FIG. 26A).

During the scanning of the first surface by the scanner unit 204, the reversing operation for the succeeding original P2 is completed as in the case of the preceding original P1. The succeeding original P2 after reversed is waiting with the vicinity of its leading end nipped by the first reversing rollers 17 (see FIG. 26B). The sheet interval between the preceding original P1 at this time and the waiting succeeding original P2 is controlled so as to be L14.

When the reading and scanning of the first surface of the preceding original P1 are completed, the reverse rotation of the first reversing rollers 17 and the second reversing rollers 18 and the forward rotation of the wide belt 7 are started at a time. Thereby, when the succeeding original P2 is placed on the platen 3, the trailing end of the preceding original P1 passes through the nip of the manual-insert register rollers 11 (see FIG. 27). The aforementioned L14 has its value preset so as to bring about such a state.

Thereafter, operations similar to these are continued up to the final original $P_n$.

7) (2)(v) Manual-Insert Original Conveying Mode

FIGS. 28A, 28B, 29A and 29B show the flow of the originals during the manual-insert original conveyance.

When the manual-insert original detecting sensor 60 detects that the original P1 has been set (see FIG. 28A), the manual-insert flapper 27 and the manual-insert shutter 28 assume their states depicted by solid lines in FIG. 4. Then, this original P1 is conveyed by the manual-insert sheet supply roller 13 and skew-feed elimination is effected by the manual-insert register rollers 11 stopped. Thereafter, when the leading end of the original arrives at the first reading position R1 on the platen 3, the conveyance of the original P1 is stopped (see FIG. 28B). At this time, the manual-insert flapper 27 and the manual-insert shutter 28 are returned to their states depicted by broken lines in FIG. 4, and make the setting of the next original possible.

After the completion of the reading and scanning by the scanner unit 204, the wide belt 7 is reversely rotated so that the original P1 is discharged toward the sheet discharge roller 12. With the rotation of the sheet discharge roller 12, the manual-insert sheet supply roller 13 is also rotated. However, the leading end of the original P2 is regulated by the manual-insert shutter 28, and therefore the manual-insert sheet supply roller 13 slips and the original P2 is not moved forward (see FIG. 29A).

Figure 29A:
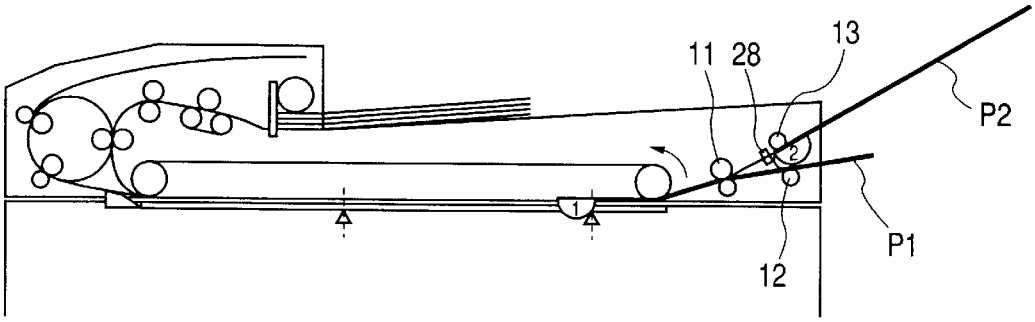
Figure 29B:
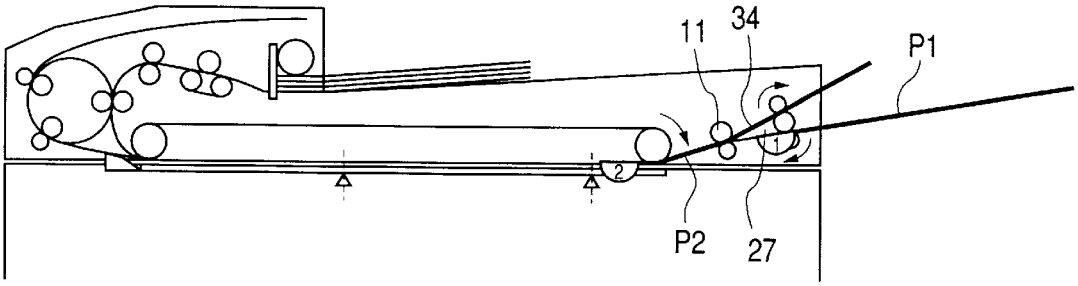

When the trailing end of the original P1 is detected by the manual-insert register sensor 34, the manual-insert register rollers 11 are stopped (see FIG. 29B). Also the manual-insert flapper 27 and the manual-insert shutter 28 assume their states depicted by solid lines in FIG. 4.

Thereafter, the original P2 is conveyed toward the manual-insert register rollers 11 by the manual-insert sheet supply roller 13, and after the completion of the aforementioned skew-feed elimination, the original P2 is placed on the platen 3 like the original P1.

4. Control Construction

Figures 30, 30A:
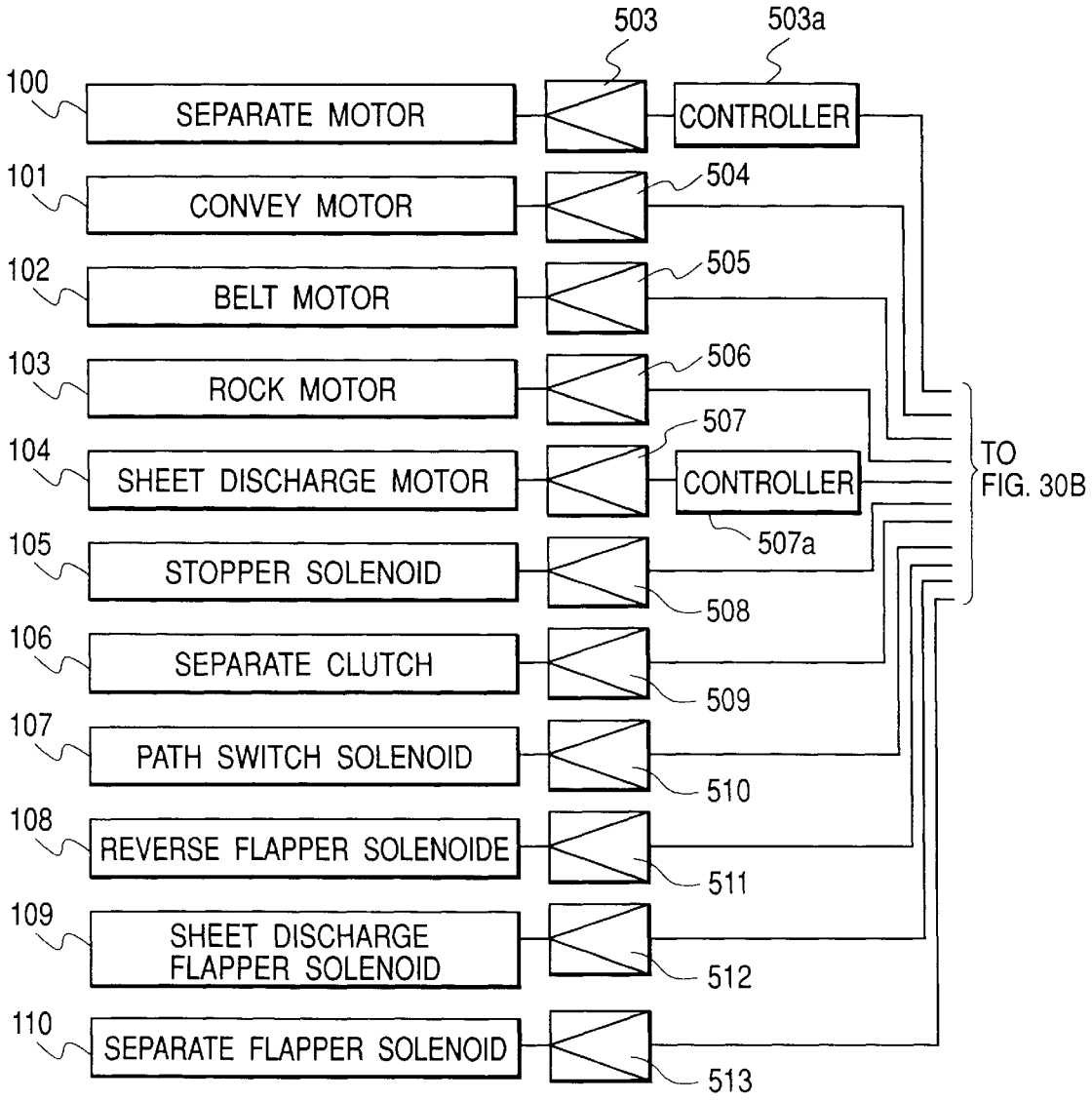
FIG. 30 is comprised of FIGS. 30A and 30B are block diagrams showing the circuit construction of a control apparatus.
Figure 30B:
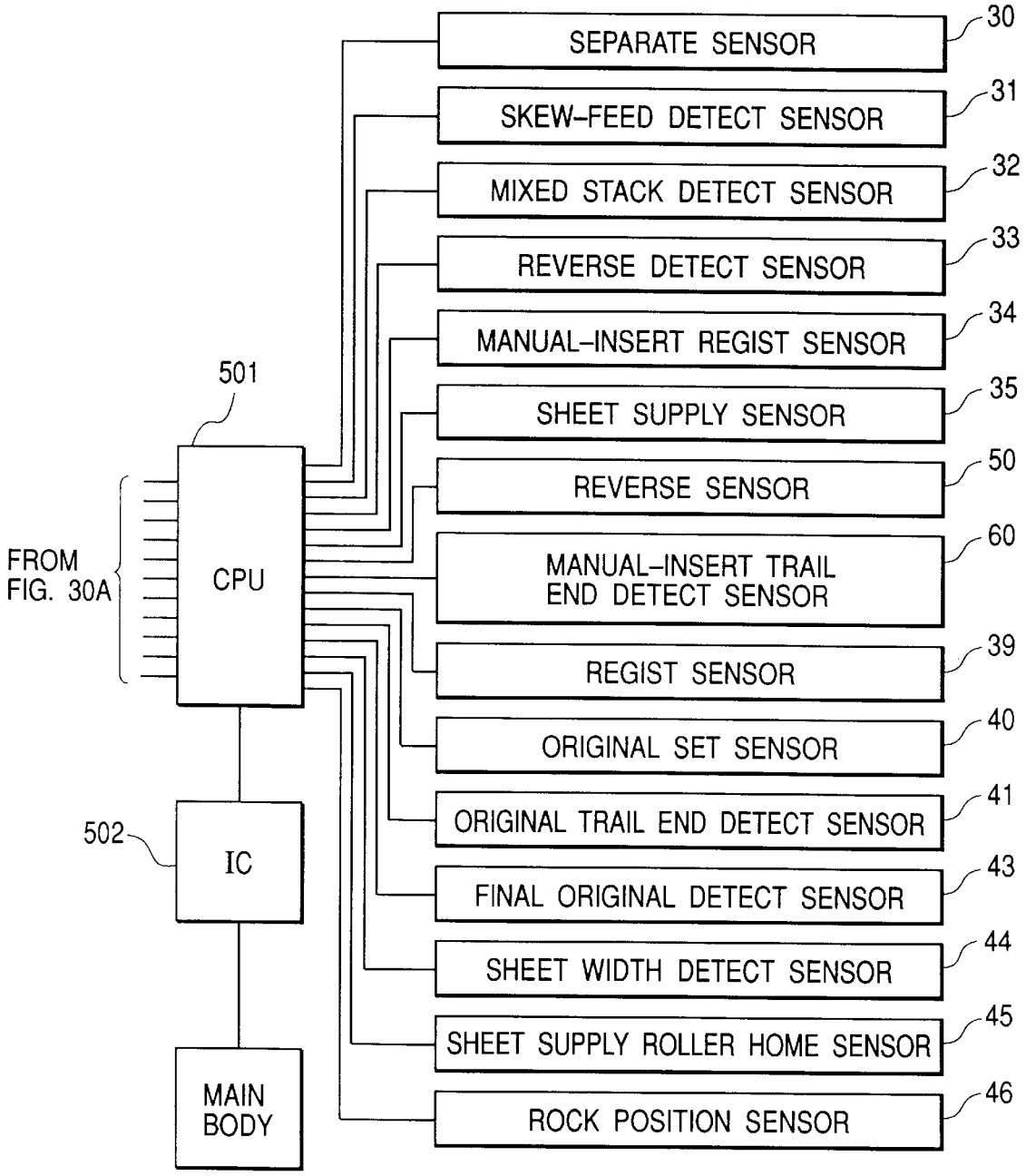

1) Control Circuit . . . see FIGS. 30A and 30B

FIGS. 30A and 30B are block diagrams showing the circuit construction of a control apparatus in the present embodiment.

The control apparatus is provided with a microprocessor (CPU) 501, a RAM (not shown) backed up by a battery (not shown), a ROM (not shown) in which control sequence software is stored, and a communication IC 502 for controlling the data communication with the copying apparatus body. Drive circuits for various loads and sensor signals are connected to the input and output ports of the CPU 501.

In FIGS. 30A and 30B, the separate motor 100 (DC brush motor) is drive-controlled by a driver 503 and a controller 503*a*. A reference clock providing a reference for the number of revolutions of the motor, an ON/OFF signal, etc. are inputted from the CPU 501 to the controller 503*a*.

In the present embodiment, the convey motor 101 (stepping motor) is driven by a stepping motor driver 504. Likewise, the belt motor 102 is constant-current-driven by a stepping motor driver 505. A phase excitation signal and a motor current control signal are inputted from the CPU 501 to each driver.

The rock motor 103 (stepping motor) is constant-voltage-driven by a driver 506. The sheet discharge motor 104 (DC brush motor) is drive-controlled by a driver 507 and a controller 507*a* for FG servo.

The motors 100 to 104 have mounted thereon clock plates 100*a* to 104*a* and clock sensors 100*b* to 104*b* as mechanisms for detecting the rotational speeds of these motors (see FIG. 4). Further, the stopper solenoid 105 is driven by a driver 508. Likewise, the separate clutch 106 is driven by a driver 509, the path switch solenoid 107 is driven by a driver 510, the reverse flapper solenoid 108 is driven by a driver 511, the sheet discharge flapper solenoid 109 is driven by a driver 512, and the separate flapper solenoid 110 is driven by a driver 513. All of the drivers 503 to 513 have their operations controlled by signals connected to the input and output ports of the CPU 501.

Further, the sensors such as the separate sensor 30, the skew-feed detect sensor 31, the mixed stack detect sensor 32, the reverse detect sensor 33, the manual-insert register sensor 34, the sheet supply sensor 35, the reverse sensor 50, the manual-insert trail end detect sensor 60, the register sensor 39, the original set sensor 40, the original trail end detect sensor 41, the final original detect sensor 43, the sheet width detect sensor 44, the sheet supply roller home sensor 45 and the rock position sensor 46 are connected to the input port of the CPU 501, to be used to monitor the behavior of the originals and the behavior of a movable load.

2) Controlling Operation 2) (1) Summary of the Controlling Operation

Figure 31:
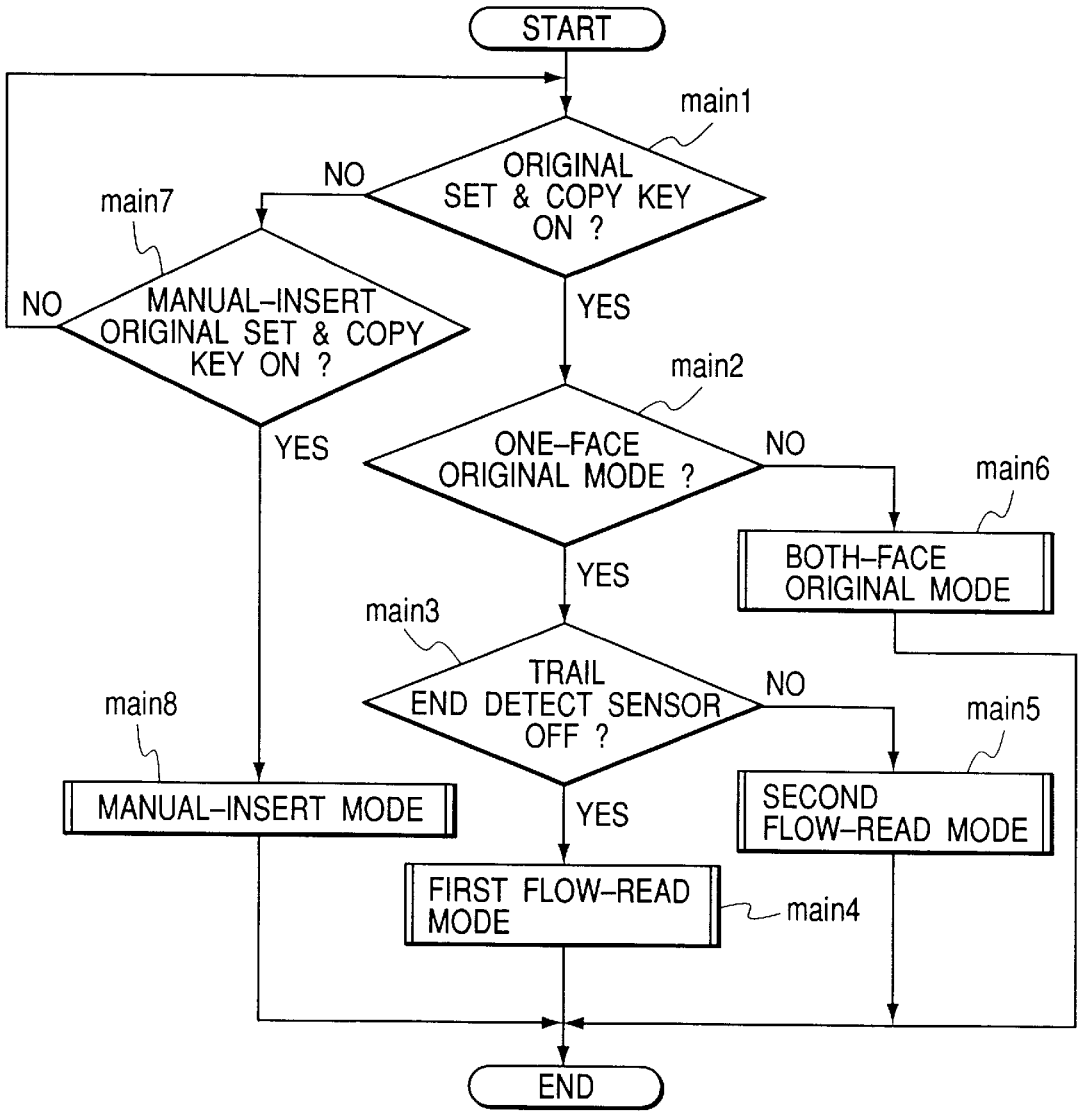
FIG. 31 is a flow chart showing the summary of operation.

FIG. 31 is a main flow chart of the controlling operation of the control apparatus.

The control apparatus assumes its waiting state while repetitively determining whether an original has been set on the original tray 4, whether an original has been set on the manual-insert original tray 14, and whether a copy key (not shown) on the operating portion of the copying apparatus body has been depressed (main 1, main 7). The determination of whether an original has been set is done on the basis of the results of the detection by the original set detect sensor 40 and the manual-insert original detect sensor 60.

When as the result of the above-mentioned determination, an original is set on the original tray 4 and the copy key is depressed, the discrimination treatments of main 2 and main 3 are effected.

The control apparatus, at main 2, discriminates the copying mode transmitted from the copying apparatus body, and at main 3, discriminates whether the original trail end detect sensor 41 is OFF. In conformity with the result of this discrimination, the copying process in each mode is carried out (main 4, main 5, main 6). That is, if the mode is not the one-face original mode, a series of copying processes are executed in the both-face original mode and the operation is completed (main 6). If the mode is the one-face original mode and the original trail end detect sensor 41 is OFF, a series of copying processes are executed in the first flow-read mode to complete the operation (main 4). If the mode is the one-face original mode and the original trail end detect sensor 41 is not OFF, a series of copying processes are executed in the second flow-read mode which will be described later to complete operation (main 5).

Figure 32:
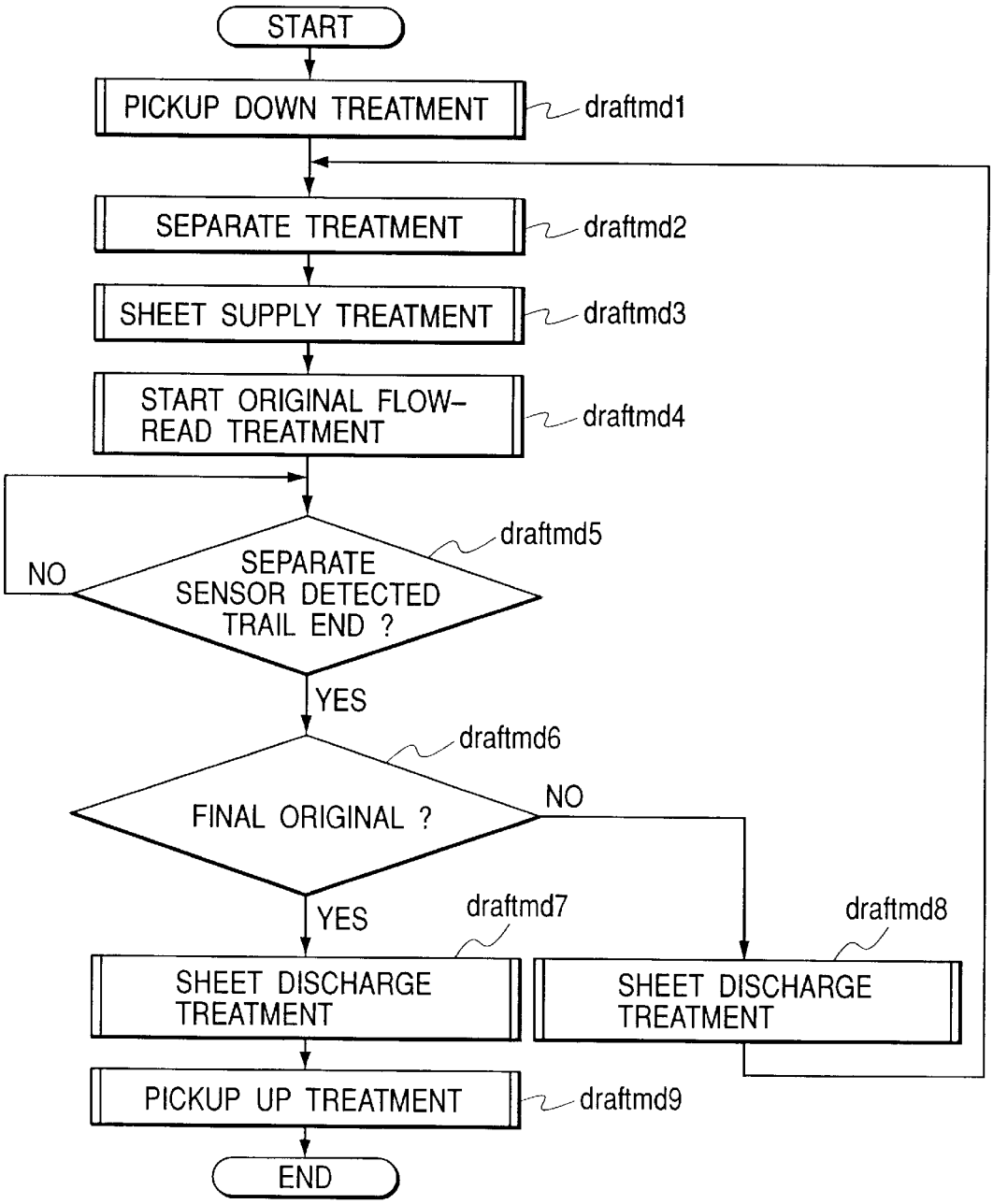
FIG. 32 is a flow chart showing treatments in a first flow-reading mode.
Figure 33:
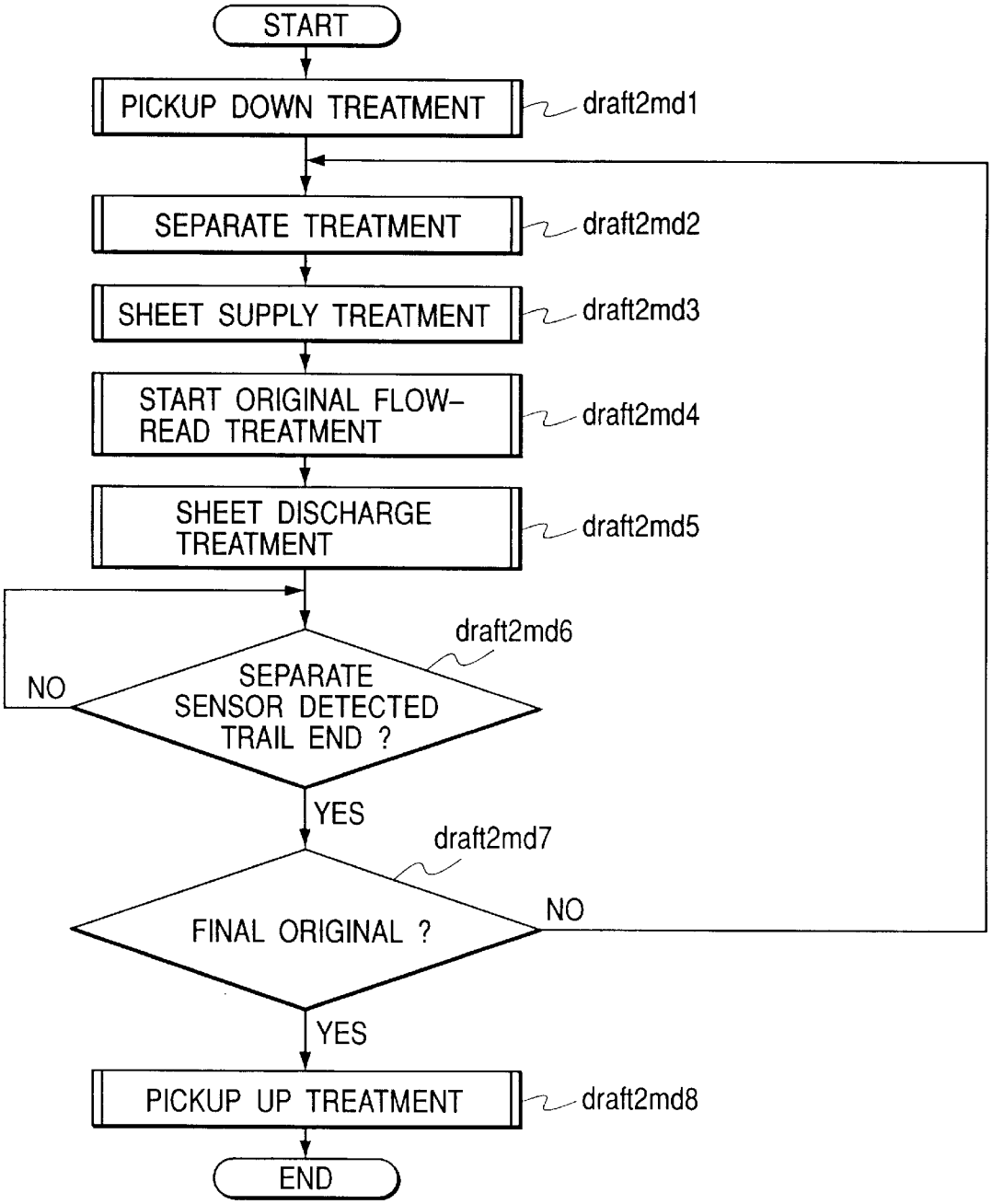
FIG. 33 is a flow chart showing treatments in a second flow-reading mode.
Figure 34:
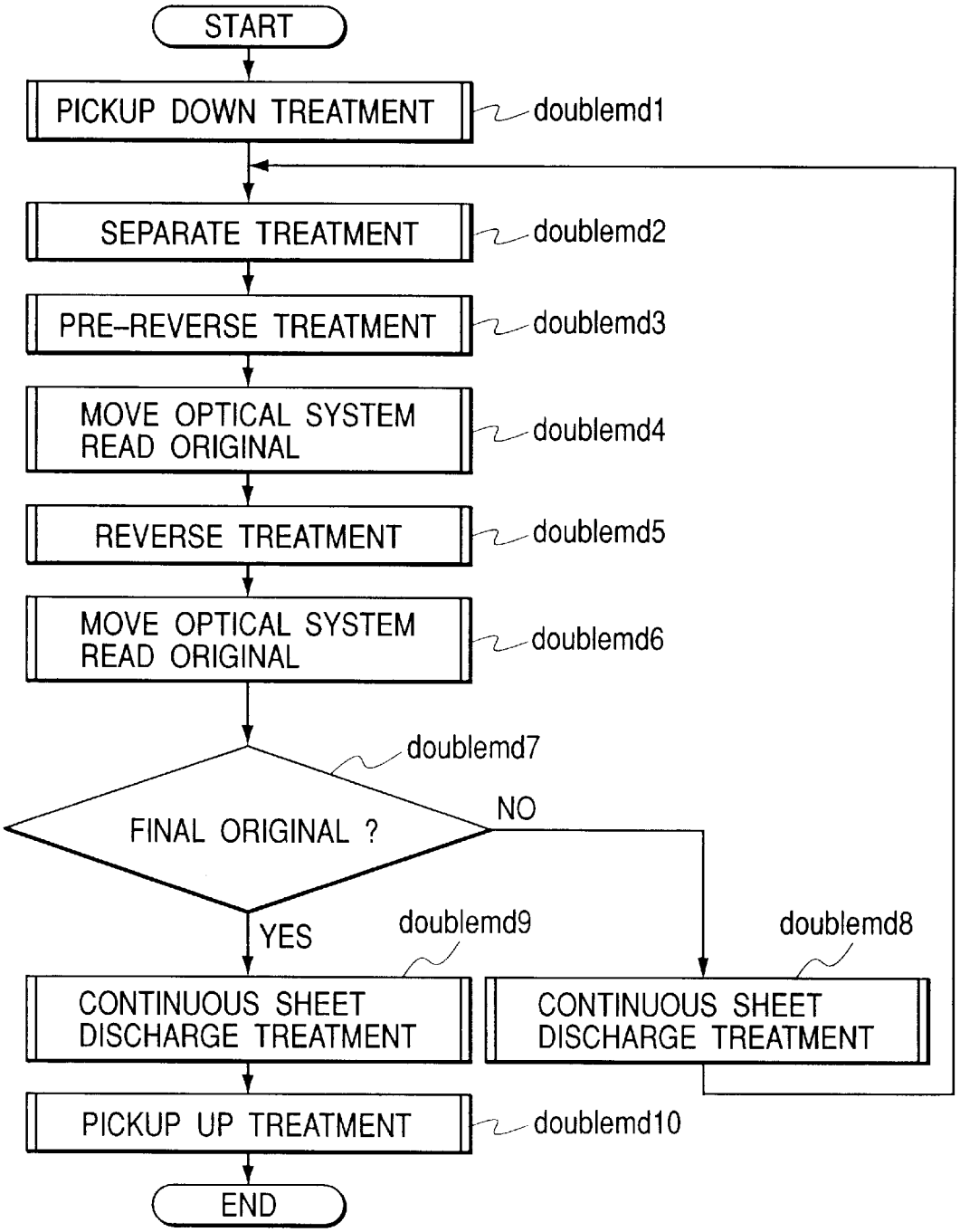
FIG. 34 is a flow chart showing treatments in a both-face original mode.

The details of the first flow-read mode, the second flow-read mode and the both-face original mode will be described later with reference to FIGS. 32, 33 and 34.

If as the result of the determination at the aforedescribed main 2, an original is set on the manual-insert original tray 14 and the copy key is depressed, a series of copying processes are executed in the manual-insert mode to be described later to complete the operation (main 8). The details of the manual-insert mode will be described later with reference to FIG. 35.

Here, a mode confirming to the size of the original is selected done on the basis of only the result of the detection (ON/OFF) by the original trail end detect sensor 41, i.e., on the basis of only the length of the original in the feeding direction. However, the selection of the mode may be done by also the use of the result of the detection by the sheet width detect sensor 44 (i.e., the width of the original).

2) (2) Details of the Controlling Operation in Each Mode 2) (2)(i) First Flow-Read Mode The details of the first flow-read mode will hereinafter be described with reference to FIG. 32.

The control apparatus effects pickup down treatment which will be described later to move the sheet supply roller 5 on the surface of sheets placed on the original tray 4 (draftmd 1). Thereafter, separate treatment (draftmd 2) and sheet supply treatment (draftmd 3) are effected to separate the uppermost one of the originals. Further, original flow-read treatment for effecting the reading of the image of the original with the optical system of the copying apparatus body remaining fixed at a predetermined position is started (draftmd 4). Thereafter, the control apparatus continues to wait for the trailing end of the original to be detected by the separate sensor 30 (draftmd 5). When the separate sensor 30 detects the trailing end of the original, the control apparatus determines whether the original supplied at that time is the final original, on the basis of the result of the detection by the original set detect sensor 40 which detects a pause in the bundle of originals (draftmd 6). If as the result of this determination, the supplied original is not the final original, sheet discharge treatment which will be described later is started to discharge the original onto the sheet discharge tray 10 (draftmd 7). Thereafter, return is made to (draftmd 2) and the treatments are repeated.

Also, if at (draftmd 6), the original is the final original, sheet discharge treatment is started (draftmd 8), whereafter pickup treatment which will be described later is effected to thereby return the sheet supply roller 5 to the upper limit position (draftmd 9). Thus, a series of treatments are ended.

When the length of the original in the feeding direction is L'mm, the scanner unit 204 (see FIG. 1) is positioned L'mm or more downstream of the second feeding roller 9 with respect to the direction of conveyance in the conveyance path (the reading positions R2 and R3 in FIG. 11). The position control of the scanner unit 204 may be effected by a well-known stepping motor or other mechanical type stopper construction.

Various basic treatments (e.g. pickup down treatment and separate treatment) constituting the treatment in the above-described first flow-read mode will be described later in detail.

2) (2)(ii) Second Flow-Read Mode

The second flow-read mode will hereinafter be described with reference to FIG. 33.

The control apparatus effects pickup down treatment to move the sheet supply roller 5 onto the surface of sheets placed on the original tray 4 (draft 2 md 1). Thereafter, it effects separate treatment (draft 2 md 2) which will be described later and sheet supply treatment (draft 2 md 3) to separate the uppermost original. Further, it starts original flow-read treatment for effecting the reading of the image of the original with the optical system of the copying apparatus body remaining fixed at a predetermined position (draft 2 md 4). Further, it starts sheet discharge treatment which will be described later to discharge the original onto the sheet discharge tray 10 because the fixed position of the optical system is near the sheet discharge portion (draft 2 md 5).

Thereafter, the control apparatus continues to wait for the trailing end of the original is detected by the separate sensor 30 (draft 2 md 6). When the separate sensor 30 detects the trailing end of the original, the control apparatus determines whether the original supplied at that time is the final original, on the basis of the result of the detection by the original set detect sensor 40 for detecting a pause in the bundle of originals (draft 2 md 7). If as the result of this determination, the supplied original is not the final original, treatment is returned to (draft 2 md 2), where the treatments are repeated. On the other hand, if the supplied original is the final original, pickup up treatment which will be described later is effected to thereby return the sheet supply roller 5 to the upper limit position (draft 2 md 8), to complete a series of treatments.

At this time, the scanner unit 204 (see FIG. 1) is at the third reading position R3 (see FIG. 11).

Various basic treatments (e.g. pickup down treatment and separate treatment) constituting the treatment of the above-described second flow-read mode will be described later in detail.

2) (2)(iii) Both-Face Original Mode

The both-face original mode will now be described with reference to FIG. 34.

The control apparatus effects pickup down treatment which will be described later to move the sheet supply roller 5 onto the surface of sheets placed on the original tray 4 (doublemd 1). Thereafter, it effects separate treatment which will be described later to separate the uppermost original (doublemd 2). Further, it reverses the separated original and effects pre-reverse treatment which will be described later (doublemd 3) so that the second surface of the original may contact with the platen 3 and the original may be placed on the left end portion of the platen 3.

Thereafter, it effects optical system movement original read treatment for effecting the reading of the image of the original while moving the optical system of the copying apparatus body (doublemd 4). When the read treatment is completed, the control apparatus effects reverse treatment to reverse the original again (doublemd 5), and it effects optical system movement original read treatment, whereby the reading of the image of the first surface of the original is also completed (doublemd 6).

The control apparatus determines whether the original supplied at that time is the final original, on the basis of the result of the detection by the original set detect sensor 40 while it is effecting the read treatment (doublemd 7). If as the result of this determination, the supplied original is not the final original, sheet discharge treatment which will be described later is started to discharge the original onto the sheet discharge tray 10 (doublemd 8), and then the treatment is returned to (doublemd 2), where similar treatments are repeated. On the other hand, if the supplied original is the final original, sheet discharge treatment is effected (doublemd 9), whereafter pickup up treatment which will be described later is effected to thereby return the sheet supply roller 5 to the upper limit position (doublemd 10). Thus, a series of treatments are completed.

Various basic treatments (e.g. pickup down treatment and separate treatment) constituting the treatment of the above-described both-face original mode will be described later in detail.

2) (2)(iv) Manual-Insert Mode

Figure 35:
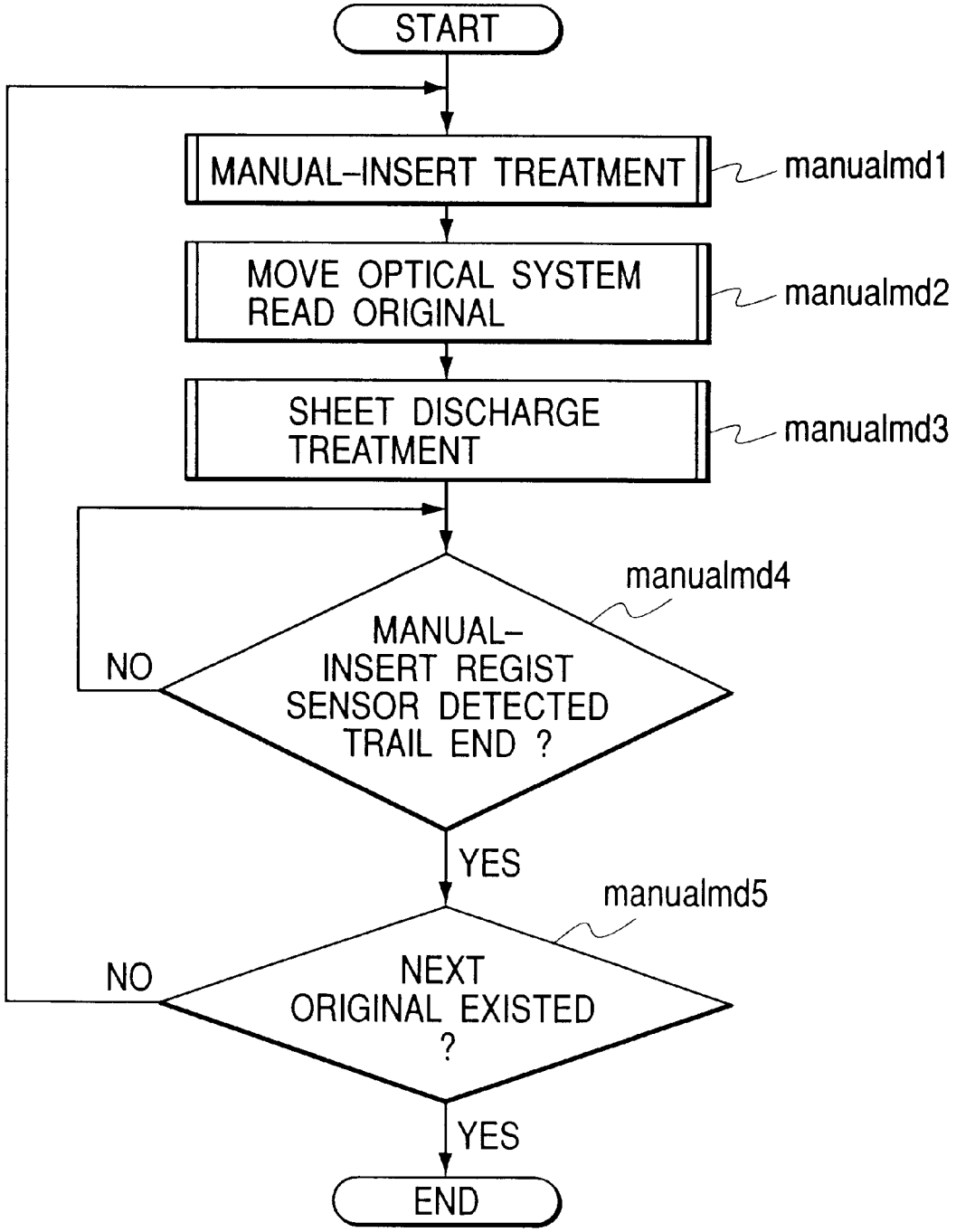
FIG. 35 is a flow chart showing treatments in a manual-insert original mode.

The manual-insert mode will now be described with reference to FIG. 35.

The control apparatus effects manual-insert sheet supply treatment to convey the original set on the manual-insert original tray 14 onto the platen 3 of the copying apparatus body (manualmd 1). Thereafter, it effects optical system movement original read treatment for effecting the reading of the image of the original while moving the optical system of the copying apparatus body (manualmd 2). After the completion of this treatment, it starts sheet discharge treatment to discharge the original onto the sheet discharge tray 10 (manualmd 3).

Thereafter, the control apparatus continues to wait for the trailing end of the original to be detected by the manual-insert register sensor 34 (manualmd 4). When the trailing end of the original is detected by the manual-insert register sensor 34, the control apparatus discriminates the presence or absence of the next original on the basis of the result of the detection by the manual insert original detect sensor 60 (manualmd 5). If as the result of this discrimination, the next original is present, treatment is returned to (manualmd 1), where similar treatments are repeated. On the other hand, if the next original is absent, manual-insert sheet discharge treatment is effected to complete a series of treatments.

Various basic treatments (e.g. manual-insert sheet supply treatment and original flow-read treatment) constituting the treatment of the above-described manual-insert mode will be described later in detail.

2) (3) Basic Treatments

Basic treatments constituting the above-described controlling operation will hereinafter be described.

2) (3)(i) Pickup Down Treatment

Figure 36:
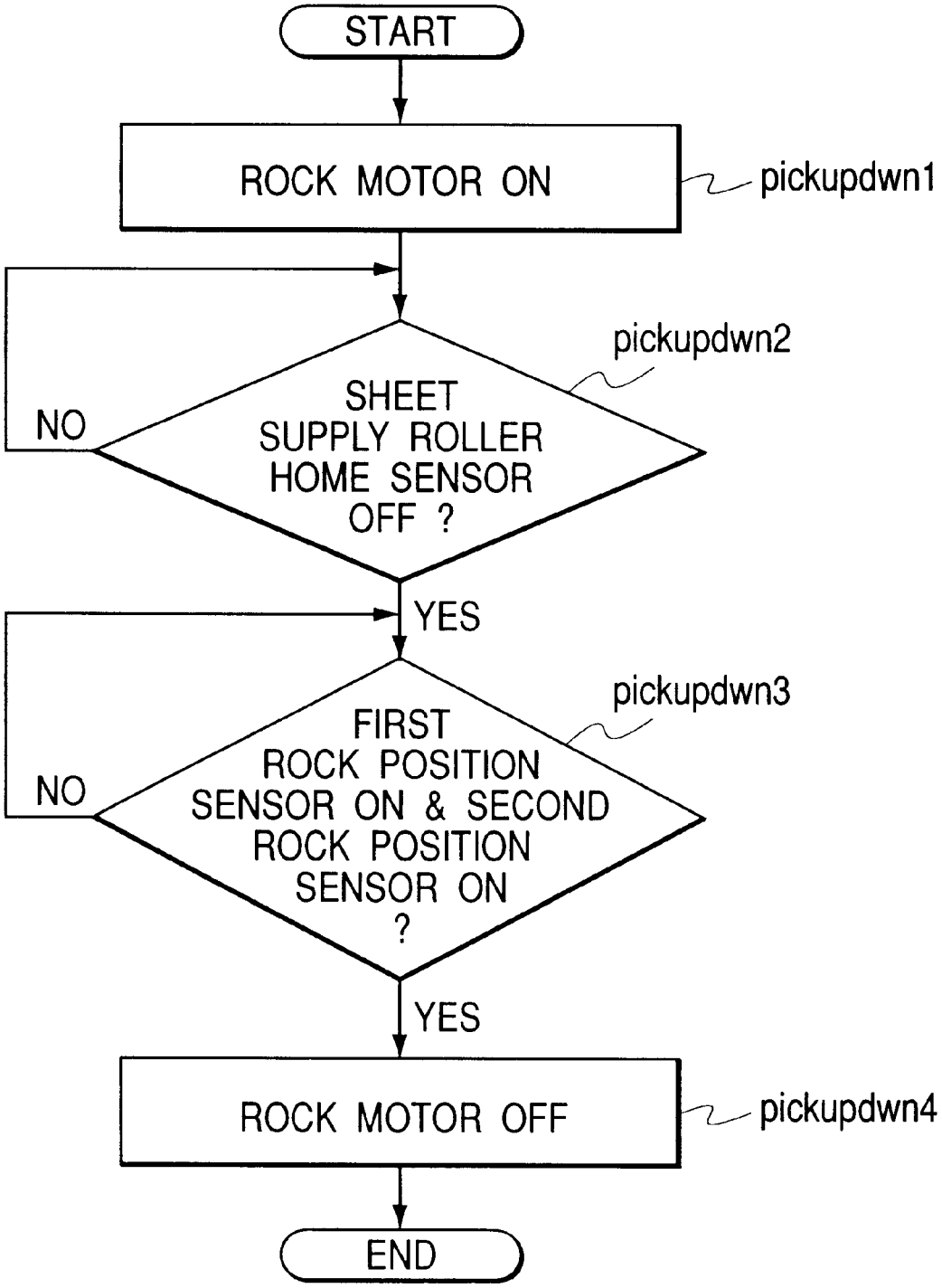
FIG. 36 is a flow chart showing the pickup down treatment for the lowering of a sheet supply roller.

Pickup down treatment will hereinafter be described with reference to FIG. 36.

The rock motor 103 is driven (pickupdwn 1) to thereby lower the lift arm 51, the rock arm 1 and the rock arm 2 to lower the sheet supply roller 5 from the position of FIG. 5 in which the sheet supply roller home sensor 45 is ON onto the bundle of originals P placed on the original tray. The sheet supply roller home sensor 45 is turned off to thereby confirm that the sheet supply roller has been lowered (pickupdwn 2). Whereafter the first rock position sensor 46 and the second rock position sensor 47 are turned on to thereby detect that the sheet supply roller 5 has dropped onto the surface of the sheet (pickupdwn 3), whereby the driving of the rock motor 103 is stopped (pickupdwn 4).

2) (3)(ii) Pickup Up Treatment

Figure 37:
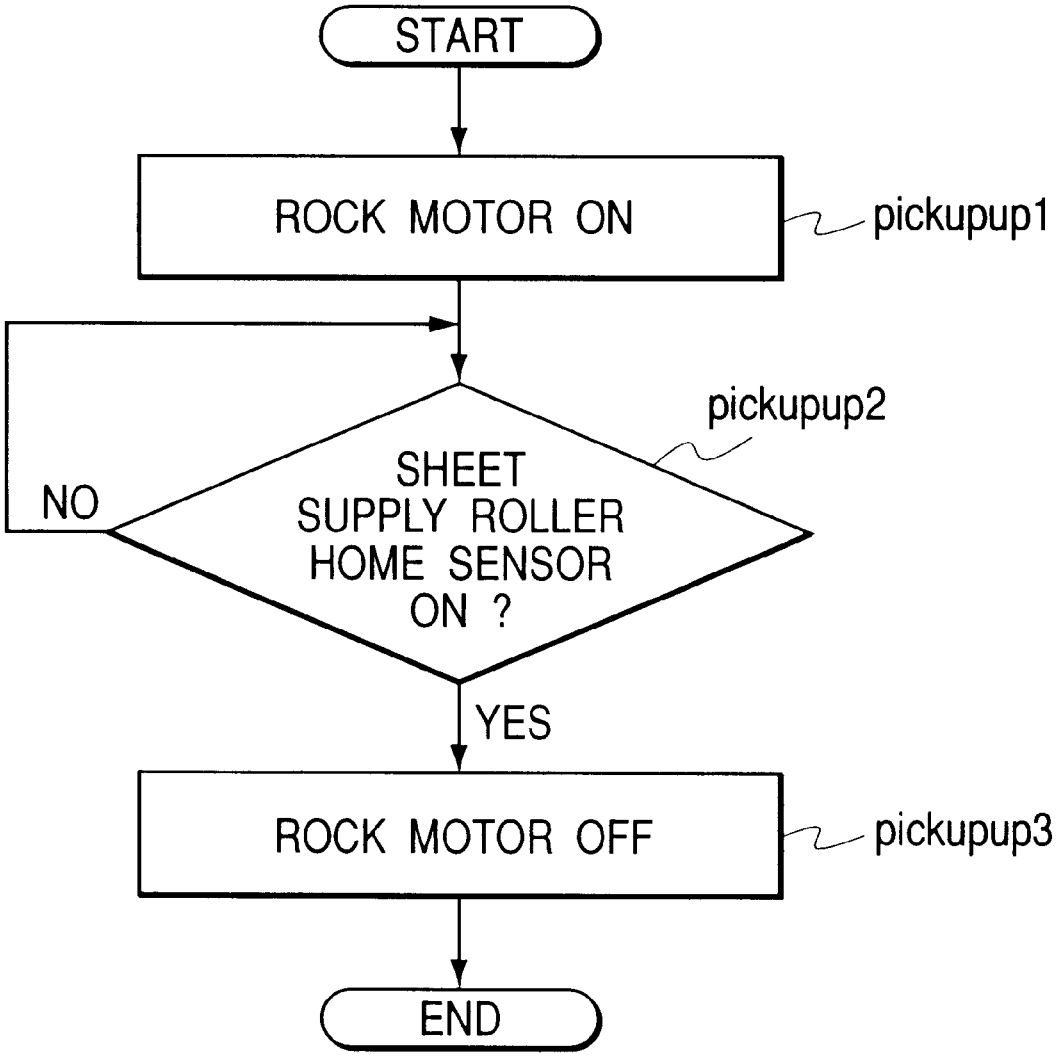
FIG. 37 is a flow chart showing the pickup up treatment for the raising of the sheet supply roller.

Pickup Up treatment will now be described with reference to FIG. 37.

The control apparatus drives the rock motor 103 to elevate the sheet supply roller 5 to its position shown in FIG. 5 (pickupup 1). When by the ON of the sheet supply roller home sensor 45, it detects that the sheet supply roller has reached its upper limit position (pickupup 2), the driving of the rock motor 103 is stopped (pickupup 3). The direction of rotation of the rock motor 103 at this time is opposite to that during the pickup down treatment.

2) (3)(iii) Separate Treatment

Figure 38:
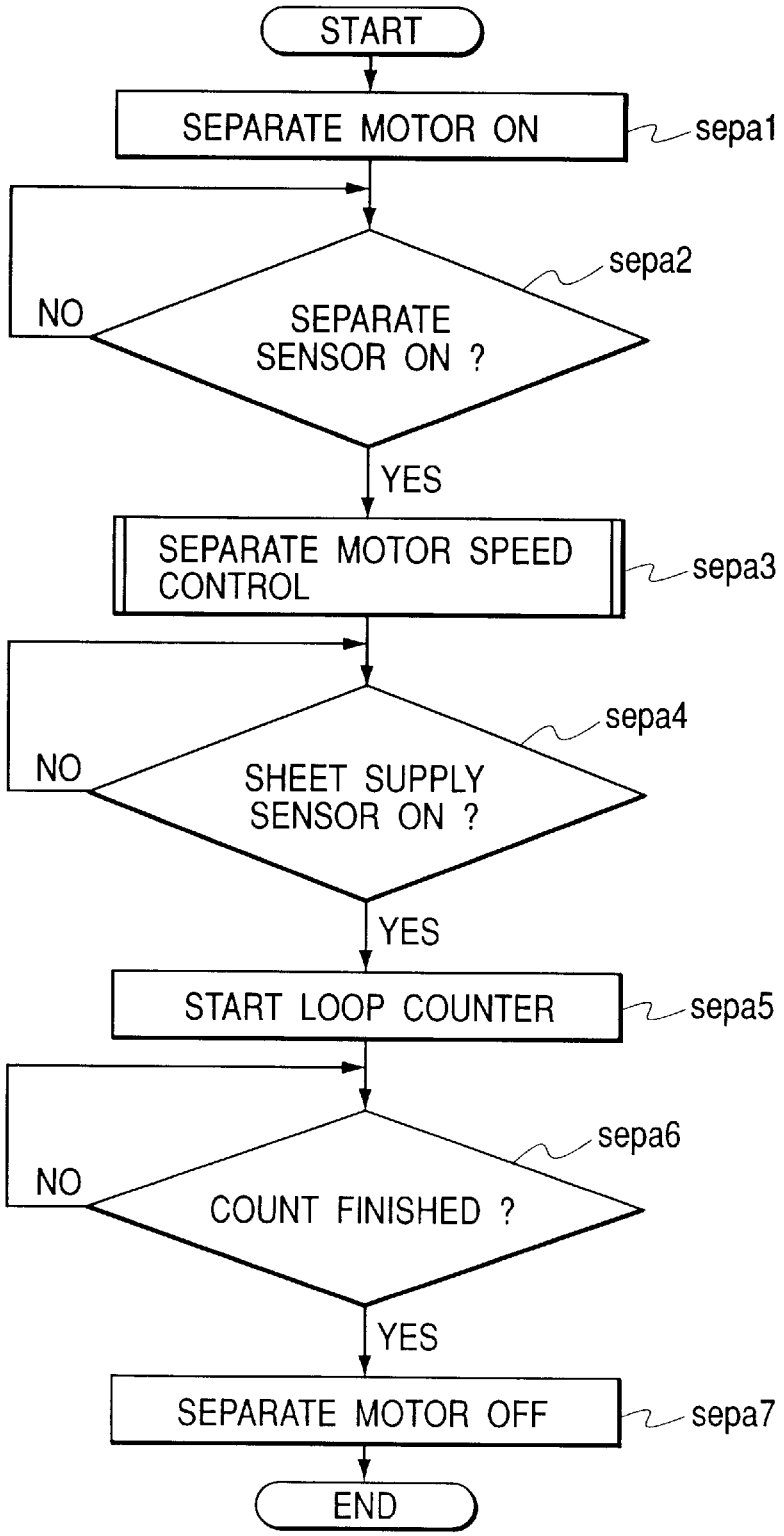
FIG. 38 is a flow chart showing the separating treatment.

Separate treatment will now be described with reference to FIG. 38.

The control apparatus switches on the separate motor 100 (sepa 1) and rotates the sheet supply roller having dropped onto the bundle of originals P, the separate belt 6, the separate-convey roller 8 and the first feeding roller 16 to thereby separate only the uppermost original P and convey it in the sheet path (a).

Thereafter, the control apparatus continues to monitor whether the leading end of the original has arrived at the detecting position of the separate sensor 30, on the basis of the result of the detection by the separate sensor 30 (sepa 2). When the result of the detection by the separate sensor 30 is ON, that is, when the leading end of the original arrived at the detecting position of the separate sensor 30, the control apparatus effects the speed control of the separate motor 100 so that separate treatment may end within a predetermined time range (sepa 3). This speed control is effected on the basis of the remaining conveyance distance until the leading end of the original is abutted against the second feeding roller 9 to form a loop, and the lapse time until the separate sensor 30 becomes ON.

Thereafter, the control apparatus continues to monitor whether the leading end of the original has arrived at the detecting position of the sheet supply sensor 35, on the basis of the result of the detection by the sheet supply sensor 35 (sepa 4). When the result of the detection by the sheet supply sensor 35 is ON, that is, when the leading end of the original arrived at the detecting position of the sheet supply sensor 35, a separate loop counter is started (sepa 5). This separate loop counter counts a clock signal inputted from a separate clock.

Thereafter, the control apparatus waits for the separate loop counter to count up to a predetermined value (sepa 6). After the completion of the counting, the control apparatus switches off the separate motor 100 (sepa 7). Thereby, the original has its leading end abutted against the nip portion of the second feeding roller 9 and is stopped with a predetermined amount of loop formed, and therefore the skew-feed which occurred during separation can be corrected.

2) (3)(iv) Sheet Supply Treatment

Figures 39, 39A:
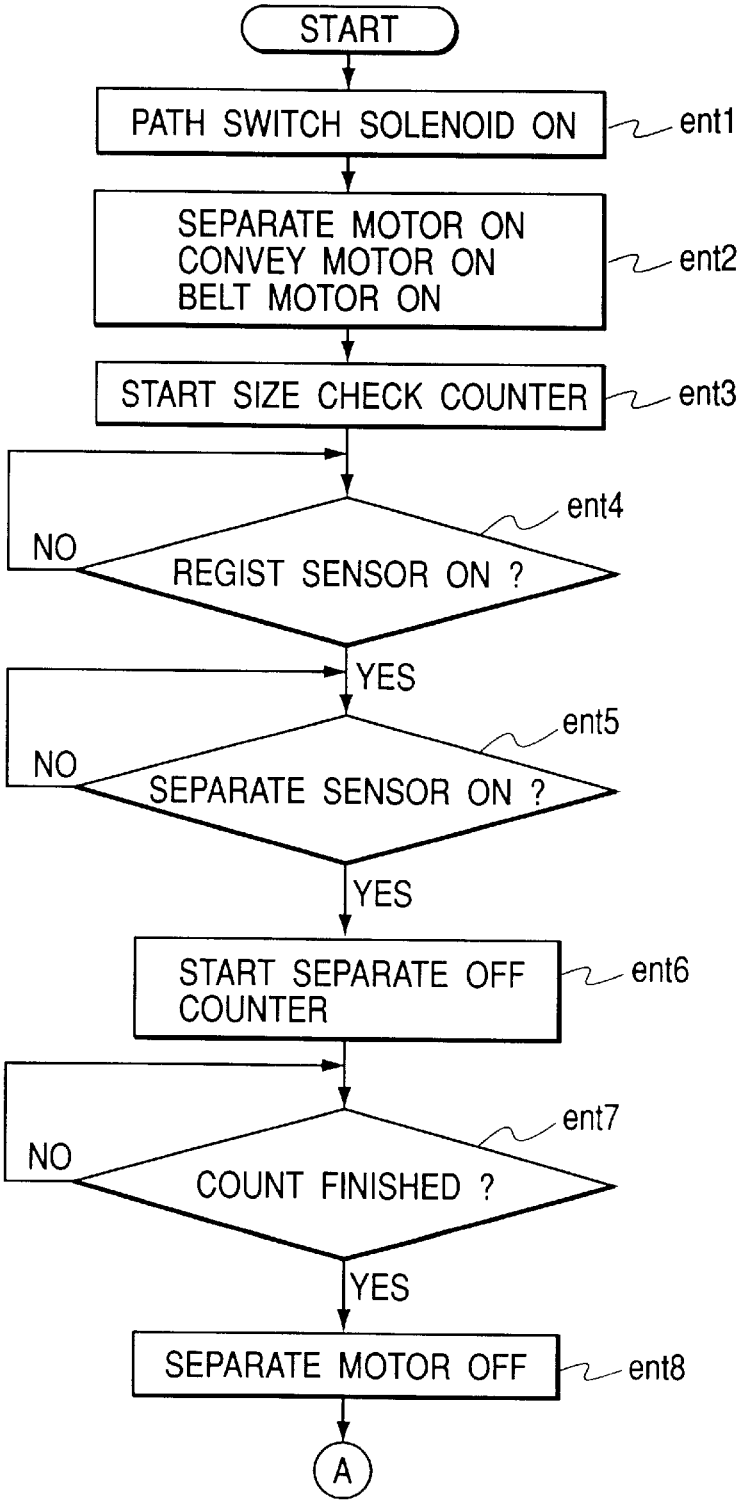
FIG. 39 is comprised of FIGS. 39A and 39B are flow charts showing the sheet supplying treatment.
Figure 39B:
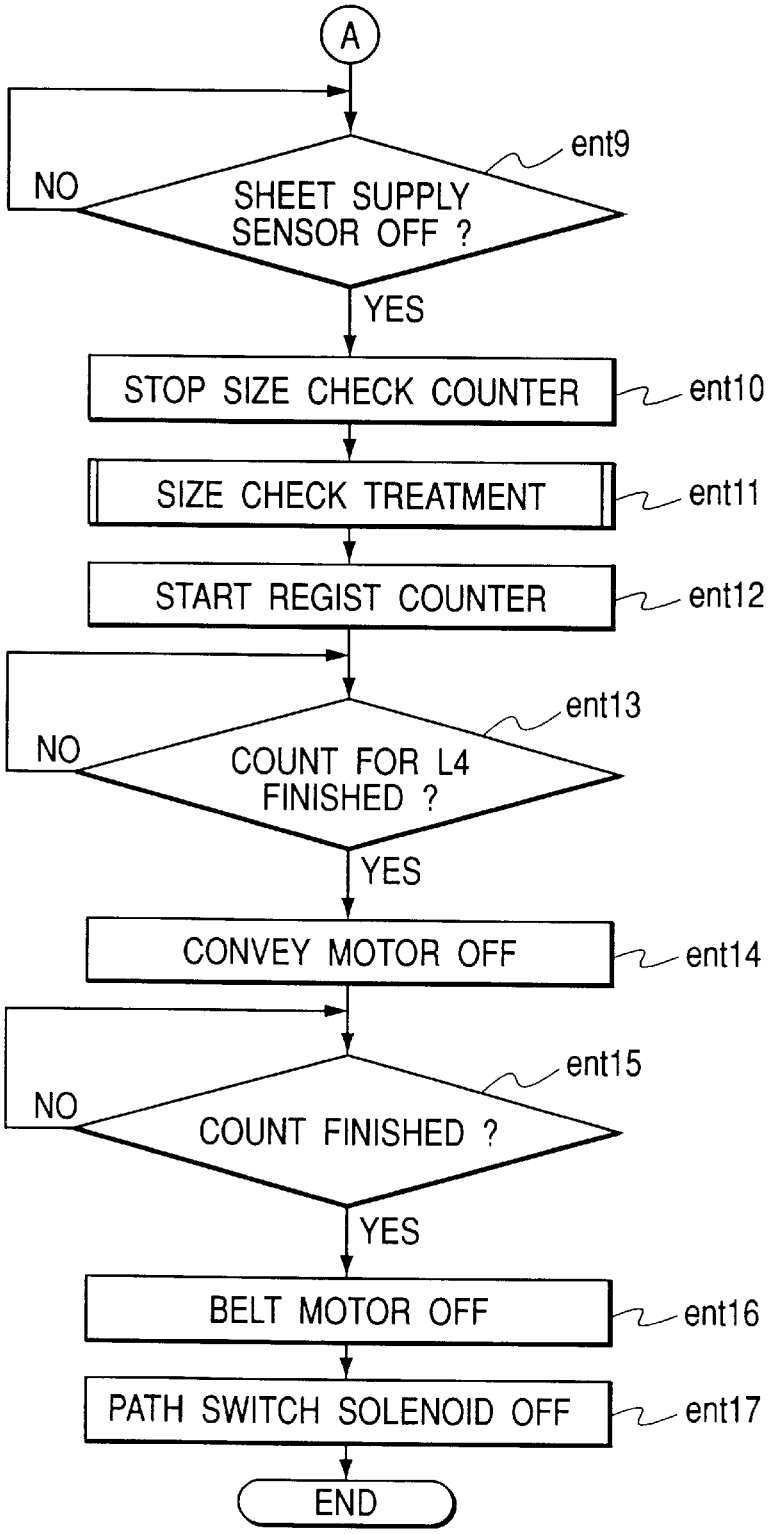

Sheet supply treatment will now be described with reference to FIGS. 39A and 39B.

The reverse sheet supply flapper 22, as indicated by solid line in FIG. 13, is usually biased so that the original may be conveyed to the sheet path (h) in the OFF state of the path switch solenoid 107. The control apparatus first switches on the path switch solenoid 107 to thereby switch the reverse sheet supply flapper 22 to its state depicted by broken line in FIG. 13 (ent 1).

Further, the control apparatus switches on the separate motor 100, the convey motor 101 and the belt motor 102 to convey the original having its leading end rammed against the second feeding rollers 9 and nipped by the first feeding rollers 16 to the sheet paths (c) and (d) (ent 2). Thereby, the driving of the first feeding rollers 16, the second feeding rollers 9 and the wide belt 7 is started. Simultaneously therewith, a size check counter is started (ent 3). The size check counter is a counter which counts by a clock signal inputted from a reverse clock.

Thereafter, the control apparatus waits while discriminating whether the original has been conveyed to the sheet path (c), on the basis of whether the result of the detection by the register sensor 39 has become ON (that is, whether the leading end of the original has been detected) (ent 4).

When it is confirmed that the original has been conveyed to the sheet path (c), whether the result of the detection by the separate sensor 30 is ON (that is, whether the trailing end of the original has passed the detecting position of the separate sensor 30) is determined (ent 5). When as the result of this determination, it is confirmed that the trailing end of the original has passed the detecting position of the separate sensor 30, a separate off counter is started (ent 6). The separate off counter counts by a clock signal inputted from a separate clock. The control apparatus waits for the count corresponding to the distance from the first feeding rollers 16 to the separate sensor 30 to be finished (ent 7).

At the point of time whereat the count is finished, the trailing end of the original has already passed the first feeding rollers 16, and therefore the control apparatus switches off the separate motor 100 to thereby stop the driving of the first feeding rollers 16 (ent 8). Thereafter, the control apparatus waits for the sheet supply sensor 35 to become OFF (ent 9). When the sheet supply sensor 35 is OFF (that is, when the trailing end of the original passed the detecting position of the sheet supply sensor 35), the size check counter is stopped (ent 10), and on the basis of the data thereof, size check treatment (ent 11) is effected. This size check treatment will be described later with reference to FIG. 45.

Further, thereafter, a register counter is started to stop the original at a predetermined position on the platen 3 (ent 12). The register counter is counted by a belt excitation clock.

Thereafter, the control apparatus waits for the register counter to count for the distance L4 from the sheet supply sensor 35 to the second feeding rollers 9 (ent 13). After the register counter has counted for the distance L4, the control apparatus switches off the convey motor 101 (ent 14). Thereafter, it waits for the started register counter to finish the count (ent 15). When the count is finished, the control apparatus switches off the belt motor 102 (ent 16). Further, it switches off the path switch solenoid 107 (ent 17).

2) (3)(v) Pre-reverse Treatment

Figure 40:
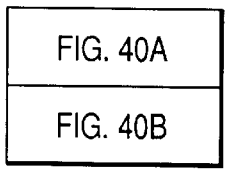
FIG. 40 is comprised of FIGS. 40A and 40B are flow charts showing a pre-reversing treatment for an original.
Figure 40A:
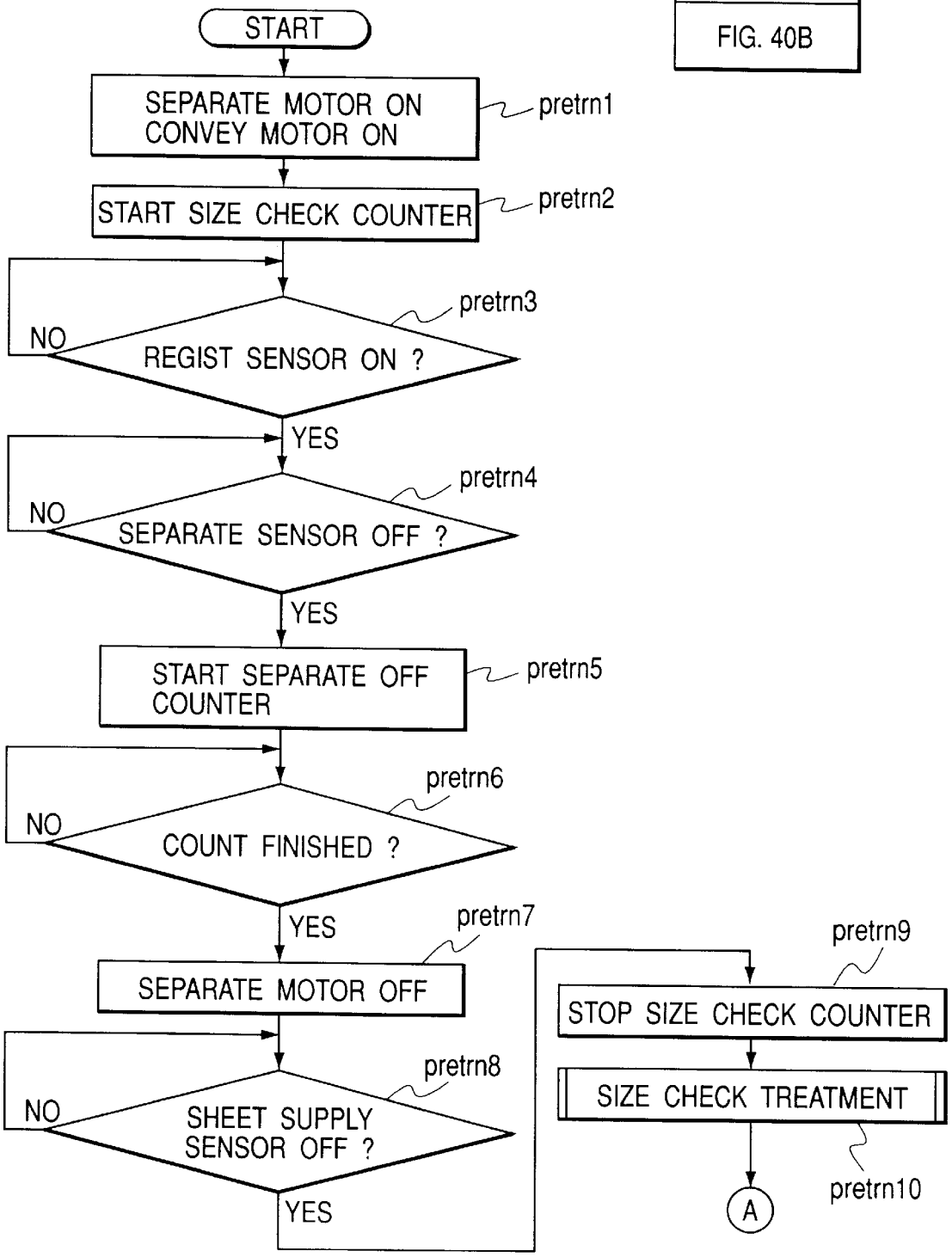
Figure 40B:
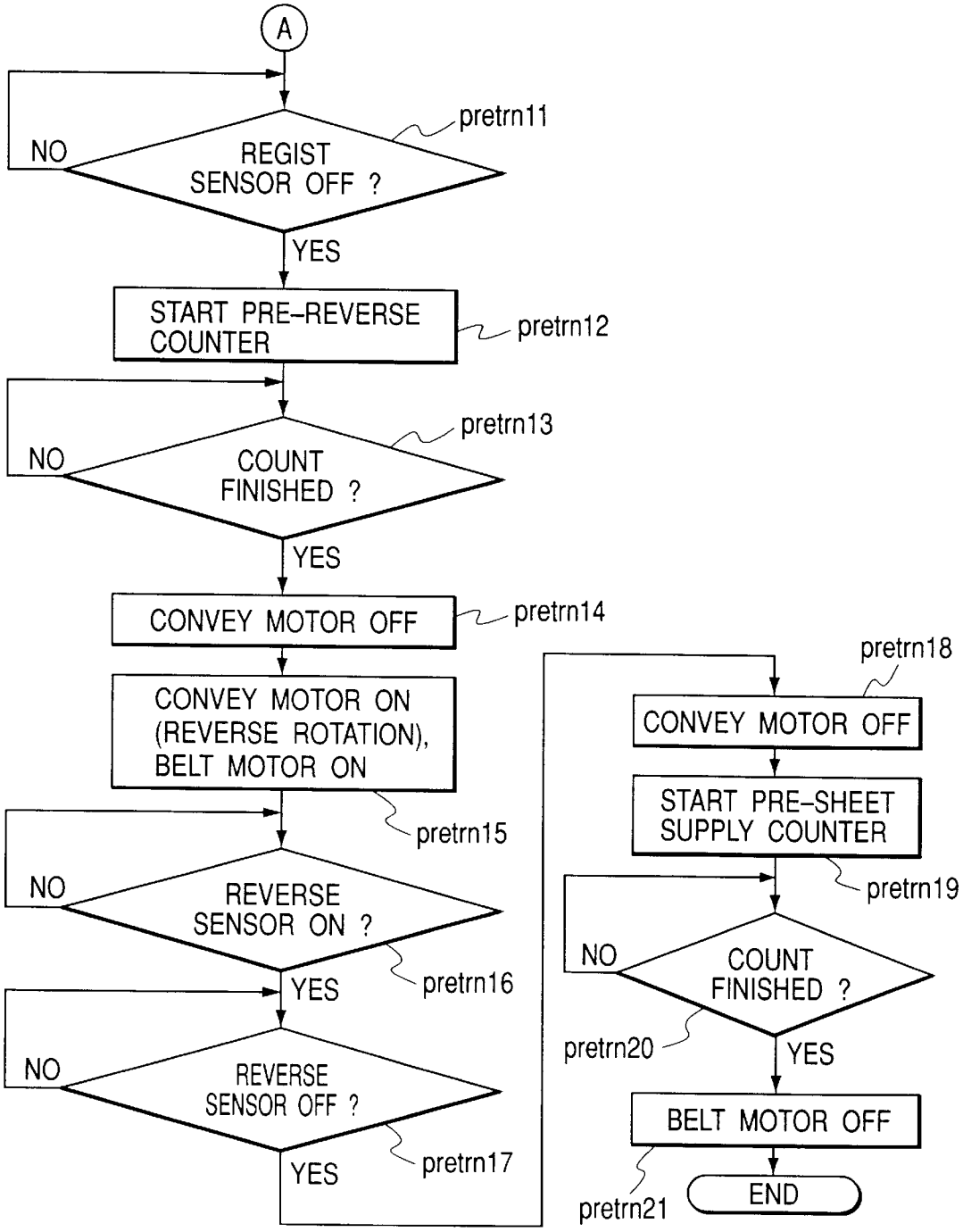

Pre-reverse treatment will hereinafter be described with reference to FIGS. 40A and 40B.

The reverse sheet supply flapper 22, as indicated by solid line in FIG. 13, is usually biased so that the original may be conveyed to the sheet path (h) in the OFF state of the path switch solenoid 107.

The control apparatus switches on the separate motor 100 and the convey motor 101 to convey the original having its leading end abutted against the second feeding rollers 9 and nipped by the first feeding rollers 16 to the sheet paths (c) and (d) (pretrn 1). Thereby, the driving of the first feeding rollers 16, the second feeding rollers 9, the first reversing rollers 17 and the second reversing rollers 18 is started. Simultaneously therewith, a size check counter is started (pretrn 2). The size check counter is a counter which counts by a clock signal inputted from a reverse clock.

Thereafter, the control apparatus waits while discriminating whether the original has been conveyed to the sheet path (h) on the basis of whether the result of the detection by the register sensor 39 has become ON (that is, whether the leading end of the original has been detected) (pretrn 3).

When it has been confirmed that the original has been conveyed to the sheet path (c), whether the result of the detection by the separate sensor 30 is ON (that is, and whether the trailing end of the original has passed the detecting position of the separate sensor 30) are determined (pretrn 4). When as the result of this determination, it is confirmed that the trailing end of the original has passed the detecting position of the separate sensor 30, a separate off counter is started (pretrn 5). The separate off counter counts by a clock signal inputted from a separate clock. The control apparatus waits for the count for the distance from the first feeding rollers 16 to the separate sensor 30 to be finished (pretrn 6).

At a point of time whereat the count has been finished, the trailing end of the original has already passed the first sheet supply roller 16, and therefore the control apparatus switches off the separate motor 100 to thereby stop the driving of the first feeding rollers 16 (pretrn 7). Thereafter, the control apparatus waits for the sheet supply sensor 35 to become OFF (pretrn 8). When the sheet supply sensor 35 became OFF (that is, when the trailing end of the original passed the detecting position of the sheet supply sensor 35), the size check counter is stopped (pretrn 9) and on the basis of the data thereof, size check treatment is effected (pretrn 10).

Thereafter, the control apparatus waits for the register sensor 39 to become OFF (pretrn 11). When the register sensor 39 became OFF (that is, when the trailing end of the original passed the register sensor 39), a pre-reverse counter is started to stop the trailing end of the original at a predetermined position whereat the trailing end passed the sheet path (h) (pretrn 12). This pre-reverse counter is a counter counted by a pre-reverse excitation clock.

Now, at this time, the reverse flapper 23, as indicated by solid line in FIG. 13, is biased so that the original may be conveyed to the sheet path (i). Thereafter, at a point of time whereat the count by the pre-reverse counter has been finished (pretrn 13), the control apparatus switches off the convey motor 101 (pretrn 14). After the lapse of a predetermined time, the control apparatus starts the reverse rotation of the convey motor 101 and switches on the belt motor 102 to thereby convey the original to the sheet path (e) (pretrn 15).

The control apparatus confirms that the reverse sensor 50 becomes ON, to thereby confirm the original has been conveyed to the sheet path (e) (pretrn 16).

Thereafter, the control apparatus waits for the reverse sensor 50 to become OFF, that is, waits for the trailing end of the original to pass the detecting position of the reverse sensor 50 (pretrn 17), and switches off the convey motor 101 (pretrn 18). Further, the control apparatus starts a pre-sheet supply counter to stop the original at a predetermined position on the platen (pretrn 19). The pre-sheet supply counter is counted by a belt excitation clock. At a point of time whereat the count by the pre-sheet supply counter has been finished (pretrn 20), the control apparatus switches off the belt motor 102 (pretrn 21).

2) (3)(vi) Reverse Treatment

Figure 41:
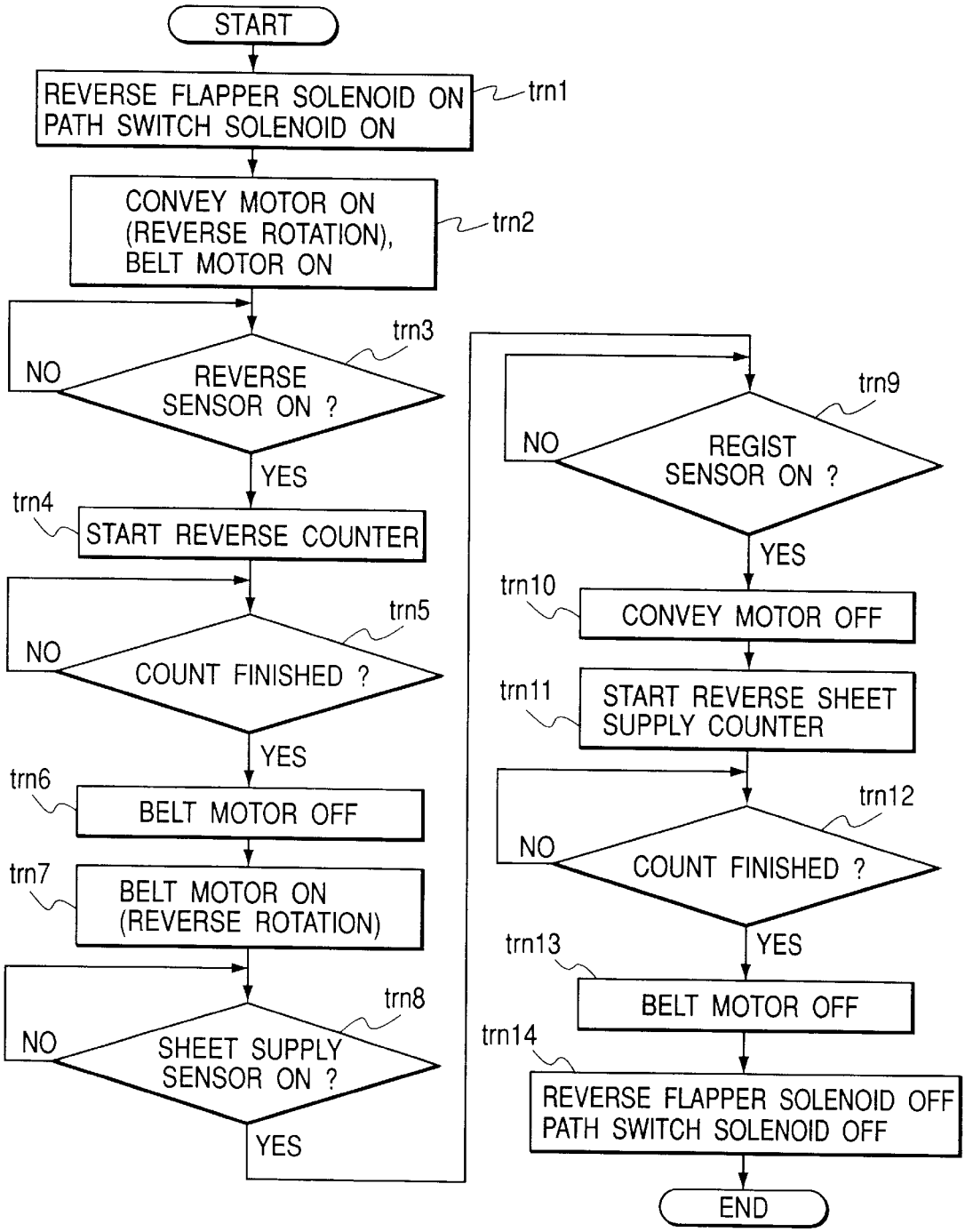
FIG. 41 is a flow chart showing a reversing treatment.

Reverse treatment will now be described with reference to FIG. 41.

In the OFF state of the reverse flapper solenoid 108, the reverse flapper 23, as indicated by solid line in FIG. 13, is biased so that the original may be conveyed to the sheet path (i). The control apparatus switches on the reverse flapper solenoid 108 to thereby switch the reverse flapper 23 to its state depicted by solid line in FIG. 13. Further, the control apparatus switches on the path switch flapper solenoid 107 to thereby switch the reverse sheet supply flapper 22 and the supply and discharge flapper 25 to their respective states depicted by broken lines in FIG. 13 (trn 1).

Subsequently, the control apparatus switches on the belt motor 102 and the convey motor 101 to convey the original on the platen 3 to the sheet path (e) (trn 2). Thereby, the wide belt 7, the second feeding rollers 9, the first reversing rollers 17 and the second reversing rollers 18 are driven.

The control apparatus waits for the reverse sensor 50 to become ON (trn 3). When the reverse sensor 50 became ON (that is, when the leading end of the original passed the detecting position of the reverse sensor 50), a reverse counter is started to count up to a predetermined value (trn 4). The reverse counter is a counter counted by a belt excitation clock. The predetermined value here is set to stop/reverse the belt motor 102 when the leading end of the original arrived at a predetermined position in the sheet paths (f) and (g).

Thereafter, the control apparatus waits for the count by the reverse counter to be finished (trn 5). When the count by the reverse counter is finished, the control apparatus switches off the belt motor 102 (trn 6). Further, after the lapse of a predetermined time, the control apparatus starts the reverse rotation of the belt motor 102 (trn 7). In the meantime, the convey motor 101 is kept ON, and the first reversing rollers 17 by which the original is nipped, the second reversing rollers 18 and the second feeding rollers 9 are being driven. The original is conveyed to the sheet paths (f) and (g).

The control apparatus waits for the sheet supply sensor 35 to become ON (trn 8). The control apparatus confirms that the sheet supply sensor 35 has become ON (that is, the leading end of the original has passed the detecting position of the sheet supply sensor 35), thereby confirming that the original is conveyed in the sheet path (g).

The control apparatus waits for the register sensor 39 to become ON (trn 9). Then, the control apparatus switches off the convey motor 101 when the register sensor 39 became ON (trn 10). Simultaneously therewith, the control apparatus starts the count by a reverse sheet supply counter to stop the original at a predetermined position on the platen 3 (trn 11). The reverse sheet supply counter is counted by the belt excitation clock. Then, the control apparatus waits for the count by the reverse sheet supply counter to be finished (trn 12).

When the count by the reverse sheet supply counter is finished, the control apparatus switches off the belt motor 102 (trn 13). Further, it switches off the reverse flapper solenoid 108 to thereby bring the reverse flapper 23 into its state depicted by solid line in FIG. 3. Also, it switches off the path switch solenoid 107 to thereby return the reverse sheet supply flapper 22 and the supply and discharge flapper 25 to their states depicted by solid lines in FIG. 13.

At (trn 7), the first reversing rollers 17 and the wide belt 7 pull the original in opposite directions. However, the nipping force of the first reversing rollers 17 is stronger, and therefore the original follows the first reversing rollers 17 and is conveyed. However, in the case of an original long in the feeding direction, such original is greatly affected by the nipping force between the pressing roller in the wide belt 7 and the platen 3, and therefore does not follow the first reversing rollers 17. Therefore, the belt motor 102 is stopped and the timing for reverse rotation (i.e., the value counted by the reverse counter) is set in conformity with the length of the original in the feeding direction.

2) (3)(vii) Sheet Discharge Treatment

Figure 42:
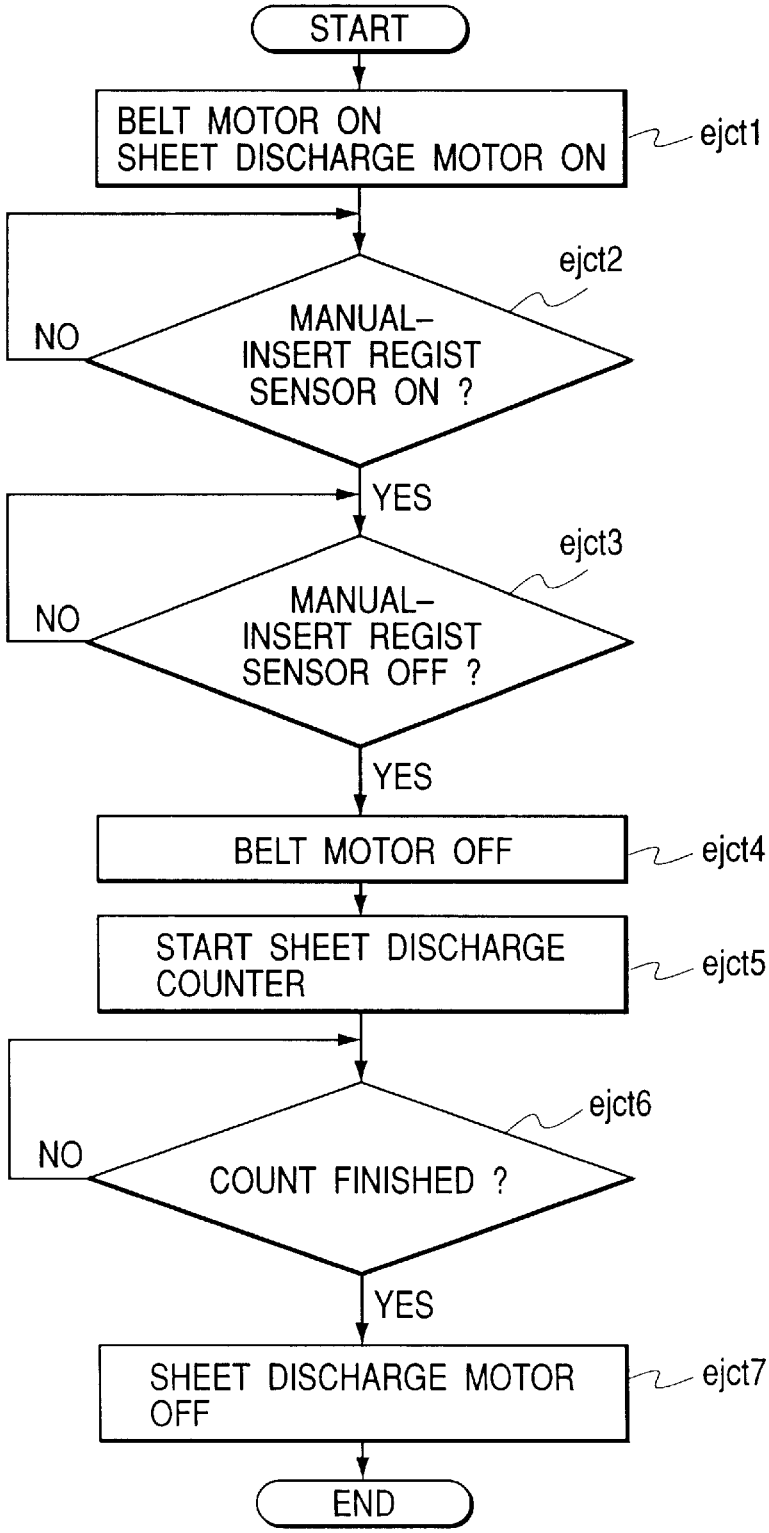
FIG. 42 is a flow chart showing a sheet discharging treatment.

Sheet discharge treatment will now be described with reference to FIG. 42.

In the OFF state of the sheet discharge flapper solenoid 109, the sheet discharge flapper 26, as indicated by broken line in FIG. 13, is biased so that the tip end portion of the flapper may be lower than the platen 3. The control apparatus switches on the belt motor 102 and the sheet discharge motor 104 to convey the original on the platen 3 to the sheet paths (d) and (j) (ejct 1). Thereby, the wide belt 7, the manual-insert sheet supply roller 13 and the sheet discharge roller 12 are driven.

The control apparatus confirms that the original is conveyed in the sheet path (j), on the basis of whether the result of the detection by the manual-insert original detect sensor 60 became ON (that is, whether the leading end of the original has passed the detecting position of the manual-insert original detect sensor 60) (ejct 2). When the result of the detection by the manual-insert original detect sensor 60 became ON (that is, when it is confirmed that the original is conveyed in the sheet path (j)), the control apparatus waits for the trailing end of the original to pass the detecting position of the manual-insert original detect sensor 60 (ejct 3), and switches off the belt motor 102 (ejct 4).

Also, the control apparatus starts the count by a sheet discharge counter (ejct 5). The sheet discharge counter counts by a clock signal inputted from a sheet discharge clock. In the meantime, the control apparatus confirms whether the count value by the sheet discharge counter has reached a predetermined value (ejct 6). When the count value reached the predetermined value, the control apparatus switches off the sheet discharge motor 104 (ejct 7). At this time, the original has already passed the sheet path (j), has passed the sheet discharge rollers 12 and has been discharged onto the sheet discharge tray 10.

2) (3)(viii) Manual-Insert Sheet Supply Treatment

Figure 43:
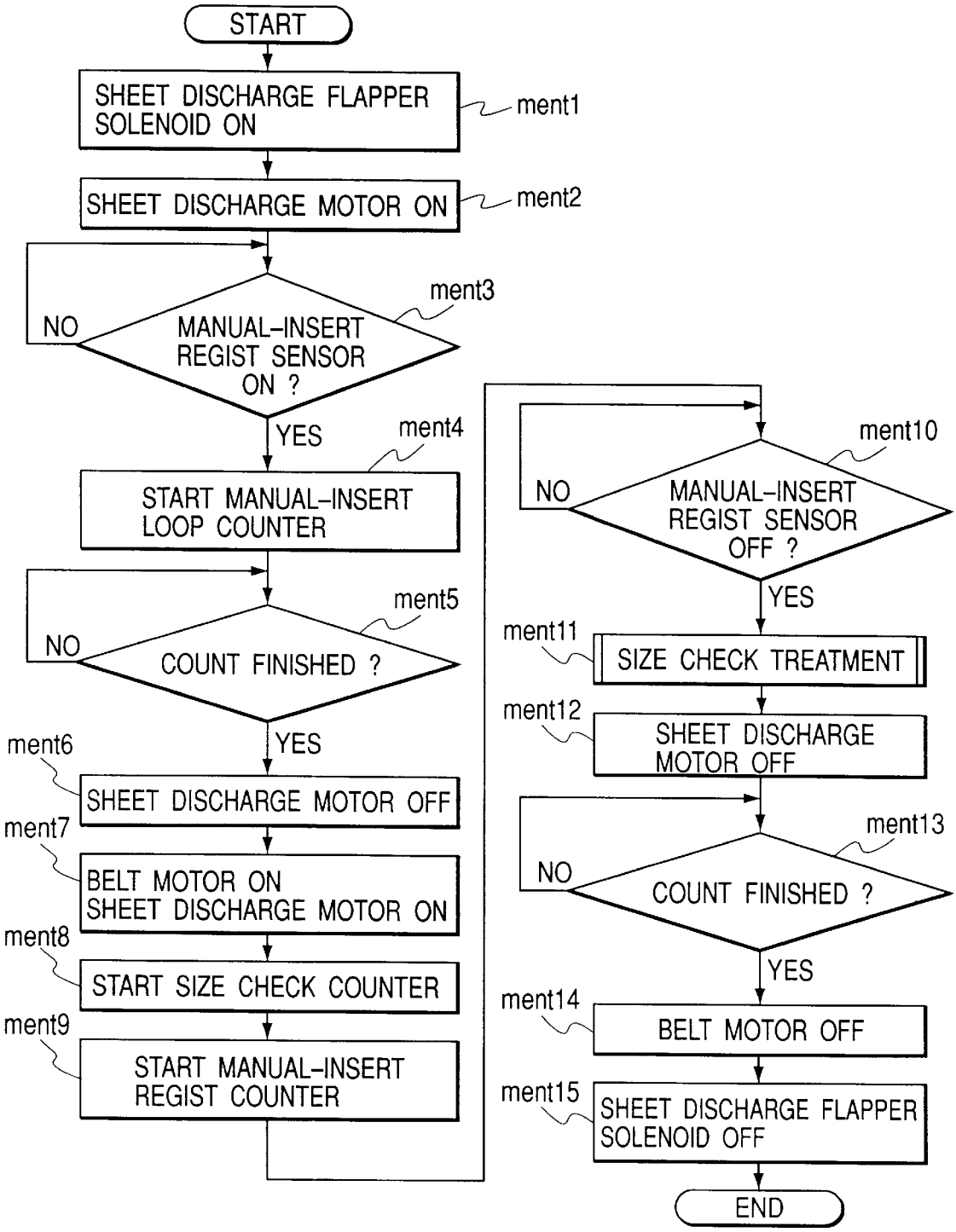
FIG. 43 is a flow chart showing a manual-insert sheet supplying treatment.

Manual-insert sheet supply treatment will now be described with reference to FIG. 43.

In the OFF state of the sheet discharge flapper solenoid 109, the sheet discharge flapper 26, as indicated by solid line in FIG. 4, has its tip end portion biased to a position lower than the platen. Also, the manual-insert shutter 28 is in a state in which the leading end of the original set on the manual-insert original tray 14 is abutted against it. The control apparatus switches on the sheet discharge flapper 109 and switches the manual-insert shutter 28 and the sheet discharge flapper 26 to their states depicted by broken lines in FIG. 4 (ment 1). Subsequently, it switches on the sheet discharge motor 104 and rotates the manual-insert sheet supply roller 13 (ment 2). Thereby, the original is conveyed in the sheet path (k).

The control apparatus determines whether the leading end of the original has passed the detecting position of the manual-insert register sensor 34, on the basis of whether the result of the detection by the manual-insert register sensor 34 has become ON (ment 3). When the result of the detection by the manual-insert register sensor 34 has become ON (that is, when the leading end of the original passed the detecting position of the manual-insert register sensor 34), the control apparatus starts the count by a manual-insert loop counter (ment 4). The manual-insert loop counter is counted by a clock signal inputted from a sheet discharge clock. When the count by the manual-insert loop counter reaches a predetermined value (ment 5), the control apparatus switches off the sheet discharge motor 104 (ment 6). Thereby, the original has its leading end abutted against the nip portion of the manual-insert register rollers 11, and is stopped with a predetermined amount of loop formed, and the skew-feed thereof which has occurred during the conveyance thereof by the manual-insert sheet supply roller 13 is corrected.

After the lapse of a predetermined time after the sheet discharge motor 104 is switched off, the control apparatus switches on the sheet discharge motor 104 and the belt motor 102 to convey the original to the sheet paths (k) and (d) (ment 7). Thereby, the manual-insert sheet supply roller 13, the manual-insert register rollers 11 and the wide belt 7 are driven.

Simultaneously therewith, the control apparatus starts a size check counter (ment 8). Further, it starts a belt register counter (ment 9). The size check counter counts by a clock signal inputted from a belt clock. The belt register counter is counted by a belt excitation clock to stop the original at a predetermined position on the platen 3. When it is detected that the manual-insert register sensor 34 has become OFF (that is, the trailing end of the original has passed the detecting position of the manual-insert register sensor 34) (ment 10), the control apparatus stops the size check counter. On the basis of the data thereof, it effects size check treatment (ment 11) shown in FIG. 43.

Also, the trailing end of the original has already passed the manual-insert sheet supply roller 13, and therefore the control apparatus switches off the sheet discharge motor 104 (ment 12). Thereafter, at a point of time whereat the count value of the manual-insert register counter has reached a predetermined value (ment 13), it switches off the belt motor 102 (ment 14), and then, it switches off the sheet discharge flapper solenoid 109 (ment 15).

2) (3)(ix) Original Flow-reading Treatment

Figure 44:
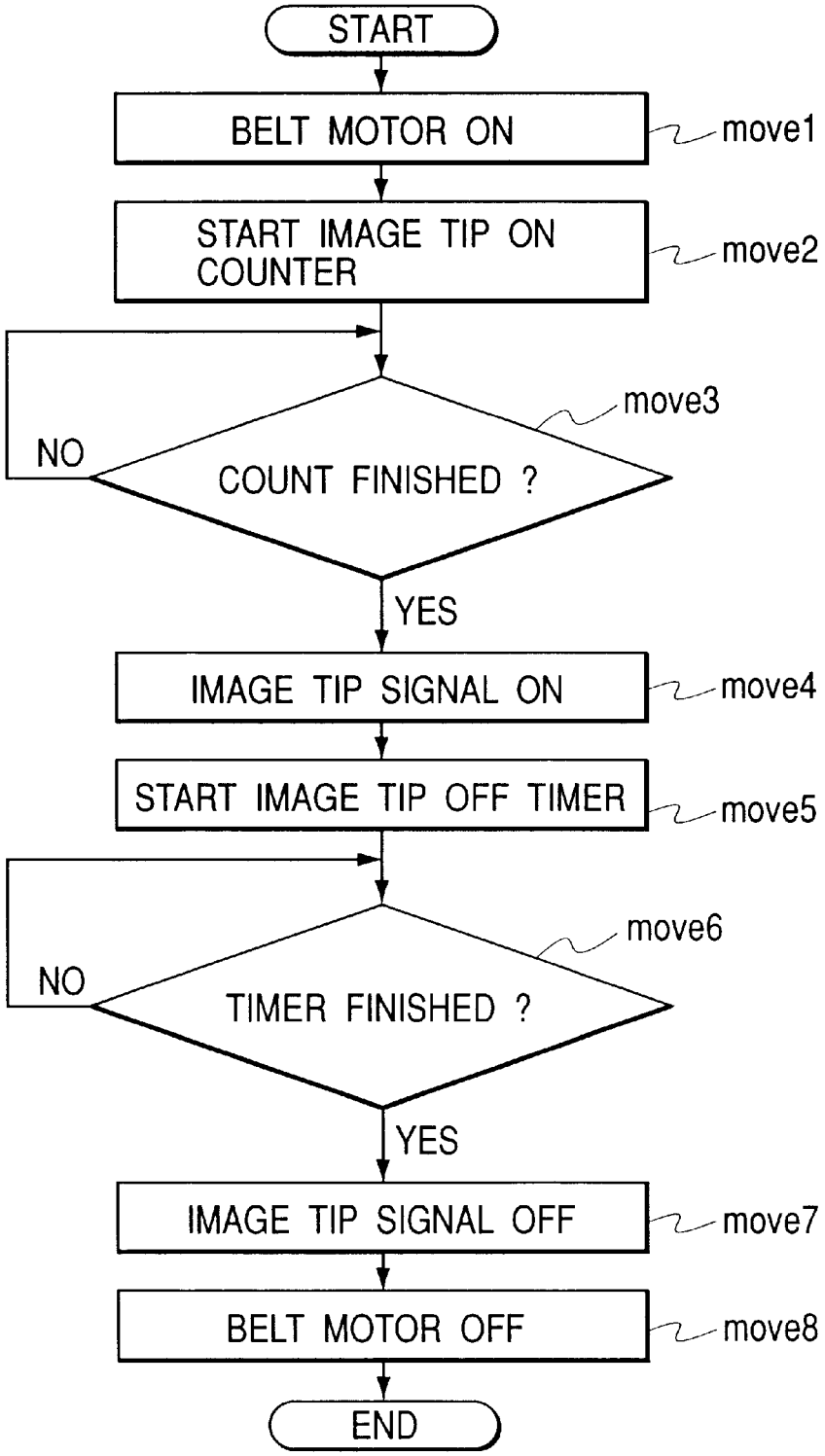
FIG. 44 is a flow chart showing an original flow-reading treatment.

Original flow-reading treatment will now be described with reference to FIG. 44.

The control apparatus switches on the belt motor 102 (move 1) and drives the wide belt 7 to read the image of the original by the fixed optical system of the copying apparatus body. Simultaneously therewith, it starts an image tip on counter to turn on an image tip signal when the leading end of the original arrived at a predetermined position (move 2). The image tip on counter is counted by the belt excitation clock. The control apparatus outputs an excitation clock signal on the basis of flow-reading speed data (V) received from the copying apparatus body at this time to thereby effect the constant speed control of the rotation of the belt motor 102. Thereafter, at a point of time whereat the count value of the image tip on counter has reached a predetermined value (move 3), it turns on the image tip signal (transmits it to the copying apparatus body) (move 4).

The copying apparatus body receives this image tip signal, whereafter it calculates the time until the leading end of th e original arrives at the fixed position of the optical system during the flow-reading, and effects actual image reading. After the lapse of a predetermined time, the control apparatus turns off the image tip signal (moves 5, 6, 7). Thereafter, when the trailing end of the original has passed the reading position, the control apparatus switches off the belt motor 102 (move 8).

The flow-reading speed data (V) may be equal to or differ from the reading speed (V1) during the movement of the optical system. Particularly, when it is set to V>V1, the reading of the image of the original is completed within a shorter time than the ordinary movement reading by the optical system, and therefore the copying speed is improved.

2) (3)(x) Size Check Treatment

Figure 45:
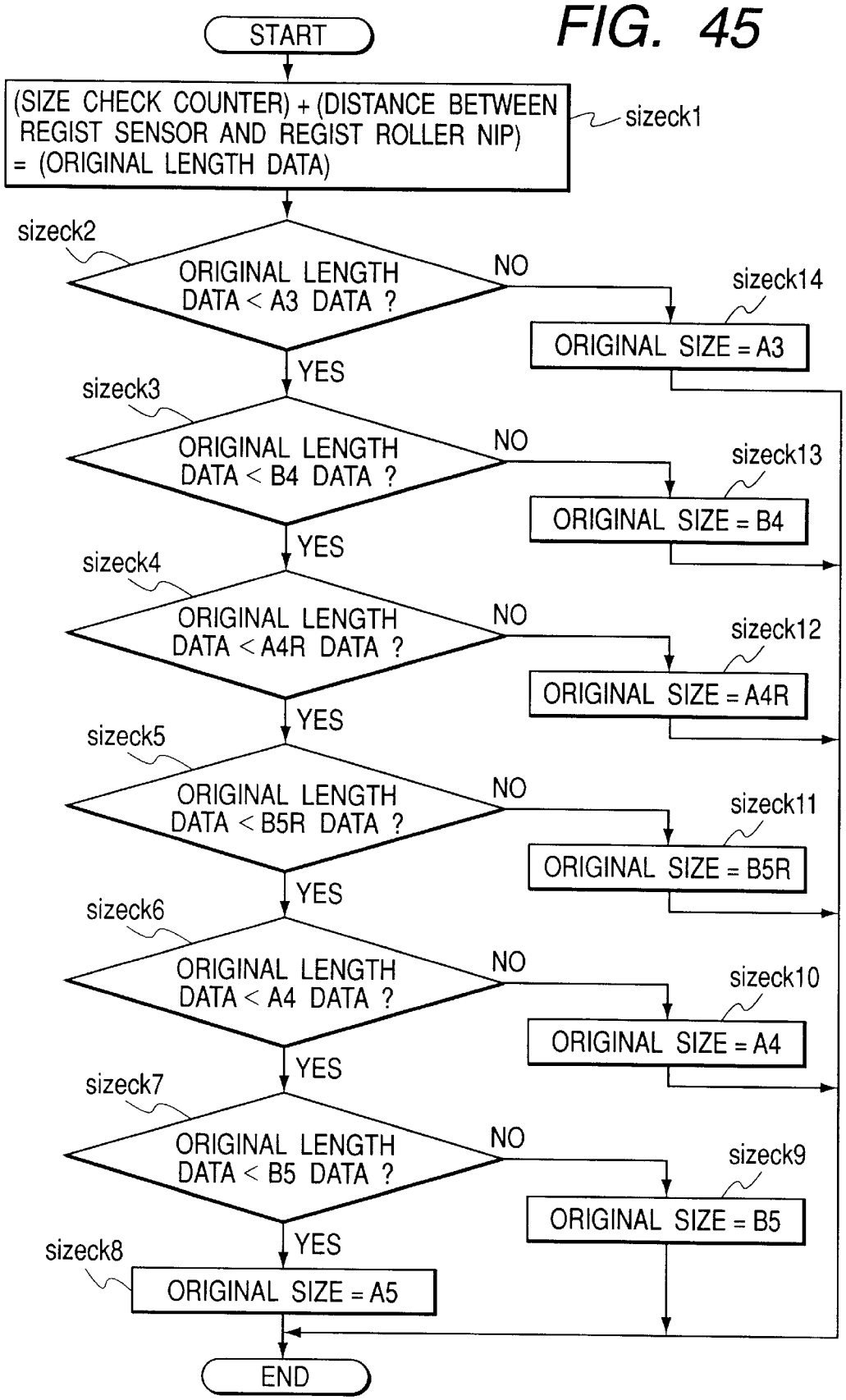
FIG. 45 is a flow chart showing a size check treatment.

Size check treatment will now be described with reference to FIG. 45.

In this size check treatment, the distance from the nip position of the second feeding rollers 9 to the sheet supply sensor 35 is added to size check counter data and is corrected to thereby obtain a true original size (the length in the feeding direction) (sizeck 1). The original is conveyed by the second feeding rollers 9 and the wide belt 7, and the amount of feed thereof and the count value by the belt excitation clock positively coincide with each other.

Thereafter, the control apparatus determines the found true original size (sizeck 1 to sizeck 7). on the basis of the result of this determination, it concludes that the then original size is one of A5, B5, A4, B5R, A4R, B4, A3, etc. (sizeck 8 to sizeck 14).

What has been described above is the description of the ADF 2 in the present embodiment.

[Printer Unit 300]

Figure 2:
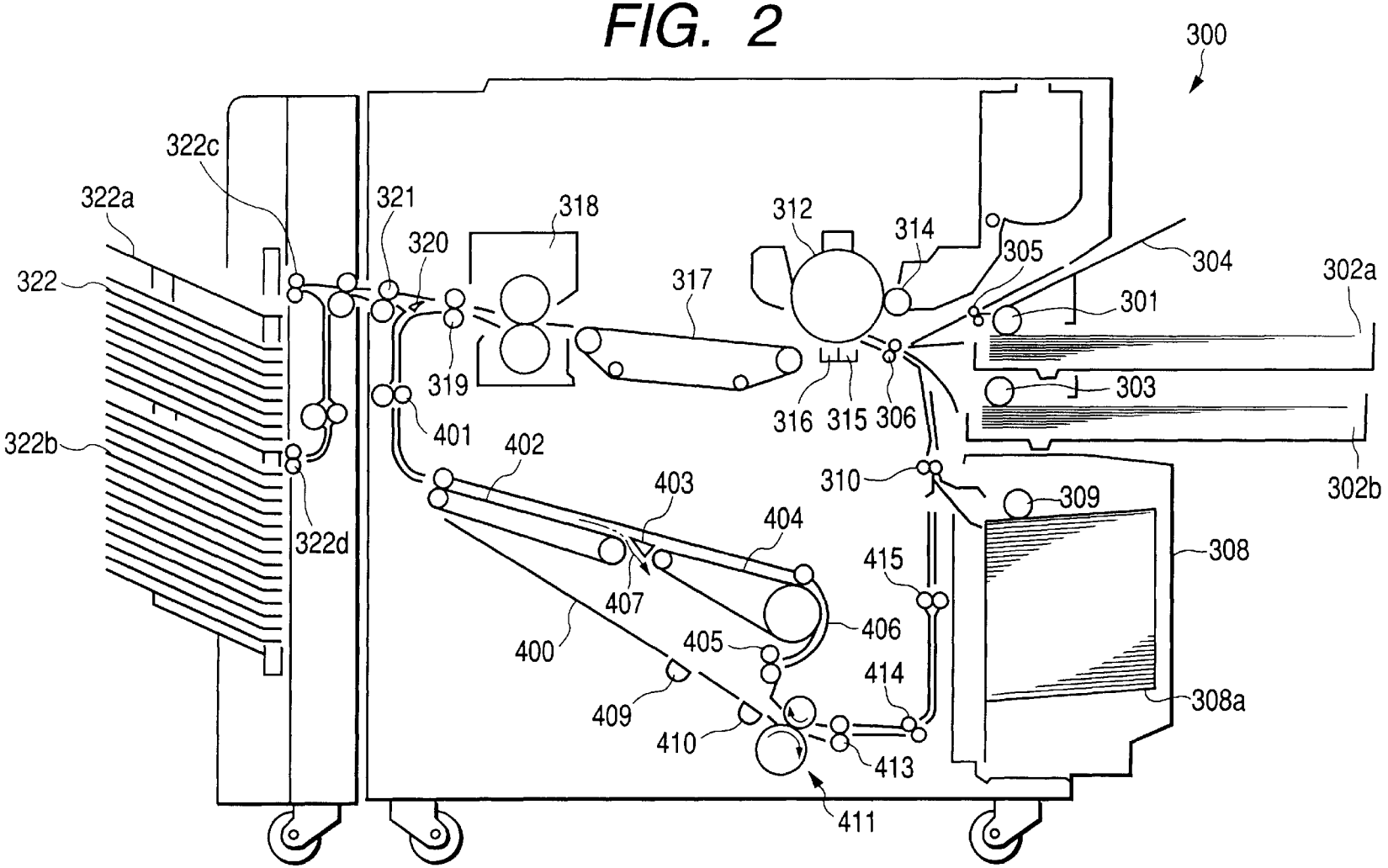
FIG. 2 shows the detailed construction of a printer unit.

The printer unit 300 which is an image outputting portion will hereinafter be described with reference to FIG. 2.

Sheets on which images are to be formed are contained in an upper cassette 302*a*, a lower cassette 302*b* and a sheet stack device 308. Each time an image is formed on a photosensitive drum 312 which will be described later, a sheet is fed from one of the cassettes 302*a*, 302*b* and the deck 308.

The sheets in the upper cassette 302*a* are separated and directed one by one to register rollers 306 by the action of a separating pawl and a feeding roller 301. Likewise, the sheets in the lower cassette 302*b* are separated and directed one by one to the register rollers 306 by the action of a separating pawl and a feeding roller 303. Also, the sheet stack device (deck type) 308 is provided with an inner plate 308*a* movable up and down by a motor or the like. The sheets on the inner plate 308*a* are separated and directed one by one by the action of a separating pawl and a feeding roller 309.

Besides these, sheets can also be supplied from a manual-insert guide 304. The sheets placed on the manual-insert guide 304 are directed one by one to register rollers 306 through a roller 305.

An image forming unit is provided with a photosensitive drum 312, a developing device 314, a transfer charger 315, a separating charger 316, etc. In the image forming unit, the electrostatic latent image of an image read by the scanner unit 204 of a reader unit 200 is formed on the photosensitive drum 312. A toner image obtained by developing the electrostatic latent image is transferred to a sheet fed from one of the cassettes 302*a*, 302*b* and the deck 308. The alignment of the toner image on the photosensitive drum 312 with the sheet fed thereto is done by the register rollers 306.

The above-described image formation is repeated in conformity with a set number of copies.

In the image forming unit, the sheet to which the toner image has been transferred is directed to a fixating device 318 by a conveying belt 317 to fix the toner image thereat. Thereafter, the sheet is conveyed to a sorter 322 by conveying rollers 319, a flapper 320, discharge rollers 321, etc. The sorter 322 has a non-sort tray 322*a*, a sort bin tray 322*b*, non-sort tray discharge rollers 322*c* and sort bin tray discharge rollers 322*d*. The sorter 322 sorts the sheets one stage by one by the non-sort tray 322*a* and the sort bin tray 322*b* are moved up and down. In some cases, a discharge tray is mounted in place of the sorter 322.

When a necessary number of copies are formed, the aforedescribed ADF 2 discharges the original thereof from the platen 3 and conveys the next original and positions it on the platen 3. Thereafter, a similar operation is repeated.

An intermediate tray 400 is for stocking sheets on which images have been once formed when images are to be formed on the both surfaces of a sheet or when images are to be superimposedly (multiplexly) formed on one surface of a sheet. The conveyance and reception of the sheets having images formed thereon to the intermediate tray 400 are done by conveying rollers 401, a conveying belt 402, a flapper 403, a conveying belt 404, conveying rollers 405, etc.

In the case of both-surface copy, the sheets is directed to the intermediate tray 400 through a path 406. In this case, the sheet has its image surface turned upward. In the case of multiplex copy, the sheet is directed to the intermediate tray 400 through a path 407. The sheet has its image surface turned downward. The sheets stacked on the intermediate tray 400 are separated one by one from the lowermost one by auxiliary rollers 409, 410 and a pair of forward and reverse rotation separating rollers 411 and refed. The refed sheet is again directed to the image forming unit through conveying rollers 413, 414, 415, rollers 310 and register rollers 306. After the image formation, the sheet is discharged as previously described.

The procedure of both-surface copy will now be described.

First, for an original disposed on the platen, one-surface copying is done in conformity with the number of copies set at that time. At this time, the sheet having an image formed on one surface thereof is placed on the intermediate tray 400. Thereafter, the original on the platen 3 is reversed by the ADF 2 and is again directed onto the platen 3. Then, the image of this original is again read and is formed on the sheets refed from the intermediate tray 400. They are sorted in the order of pages by the sorter 322.

There is also a method of making only one set of copies each time an original is caused to make a round by the ADF 2. According to this method, even when a plurality of copies are made, groups of copies good in the order of pages are successively obtained and therefore, a necessary number of copies can be sorted and obtained even if there is not the sorter. When both-surface copying is to be done by this method, sorted groups of both-surface copies can be obtained if the both surfaces of an original are successively read and copied on the front and back surfaces of a sheet and this original is then discharged, whereafter this is repeated many times for the both surfaces of the next original.

According to the above-described embodiment, any delay in the separation of originals can be prevented without causing the abutments of the originals.

The present embodiment is an automatic original feeding apparatus for feeding sheet-like originals provided in an image forming apparatus. However, the present invention is generally applicable to a sheet conveying apparatus for conveying sheets.

Also, in the present invention, the mechanism for separating sheets one by one is not particularly restricted. Various separating devices such as the well-known separating pad system and the retard separating system can also be adopted.

Also, as the paths 71 and 72, a wide path is partly used in common, but alternatively, a guide plate may be provided in the central portion to thereby make the paths completely independent of each other, and an inlet portion and an outlet portion may be made to meet each other, and the flapper 70 may be provided at the inlet.

Figure 46:
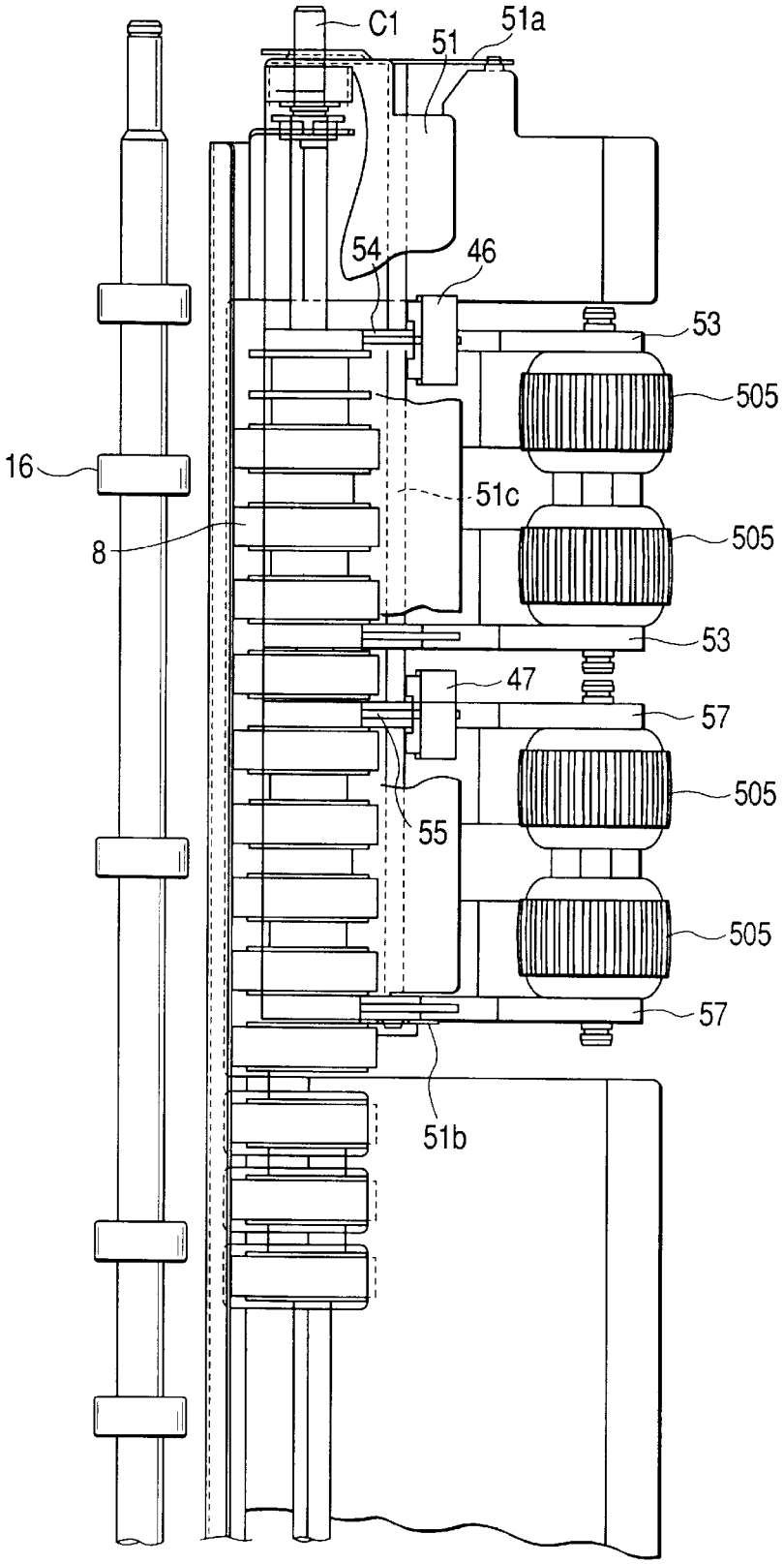
FIG. 46 is a plan view of another example of the paper supplying portion of a sheet conveying apparatus.
Figure 47A:
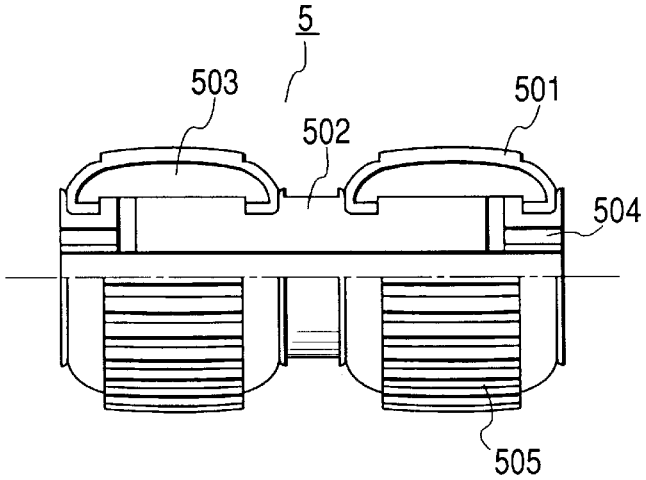
FIGS. 47A and 47B are a front view, partly in longitudinal cross-section, and a side view, respectively, of the sheet supply roller of FIG. 46.
Figure 47B:
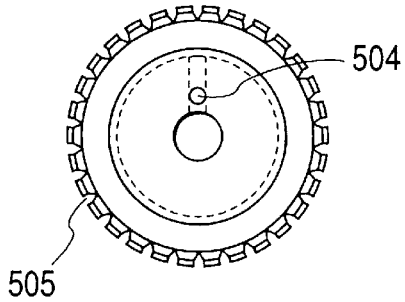
Figure 48:
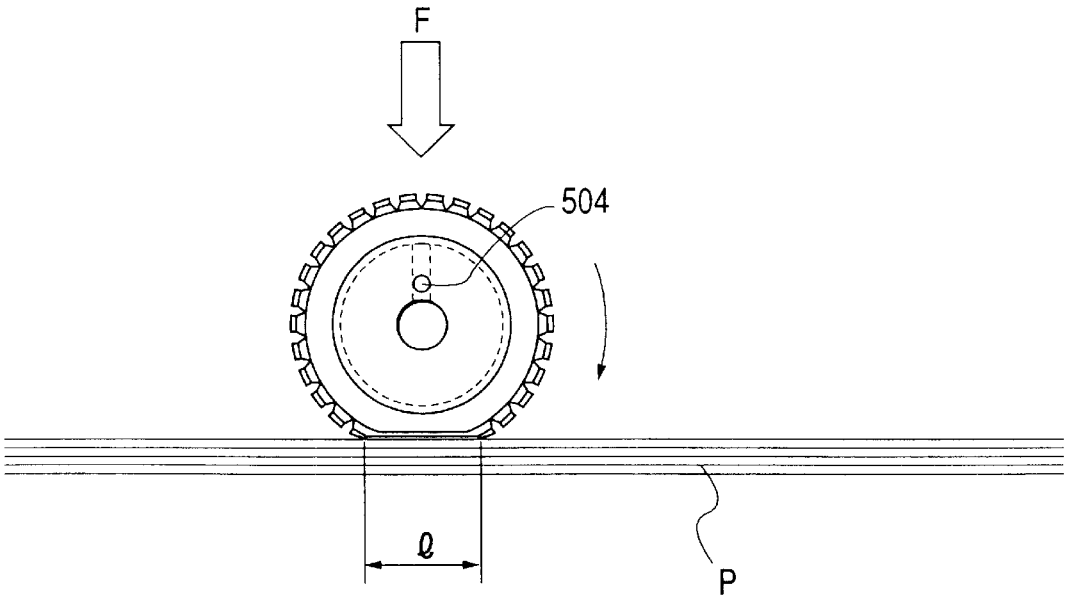
FIG. 48 shows the state of contact between the sheet supply roller of FIGS. 47A and 47B and a sheet.
Figure 49:
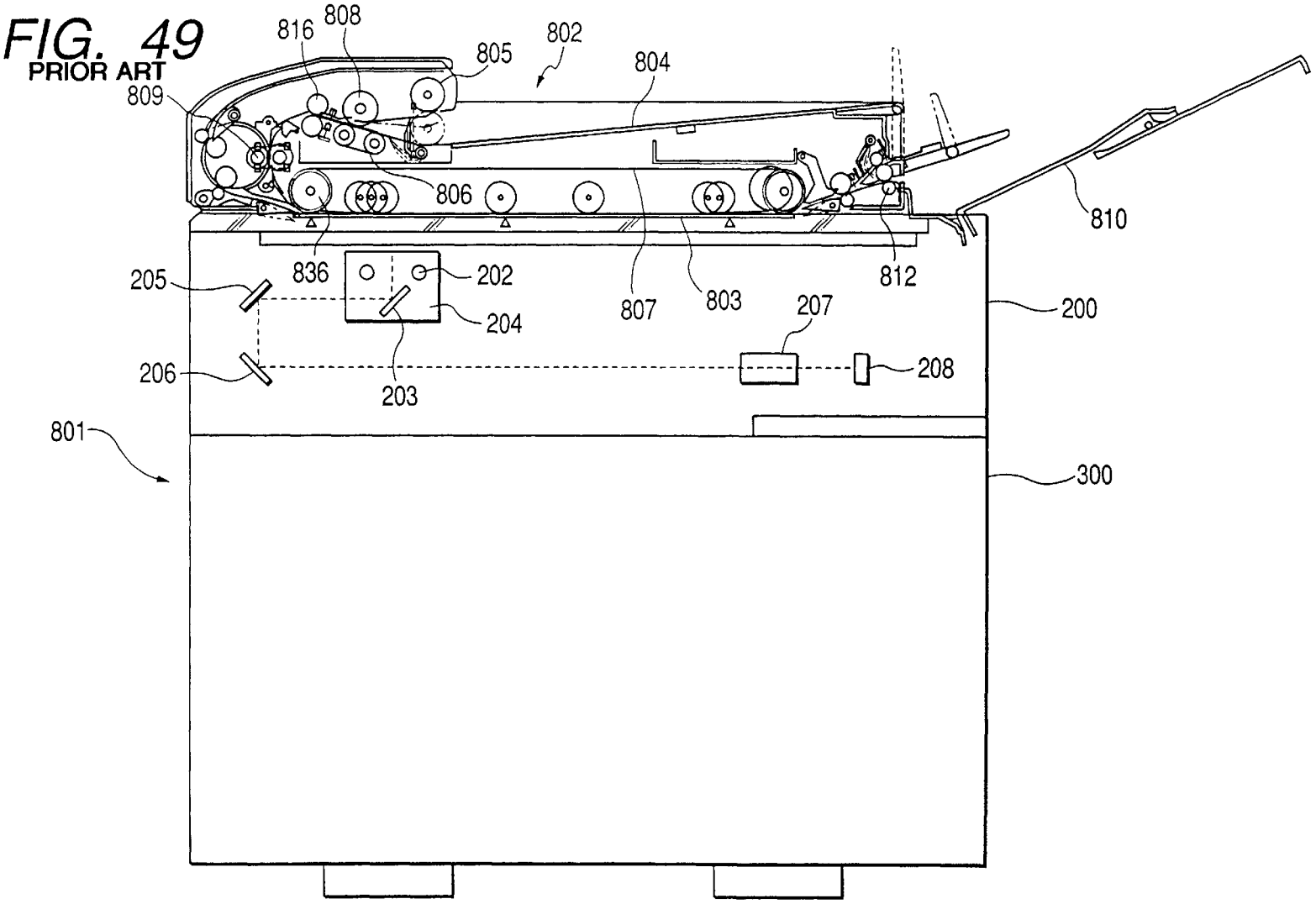
FIG. 49 PRIOR ART
FIG. 49 shows an example of the prior art.

Also, the sheet supply roller 505, as shown in FIGS. 46, 47A and 47B, may be formed such that a rubber member (elastic member) 501 is wound around a core member 502 formed of resin or the like to support the rotary shaft of the roller. The rubber member 501 is formed of a rubber material having a high frictional force because it grips paper with a frictional force. Also, the sheet supply roller 505 is formed into a hollow shape so that the inside of the rubber member 501 may provide an air layer 503, and maintains a shape inflated by the elasticity of the rubber member 501 itself. Therefore, as shown in FIG. 48, it can be readily elastically deformed when a pressure force by the gravity of the roller is applied thereto when it supplies an original P, thereby increasing the surface of contact L between the original P and the roller.

Also, knurled grooves 505 are continuously formed on the outer periphery of the rubber member 501, and paper powder and toner powder created by friction when a sheet is supplied are taken into the grooves 505, whereby the paper powder and toner powder are prevented from adhering to the surface of the rubber contacting with the sheet to thereby reduce the frictional surface. An air hole 504 for communicating the air layer 503 of the rubber member 501 with the atmosphere is formed in the core member 504, whereby the air is readily drawn when the roller is elastically deformed, or the air readily comes in when the roller is inflated by its own elasticity.

By adopting such a construction for the sheet supply roller 505, the roller can be reading deformed to increase the surface of contact L between the original P and the roller to about two times to four times that of the conventional roller and therefore, the pressure per unit area becomes as low as ½ to ¼, and for example, when the sheet (original) supplied is an original written by a pencil or the like or a copy sheet outputted by a toner easy to peel, a pressure force F acts on the area L in which the sheet supply roller 505 contacts with the original P and therefore the pencil or the toner on the back of the sheet being supplied can be prevented from being retransferred onto the upper surface of the next sheet waiting by the pressure.

As described above, according to such construction of the roller, the feeding rotatable member for feeding the sheets on the stack means is made into a hollow shape having an air layer along the outer periphery thereof, and therefore in its state of contact with the sheet, it can be readily deformed to increase the area of contact with the sheet as compared with the conventional one, and the pressure per unit area becomes low and for example, when the sheet being supplied is an original written by a pencil or a copy sheet easy to peel, only a low pressure force acts on the area in which the feeding rotatable member contacts with the sheet and therefore, pencil powder or toner powder can be prevented from being retransferred onto the upper surface of the next sheet supplied to thereby contaminate the sheet.

What is claimed is:

1. A sheet conveying apparatus provided comprising:

a stacking portion on which sheets are stacked, separating means for separating and feeding out the sheets stacked on said stacking portion;

feeding means for feeding the sheets at a downstream side of said separating means;

a plurality of conveyance paths extending from said separating means to said feeding means; and switching means for switching said plurality of conveyance paths, wherein said separating means feeds out said sheets at a speed higher than a feeding speed of said feeding means.

2. A sheet conveying apparatus according to claim 1, wherein said switching means switches at a timing when a trailing end of a preceding sheet passes by said switching means.

3. A sheet conveying apparatus according to claim 2, wherein when said switching means switches, said separating means feeds a succeeding sheet.

4. A sheet conveying apparatus according to claim 3, wherein said feeding means is a pair of rotatable rollers receiving a leading end of the sheet in their stopped state, and thereafter is rotated to thereby feed the sheet.

5. A sheet conveying apparatus according to claim 4, wherein said separating means comprises a rotatable roller and means for preventing double feeding.

6. A sheet conveying apparatus according to claim 5, wherein said means for preventing double feeding is a rotary member reversely rotatable.

7. A sheet conveying apparatus according to claim 6, wherein the succeeding sheet is stopped immediately before a nip of said pair of rotatable rollers.

8. A sheet conveying apparatus according to claim 7, wherein when the preceding sheet is fed and the trailing end thereof passes by said pair of rotatable rollers, said pair of rotatable rollers are sopped and the succeeding sheet is re-fed by said separating means.

9. A sheet conveying apparatus according to claim 8, wherein said separating means has a pair of feeding rollers to feed the sheets after separated.

10. A sheet conveying apparatus according to claim 9, further comprising with reading means, and a rotary member for feeding the sheets fed by said pair of rotatable rollers to said reading means.

11. A sheet conveying apparatus according to claim 10, wherein said rotary member is a belt, and said reading means is disposed below a platen.

12. A sheet conveying apparatus according to one of claims 1 to 11, wherein said plurality of conveyance paths are divided by said switching means.

13. A sheet conveying apparatus according to one of claims 1 to 11, wherein said plurality of conveyance paths are divided by a guide plate to be selected by said switching means.

14. A sheet conveying apparatus according to one of claims 1 to 9, further comprising reading means, and a rotatable member for feeding the sheets fed by said feeding means to said reading means.

15. A sheet conveying apparatus according to claim 14, wherein said rotatable member is a belt, and said reading means is disposed below a platen.

16. A sheet reading apparatus comprising:

a sheet conveying apparatus according to one of claims 1 to 9, and reading means for reading the sheets conveyed by said sheet conveying apparatus.

17. An image forming apparatus comprising:

said sheet reading apparatus of claim 16; and image forming means for recording read images on the sheets.

* * * * *

UNITED STATES PATENT AND TRADEMARK OFFICE

CERTIFICATE OF CORRECTION

PATENT NO. : 6,038,424

DATED : March 14, 2000

INVENTOR(S): TOMOHITO NAKAGAWA

It is certified that error appears in the above-identified patent and that said Letters Patent is hereby corrected as shown below:

COVER PAGE AT ITEM [57] ABSTRACT:
Line 3, tacked" should read --stacked--.

COLUMN 2:
Line 16, "been" should read --be--.

COLUMN 32:
Line 55, "stacked," should read --stacked;--.

Signed and Sealed this

Twenty-seventh Day of February, 2001

Attest:

Nicholas P. Godici

NICHOLAS P. GODICI

Attesting Officer

Acting Director of the United States Patent and Trademark Office